US006542142B2

(12) United States Patent
Yumoto et al.

(10) Patent No.: US 6,542,142 B2
(45) **Date of Patent: *Apr. 1, 2003**

(54) VOLTAGE GENERATING CIRCUIT, SPATIAL LIGHT MODULATING ELEMENT, DISPLAY SYSTEM, AND DRIVING METHOD FOR DISPLAY SYSTEM

(75) Inventors: Akira Yumoto, Kanagawa (JP); Osamu Akimoto, Tokyo (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/220,208

(22) Filed: Dec. 23, 1998

(65) Prior Publication Data

US 2002/0067328 A1 Jun. 6, 2002

(30) Foreign Application Priority Data

Dec. 26, 1997 (JP) ..... 9-361468
Mar. 26, 1998 (JP) ..... 10-079661

(51) Int. Cl.[7] ..... G09G 3/36
(52) U.S. Cl. ..... 345/90; 345/98
(58) Field of Search ..... 345/84, 98, 211, 345/212, 100, 97, 89, 102, 87, 92, 94, 99, 95, 208, 210, 90

(56) References Cited

U.S. PATENT DOCUMENTS

| | | | | |
|---|---|---|---|---|
| 4,651,149 A | | 3/1987 | Takeda et al. | 345/90 |
| 5,166,671 A | * | 11/1992 | Maekawa | 345/100 |
| 5,337,171 A | | 8/1994 | Mase et al. | 349/74 |
| 5,436,742 A | * | 7/1995 | Tanaka et al. | 359/56 |
| 5,682,174 A | * | 10/1997 | Chiu | 345/84 |
| 5,686,939 A | * | 11/1997 | Millward et al. | 345/148 |
| 5,721,563 A | * | 2/1998 | Memida | 345/98 |
| 5,828,354 A | * | 10/1998 | Ebihara | 345/58 |
| 5,959,598 A | * | 9/1999 | McKnight | 345/87 |
| 6,034,660 A | * | 3/2000 | Millward et al. | 345/84 |
| 6,037,922 A | * | 3/2000 | Yagyu | 345/89 |
| 6,057,816 A | * | 5/2000 | Eckersley | 345/85 |
| 6,064,362 A | * | 5/2000 | Brownlow et al. | 345/98 |
| 6,084,580 A | * | 7/2000 | Takahashi et al. | 345/211 |
| 6,137,465 A | * | 10/2000 | Sekine et al. | 345/98 |
| 6,144,357 A | * | 11/2000 | Jeong | 345/100 |

FOREIGN PATENT DOCUMENTS

| | | |
|---|---|---|
| EP | 0 554 109 | 8/1993 |
| EP | 0 586 155 | 3/1994 |
| EP | 0 588 398 | 3/1994 |
| EP | 0 600 609 | 6/1994 |
| EP | 0 666 555 | 8/1995 |
| EP | 0 750 288 | 12/1996 |

* cited by examiner

*Primary Examiner*—Richard Hjerpe
*Assistant Examiner*—Kevin M. Nguyen
(74) *Attorney, Agent, or Firm*—Frommer Lawrence & Haug LLP; William S. Frommer; Dennis M. Smid

(57) ABSTRACT

A voltage generating circuit which enables realization of iminiaturization, reduction in operating voltage and reduction in dissipation power, a spatial light modulating element and a display system using the same, and a driving method for display system are disclosed. A pMOS transistor as first level setting means is controlled by a pre-charge signal and an output node is pre-charged to a first level. An nMOS transistor forming a control circuit is controlled in accordance with signals on a scanning line and a data line. A signal for controlling an nMOS transistor as second level setting means is generated to control the ON/OFF state of this transistor. Thus, electric charges are discharged from a capacitor and the output node is set at a second level. The capacitor holds the level of the output node and supplies the level to an electrode as a load. Therefore, a voltage generating circuit which enables simplification of the circuit structure, operation at a low voltage and reduction in dissipation power can be realized.

43 Claims, 52 Drawing Sheets

LOAD RESISTANCE TYPE (NMOS)
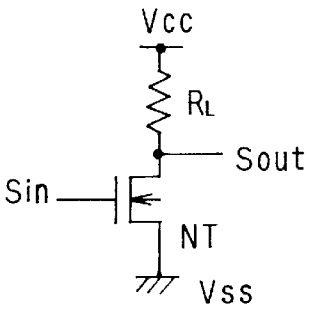
FIG.1A
LOAD RESISTANCE TYPE (PMOS)
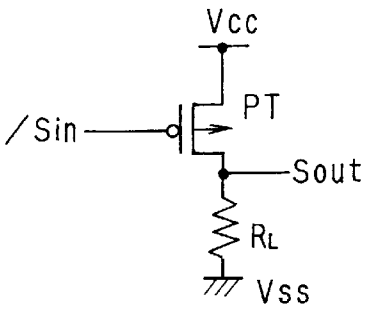
FIG.1B
CMOS
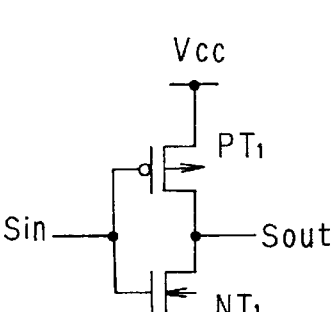
FIG.1C
Buffer
FIG.1D
DRAM TYPE
FIG.1E

NMOS STRUCTURE

PMOS STRUCTURE

VOLTAGE GENERATING CIRCUIT, SPATIAL LIGHT MODULATING ELEMENT, DISPLAY SYSTEM, AND DRIVING METHOD FOR DISPLAY SYSTEM

BACKGROUND OF THE INVENTION

1. Field of the Invention

This invention relates to a voltage generating circuit, for example, a voltage generating circuit capable of outputting multi-level voltages having a plurality of different levels in accordance with input signals, a spatial light modulating element and a display system constituted by using the voltage generating circuit, and a driving method for display system having the spatial light modulating element.

2. Description of the Related Art

In a display system, for example, in a liquid crystal display, an image signal having predetermined luminance can be displayed by controlling the light intensity of each pixel in accordance with image information to be displayed. Therefore, it is necessary to provide, with respect to each pixel, an electrode for controlling a light modulating element constituting the pixel, and control the voltage of the corresponding electrode for changing the light modulation characteristic of each pixel in accordance with image information to be displayed. It is desired to provide a voltage generating circuit which generates a predetermined voltage in accordance with image information to be displayed by each electrode.

In a display which displays general image information such as image signals of television broadcast or image signals displayed on a computer monitor, a display screen is constituted by arraying an extremely large quantity of pixels. To control all the electrodes provided in accordance with these pixels, a voltage generating circuit which enables miniaturization, lower dissipation power and high-speed operation is required.

FIGS. 1A to 1E show exemplary structures of generally used voltage generating circuits. FIG. 1A is a circuit diagram of a load resistance type voltage generating circuit constituted by an nMOS transistor NT and a resistance element RL. As shown in FIG. 1A, an input signal Sin is supplied to the gate of the nMOS transistor NT, and the drain is connected to a power-supply voltage Vcc through the resistance element RL. The source is connected to a common electric potential Vss (or grounded).

Similarly, FIG. 1B is a circuit diagram of a load resistance type voltage generating circuit constituted by a pMOS transistor PT and a resistance element RL. As shown in FIG. 1B, an inversion signal/Sin of an input signal Sin is applied to the gate of the pMOS transistor PT, and the source of the pMOS transistor is connected to a power-supply voltage Vcc. The drain is grounded through a resistance element RL.

In the load resistance type voltage generating circuits shown in FIGS. 1A and 1B, a current flowing through the nMOS transistor NT or the pMOS transistor PT is set in accordance with the level of the input signal Sin or its inversion signal/Sin. Therefore, the level of an output signal Sout outputted from the drain of the nMOS transistor NT or the pMOS transistor PT is set by the input signal Sin or its inversion signal/Sin.

FIG. 1C shows an example of a CMOS type voltage generating circuit constituted by a pMOS transistor PT1 and an nMOS transistor NT1. As shown in FIG. 1C, both of the gates of the pMOS transistor PT1 and the nMOS transistor NT1 are connected to a terminal for an input signal Sin. The source of the pMOS transistor PT1 is connected a power-supply voltage Vcc, and the source of the nMOS transistor NT1 is connected to a common electric potential Vss. In addition, the drains of these two transistors are connected to each other, and the connection point becomes a terminal for an output signal Sout.

In the voltage generating circuit of FIG. 1C, the ON/OFF states of the pMOS transistor PT1 and the nMOS transistor NT1 are controlled in accordance with the input signal Sin, and the level of the output signal Sout is controlled accordingly. For example, when the input signal Sin is at a low level such as the level of the common electric potential Vss or a level proximate thereto, the pMOS transistor PT1 is held in the ON state while the nMOS transistor NT1 is held in the OFF state. Therefore, the output signal Sout is held at the level of the power-supply voltage Vcc. On the contrary, when the input signal Sin is at a high level such as the level of the power-supply voltage Vcc or a level proximate thereto, the pMOS transistor PT1 is held in the OFF state while the nMOS transistor NT1 is held in the ON state. Therefore, the output signal Sout is held at the level of the common electric potential Vss.

Thus, the voltage generating circuit of FIG. 1C supplies the output signal Sout having the inverted logical level of that of the input signal Sin.

FIG. 1D is a circuit diagram of a buffer type voltage generating circuit constituted by a pMOS transistor PT2, an nMOS transistor NT2, and resistance elements RF1, RF2. As shown in FIG. 1D, both of the gates of the pMOS transistor PT2 and the nMOS transistor NT2 are connected to a terminal for an input signal Sin. The source of the pMOS transistor PT2 is connected to a power-supply voltage Vcc, and the source of the nMOS transistor NT2 is connected to a common electric potential Vss. In addition, the resistance elements RF1 and RF2 are connected in series between the drains of the pMOS transistor PT2 and the nMOS transistor NT2, and the connection point of the resistance elements forms a terminal for an output signal Sout.

Similarly to the CMOS type voltage generating circuit of FIG. 1C, the voltage generating circuit of FIG. 1D provides the output signal Sout having an inverted logical level of that of the input signal Sin. In the voltage generating circuit of this example, the resistance elements RF1, RF2 constitute feedback resistance elements, thus compensating temperature characteristics of the MOS transistors PT2, NT2. In general, a drain current of the MOS transistor has a negative temperature characteristic. By providing the resistance element for temperature compensation, the negative temperature characteristic of the drain current can be restrained.

FIG. 1E is a circuit diagram of a DRAM type voltage generating circuit. As shown in FIG. 1E, the voltage generating circuit of this example is constituted by an nMOS transistor NT2 with its source connected to a data line DL and with its gate connected to a control line CL, and a capacitor CS connected between the nMOS transistor NT2 and a common electric potential Vss.

In accordance with a control signal inputted to the control line CL, the ON/OFF state of the transistor NT2 is controlled. When the transistor NT2 is in the ON state, a signal on the data line DL is outputted to the drain side of the transistor NT2, and the capacitor CS is charged accordingly. If a voltage drop of the transistor NT2 can be ignored, the capacitor CS is charged to the same level as an input voltage of the data line DL. In addition, after the transistor NT2 is set in the OFF state by the control signal of the control line CL, the level of an output signal Sout is held.

In order to enhance the driving capability in the case where a load circuit to be driven by the voltage generating circuit has a low impedance, the buffer of FIG. 1D can be provided on the output side of the voltage generating circuits of FIGS. 1A, 1B and 1E.

Meanwhile, the recent semiconductors have been becoming more advanced in features such as increase in operating speed, increase in integration, fine processing, and reduction in voltage. Among these features, the reduction in voltage provides an effect of square with respect to reduction in dissipation power (i.e., dissipation power voltage$^2$). Therefore, the reduction in voltage has been desired increasingly.

For example, since a liquid crystal display has a large number of long distributing electrodes, the electrode capacity is large. Moreover, since a signal of 10 V or more is usually handled, invalid dissipation power occupies a large part of charge/discharge of the stray capacitance. For example, if the driving voltage can be halved to 5 V, the charging/discharging power of the stray capacitance can be reduced to approximately ¼ of the power at the time of 10-V driving. Therefore, reduction in voltage is an effective measure for reducing dissipation power.

FIG. 2 is a circuit diagram showing an exemplary structure of a liquid crystal display constituted by using the DRAM type voltage generating circuit of FIG. 1E. The liquid crystal display is constituted by a plurality of pixels generally arranged in a matrix form, and each pixel is constituted by a voltage generating circuit for supplying a predetermined driving voltage to a driving electrode and a liquid crystal material held between the driving electrode and an electrode held at a common electric potential. As shown in FIG. 2, the output side of the DRAM type voltage generating circuit (hereinafter referred to as a driving circuit) constituted by the nMOS transistor and the capacitor is connected to the driving electrode. In FIG. 2, the electrode at the common electric potential and the liquid crystal material of each pixel are not shown.

In displaying an image signal, pixel data is generated in accordance with an image signal to be displayed and is inputted to data lines DL1, DL2, . . . , DLm. Since a control signal having a predetermined level is sequentially applied to scanning lines SL1, SL2, . . . , SLn in accordance with the input timing of the pixel data to the data lines DL1, DL2, . . . , DLm, the nMOS transistor at each pixel is set in the ON state and the capacitor is charged in accordance with the pixel data. Then, since the voltage held by the capacitor of each pixel is applied to driving electrodes PAD11, . . . , PADm1, PAD 12, . . . , PADm2, PAD1n, . . . , PADmn, the light modulation characteristic such as the refractive index or reflectivity of the liquid crystal material of each pixel is controlled in accordance with the driving voltage applied to each driving electrode. Thus, the image signal corresponding to the pixel data is displayed.

In the display system thus constituted, since the DRAM type voltage generating circuit of FIG. 1E is used, the data lines DL1, DL2, . . . , DLm need to be driven with a large amplitude having an electric potential equal to or higher than that of the output signal Sout. In addition, since the nMOS transistor is generally used, the output signal is driven only with an amplitude of Vpp-Vth-dVth even when the scanning lines SL1, SL2, . . . , SLn are driven at a certain electric potential Vpp. In this case, Vth represents a threshold voltage of the nMOS transistor, and dvth represents a rise of effective Vth due to a board bias effect.

As a measure for overcoming this, it can be considered to employ the voltage generating circuit using a resistance load, as shown in FIGS. 1A and 1B. However, if the transistor is in the ON state in the case where the resistance load is used, a current continues to flow through the resistance load. Therefore, heating of the resistance load and dissipation power become problematical particularly in a VLSI (very large scale integrated circuit). Also, in a multi-level voltage generating circuit capable of outputting a plurality of different voltage levels, unevenness of the resistance load causes a problem.

On the other hand, in the case of the CMOS structure in which the nMOS transistor and the pMOS transistor coexist as shown in FIGS.1C and 1D, a through current generated by setting both the nMOS transistor and the pMOS transistor in the ON state and dissipation power due to the through current cause problems. To prevent such problems, an input signal having an amplitude equal to an output logical amplitude is generally required. Therefore, when a large amplitude output is necessary, increase in pressure resistance of the circuit structure and a level shift circuit are required. However, in this case, too, the through current at the moment of switching of the circuit state is still a problem.

To minimize the through current, an output transition period must be reduced and the rise of the input signal must be made sufficiently quick. That is, a signal having a high amplitude and a high through rate is required.

If the voltage is raised, an insulating region is required between the nMOS transistor and the pMOS transistor. Since problems of latch up of the transistors and the like are likely occur when the voltage becomes higher, the transistors must be separated sufficiently from each other, thus causing such inconvenience that it is difficult to constitute the CMOS circuit in a narrow region.

SUMMARY OF THE INVENTION

In view of the foregoing status of the art, it is an object of the present invention to provide a voltage generating circuit which is capable of controlling an output signal of a large amplitude by a small-amplitude signal without using load resistance, and which enables realization of miniaturization, reduction in voltage, and reduction in dissipation power.

According to the present invention, there is provided a voltage generating circuit which operates in accordance with an input signal and outputs a signal having at least two levels to an output node, the voltage generating circuit including: a capacitor connected between the output node and a common electric potential; first level setting means for charging the capacitor with a predetermined voltage in accordance with a first input signal, thus setting the electric potential of the output node at a first level; and second level setting means for controlling discharge operation of the capacitor in accordance with a second input signal, thus setting the electric potential of the output node at a second level different from the first level.

According to the present invention, there is also provided a spatial light modulating element having a plurality of pixels and adapted for modulating a light by each pixel in accordance with pixel data based on an image signal to be displayed, the spatial light modulating element including, for each pixel: a voltage generating circuit having first level setting means for setting the electric potential of an output node at a first level in accordance with a first input signal, level holding means for holding the level of the output node, and second level setting means for setting the electric potential of the output node at a second level different from the first level in accordance with a second input signal; and control means for outputting the second input signal in accordance with the pixel data.

According to the present invention, there is also provided a display system including: a light source for radiating a light; and a spatial light modulating element having a plurality of pixels and adapted for modulating a light radiated from the light source by each pixel in accordance with pixel data based on an image signal to be displayed. The spatial light modulating element includes, for each pixel: a voltage generating circuit having first level setting means for setting the electric potential of an output node at a first level in accordance with a first input signal, level holding means for holding the level of the output node, and second level setting means for setting the electric potential of the output node at a second level different from the first level in accordance with a second input signal; and control means for outputting the second input signal in accordance with the pixel data.

According to the present invention, there is further provided a driving method for display system for driving each pixel of a spatial light modulating element having a plurality of pixels and adapted for modulating a light by each pixel in accordance with pixel data based on an image signal to be displayed, the method including: a first step of charging a capacitor provided between an output node connected to each pixel and a common electric potential in accordance with a first input signal, thus setting the electric potential of the output node at a first level; and a second step of holding the electric potential of the output node at the first level or setting the electric potential of the output node at a second level different from the first level, in accordance with a second input signal corresponding to the pixel data.

BRIEF DESCRIPTION OF THE DRAWINGS

FIGS. 1A to 1E show conventional voltage generating circuits. FIG. 1A is a circuit diagram of a load resistance type voltage generating circuit using a nMOS transistor. FIG. 1B is a circuit diagram of a load resistance type voltage generating circuit using a pMOS transistor. FIG. 1C is a circuit diagram of a CMOS type voltage generating circuit. FIG. 1D is a circuit diagram of a buffer type voltage generating circuit. FIG. 1E is a circuit diagram of a DRAM type voltage generating circuit.

FIG. 4A is a circuit diagram of a voltage generating circuit having two nMOS transistors. FIG. 4B is a circuit diagram of a voltage generating circuit having two pMOS transistors.

FIG. 7A is a perspective view showing the state where the spatial light modulating element transmits a light. FIG. 7B is a perspective view showing the state where the spatial light modulating element interrupts a light.

FIG. 10A is a schematic view showing the state where the spatial light modulating element interrupts a light. FIG. 10B is a schematic view showing the state where the spatial light modulating element transmits a light. FIG. 10C is a schematic view for explaining the state of FLC.

FIG. 31A is an exploded perspective view of the spatial light modulating element. FIG. 31B is a cross-sectional view of the spatial light modulating element.

DESCRIPTION OF THE PREFERRED EMBODIMENTS

1. Voltage Generating Circuit 1-1. Structure of Driving Circuit Using Voltage Generating Circuit FIG. 3 is a circuit diagram showing an example of a driving circuit using the voltage generating circuit of the present invention.

Figure 2:
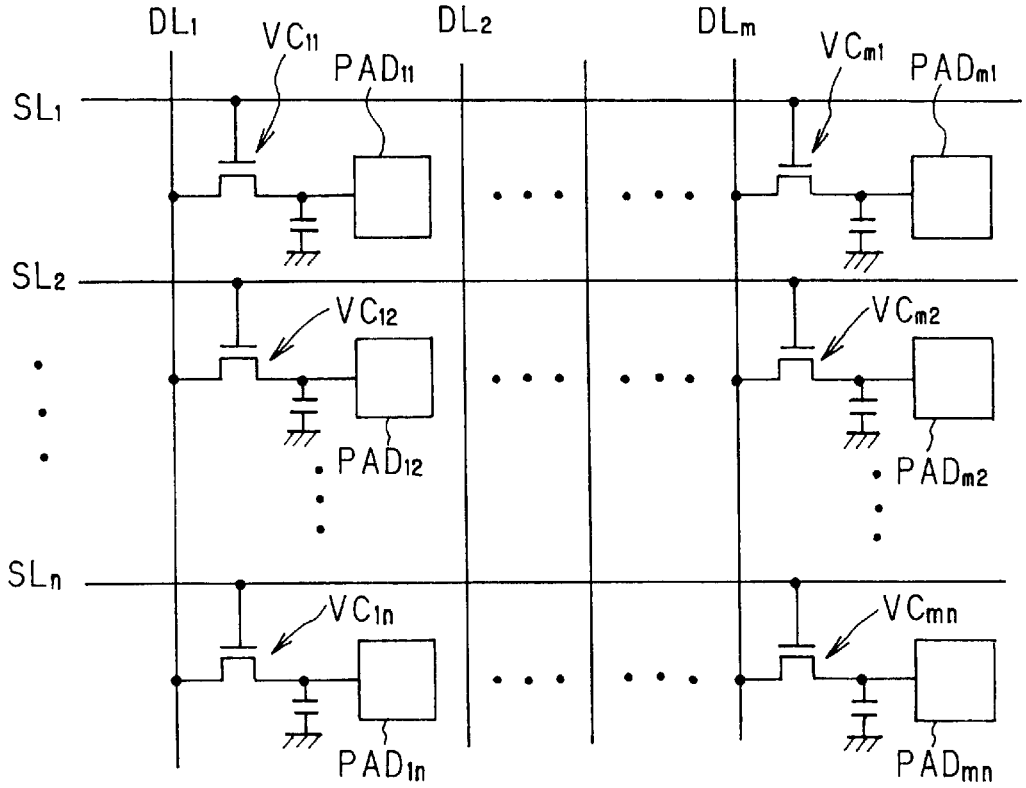
FIG. 2 is a circuit diagram of a conventional liquid crystal display.
Figure 3:
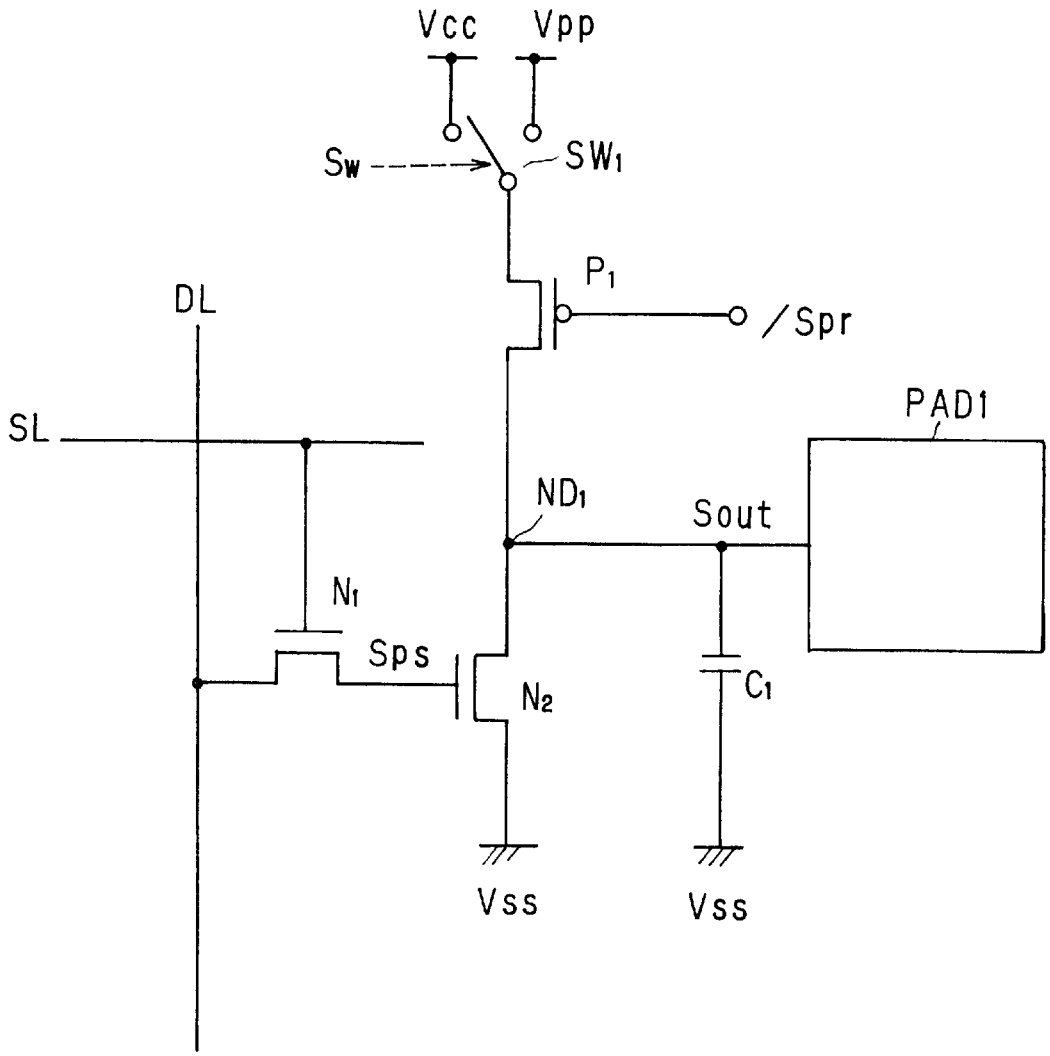
FIG. 3 is a circuit diagram showing a liquid crystal driving circuit employing a voltage generating circuit of the present invention.

As shown in FIG. 3, the driving circuit using the voltage generating circuit has an nMOS transistor N1 forming a control circuit, an nMOS transistor N2 forming a voltage generating circuit, a pMOS transistor P1, a capacitor C1, and a switch SW1.

To an output node ND1 of the voltage generating circuit, an electrode PAD1 is connected. This electrodes PAD1 is driven by a voltage Sout generated by the voltage generating circuit.

In this driving circuit, the pMOS transistor P1 constitutes first level setting means of the voltage generating circuit. The ON/OFF state of this pMOS transistor P1 is controlled in accordance with a pre-charge signal Spr (or its inversion signal/Spr), which is a first input signal. When the pMOS transistor P1 is set in the ON state, the capacitor C1 is charged to a first level by a voltage selected by the switch SW1.

In this driving circuit, the nMOS transistor N2 constitutes second level setting means of the voltage generating circuit. The ON/OFF state of the nMOS transistor N2 is controlled in accordance with a second input signal from the nMOS transistor N1. When the nMOS transistor N2 is held in the ON state, electric charges are discharged from the capacitor C1. The electric potential of the output node ND1 is lowered by the discharge and is set to a second level.

The ON/OFF state of the control circuit for supplying the second input signal to the voltage generating circuit is controlled by the signal levels of a scanning line SL and a data line DL. When the control circuit is in the ON state, it is constituted only by the nMOS transistor N1 for supplying the second signal of a predetermined level to the nMOS transistor N2.

The nMOS transistor N1 constituting the control circuit has its gate connected to the scanning line SL. Also, the nMOS transistor N1 has its one diffusion layer connected to the data line D1, and has its other diffusion layer connected to the gate of the nMOS transistor N2 constituting the second level setting means.

The pMOS transistor P1 of the voltage generating circuit has its gate connected to an input terminal for the inversion signal/Spr of the pre-charge signal Spr, and has its source connected to the switch SW1. Also, the pMOS transistor P1 has its drain connected to the output node ND1.

The nMOS transistor N2 has its drain connected to the output node ND1, and has its source connected to a common electric potential Vss.

The capacitor C1 is connected between the output node ND1 and the common electric potential Vss. The electrode PAD1 is connected to the output node ND1 and is driven by an output signal Sout.

The switch SW1 is connected to either a power-supply voltage Vcc or a voltage Vpp. This switch SW1 selects either the power-supply voltage Vcc or the voltage Vpp in accordance with a control signal Sw. The voltage selected by the switch SW1 becomes a charging voltage of the capacitor C1.

1-2. Operation of Driving Circuit Using Voltage Generating Circuit

Referring to FIG. 3, the operation of the driving circuit of this embodiment will now be described.

In accordance with a control signal Sw from outside, the switch SW1 selects a predetermined voltage. The selected voltage is applied to the source of the pMOS transistor P1.

At this point, an inversion signal/Spr of a pre-charge signal Spr is held at a low level, for example, at the common electric potential Vss. Thus, the pMOS transistor P1 is held in the ON state, and the voltage selected by the switch SW1 is applied to the output node ND1, thereby charging the capacitor C1. Since the pMOS transistor P1 is held in the ON state for a predetermined time period, the capacitor C1 is charged with a voltage V1 selected by the switch SW1. Then, the pMOS transistor P1 is switched to the OFF state, and the electric potential V1 of the output node ND1 is held by the capacitor C1.

The nMOS transistor N1 is set either in the ON state or in the OFF state in accordance with a control signal applied to the scanning line SL. For example, when the control signal is at a high level, the nMOS transistor N1 is set in the ON state. On the contrary, when the control signal is at a low level, the nMOS transistor N1 is set in the OFF state.

When the nMOS transistor N1 is set in the ON state, the ON/OFF state of the nMOS transistor N2 is controlled in accordance with a signal applied to the data line DL. For example, when a signal of a high level is applied to the data line DL, the nMOS transistor N2 is set in the ON state. On the contrary, when a signal of a low level is applied to the data line DL, the nMOS transistor N2 is set in the OFF state.

When the nMOS transistor N2 is held in the ON state, electric charges are discharged from the capacitor C1 and the electric potential of the output node ND1 is lowered. By controlling the time period during which the nMOS transistor N2 is held in the ON state, the electric potential of the output node ND1 can be set at a predetermined level. The output signal Sout from the output node ND1 is applied to the electrode PAD1 as a driving voltage.

In the above-described voltage generating circuit, the transistor for charging the capacitor C1 is constituted by the pMOS transistor, and the transistor for discharging the capacitor C1 is constituted by the nMOS transistor. However, this invention is not limited to this structure. It may also be considered that both transistors for charge and discharge are constituted by nMOS transistors or by pMOS transistors. In addition, charging and discharging of the capacitor C1 can also be controlled by, for example, bipolar transistors, as well as the MOS transistors.

In the voltage generating circuit of the present invention, the capacitor C1 is adapted for stably holding the electric potential of the output node ND1. However, in the case where there is little possibility of potential fluctuation, the capacitor C1 may be constituted by a parasitic capacitance existing between the output node ND1 and the common electric potential Vss, the power-supply voltage Vcc, or the voltage Vpp. Also, a resistor or a transistor having a high impedance may be connected between the output node ND1 and the power-supply voltage Vcc or the voltage Vpp so as to hold the electric potential of the output node ND1.

1-3. Another Exemplary Structure of Voltage Generating Circuit

Figure 4A:
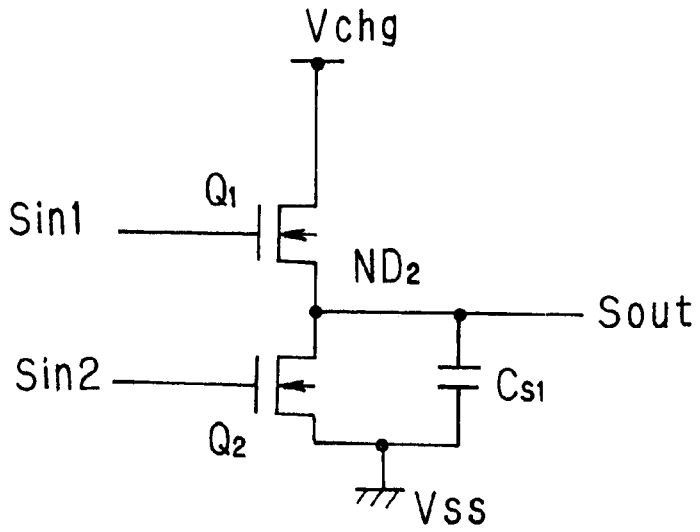
FIGS. 4A and 4B show other exemplary structures of the voltage generating circuit of the present invention.
Figure 4B:
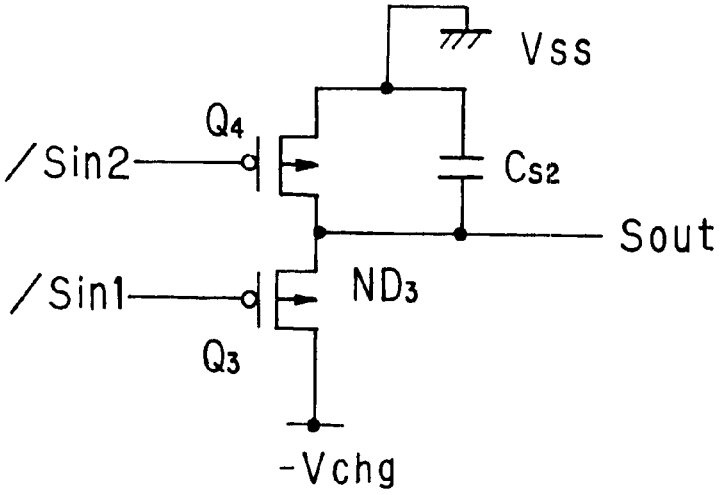

FIGS. 4A and 4B show other examples of the voltage generating circuit using nMOS transistors or pMOS transistors. FIG. 4A is a circuit diagram of a voltage generating circuit using nMOS transistors Q1 and Q2, and FIG. 4B is a circuit diagram of a voltage generating circuit using pMOS transistors Q3 and Q4.

The voltage generating circuit of FIG. 4A is constituted by the two nMOS transistors Q1, Q2, and a capacitor Cs1. In this voltage generating circuit, the nMOS transistor Q1 forms first level setting means, and the nMOS transistors Q2 forms second level setting means.

As shown in FIG. 4A, an input signal Sin1 is applied to the gate of the nMOS transistor Q1, and an input signal Sin2 is applied to the gate of the nMOS transistor Q2.

The drain of the nMOS transistor Q1 is connected to a charging voltage Vchg. The source of the nMOS transistor Q1 is connected to the drain of the nMOS transistor Q2, and the connection point forms an output node ND2. The source of the nMOS transistor Q2 is connected to a common electric potential Vss.

The capacitor Cs1 is connected between the output node ND2 and the common electric potential Vss.

In the voltage generating circuit thus constituted, the ON/OFF states of the nMOS transistors Q1 and Q2 are controlled in accordance with the input signals Sin1 and Sin2, respectively. Electric charges are charged to or discharged from the capacitor Cs1 accordingly, and the output voltage Sout of the output node ND2 is controlled.

For example, when the input signal Sin1 is held at a high level, the nMOS transistor Q1 is held in the ON state and the capacitor Cs1 is charged to the level of the charging voltage Vchg.

When both of the nMOS transistors Q1 and Q2 are in the OFF state, the voltage of the output node ND2 is held by the capacitor Cs1.

When the input signal Sin2 is held at a high level, the nMOS transistor Q2 is held in the ON state and electric charges are discharged from the capacitor Cs1, thus lowering the electric potential of the output node ND2.

Thus, by controlling the input signals Sin1 and Sin2, the ON/OFF states of the nMOS transistors Q1 and Q2 are controlled, and the output signal Sout set at an arbitrary potential level between the charging voltage Vchg and the common electric potential Vss is obtained from the output node ND2.

The voltage generating circuit of FIG. 4B is constituted by the two pMOS transistors Q3, Q4, and a capacitor Cs2. In this voltage generating circuit, the pMOS transistor Q3 forms first level setting means, and the pMOS transistor Q4 forms second level setting means.

As shown in FIG. 4B, an inversion signal/Sin1 of an input signal Sin1 is applied to the gate of the pMOS transistor Q3, and an inversion signal/Sin2 of an input signal Sin2 is applied to the gate of the pMOS transistor Q4. The drain of the pMOS transistor Q3 is connected to a charging voltage-Vchg. The source of the pMOS transistor Q3 is connected to the drain of the pMOS transistor Q4, and the connection point forms an output node ND3. The source of the pMOS transistor Q4 is connected to a common electric potential Vss.

The capacitor Cs2 is connected between the output node ND3 and the common electric potential Vss.

In the voltage generating circuit thus constituted, the ON/OFF states of the pMOS transistors Q3 and Q4 are controlled in accordance with the levels of the input signals Sin1, Sin2 (or their inversion signals /Sin1, /Sin2), respectively. Electric charges are charged to or discharged from the capacitor Cs2 accordingly, and the output voltage Sout of the output node ND3 is controlled.

For example, when the input signal Sin1 is held at a high level, its inversion signal/Sin1 is held at a low level and the pMOS transistor Q3 is held in the ON state. Therefore, the capacitor Cs2 is charged to the level of the charging voltage-Vchg.

When both of the pMOS transistors Q3 and Q4 are in the OFF state, the voltage of the output node ND3 is held by the capacitor Cs2.

When the input signal Sin2 is held at a high level, its inversion signal/Sin2 is held at a low level and the pMOS transistor Q4 is held in the ON state. Therefore, electric charges are discharged from the capacitor Cs2 and the voltage of the output node ND3 is raised toward the common electric potential Vss.

Thus, by controlling the input signals Sin1 and Sin2, the ON/OFF states of the pMOS transistors Q3 and Q4 are controlled, and the output signal Sout having an arbitrary potential level between the charging voltage-Vchg and the common electric potential Vss is obtained from the output node ND3.

1-4. Operation of Voltage Generating Circuit

Figure 5:
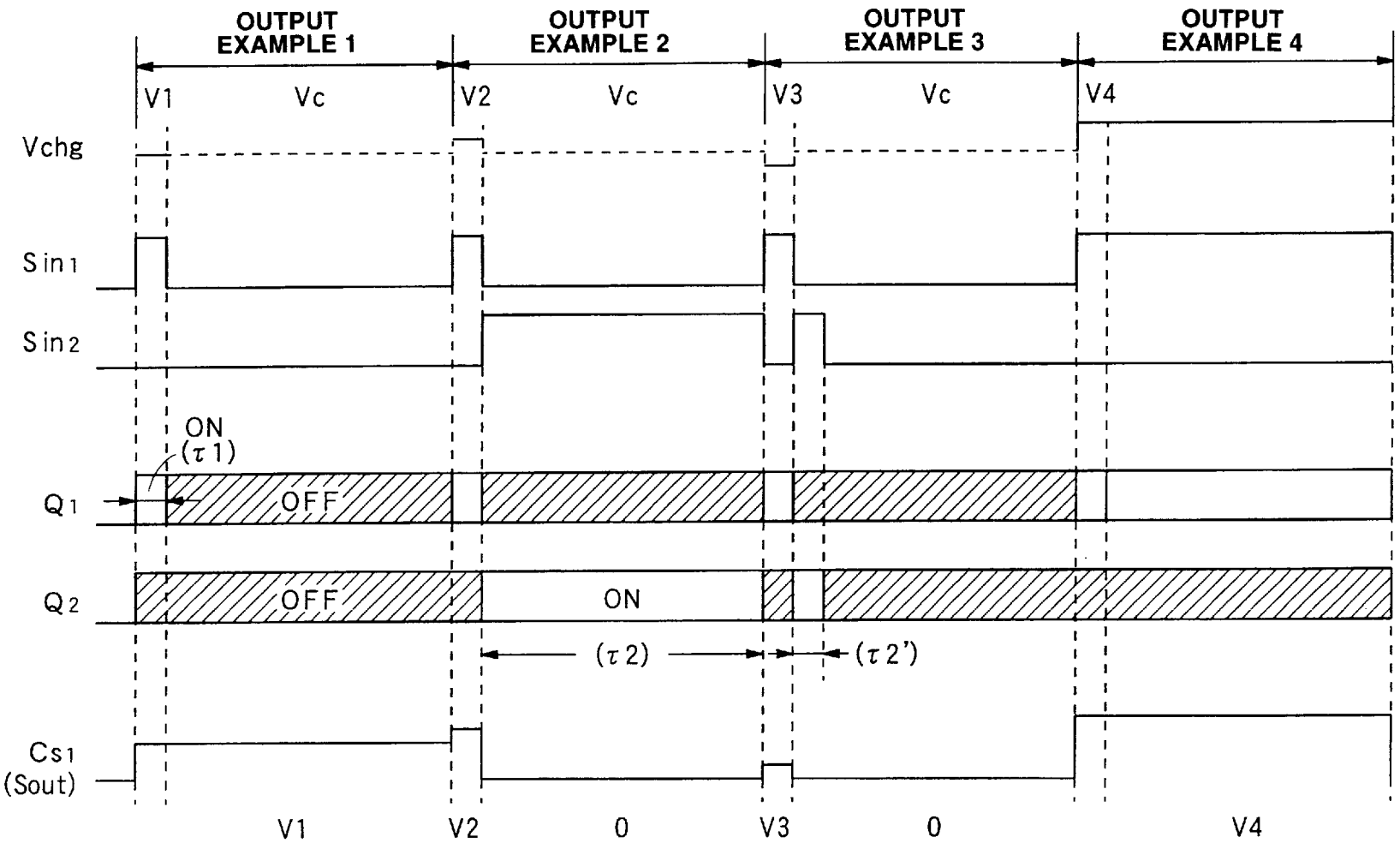
FIG. 5 is a waveform diagram showing operation of the voltage generating circuit of the present invention.
Figure 6:
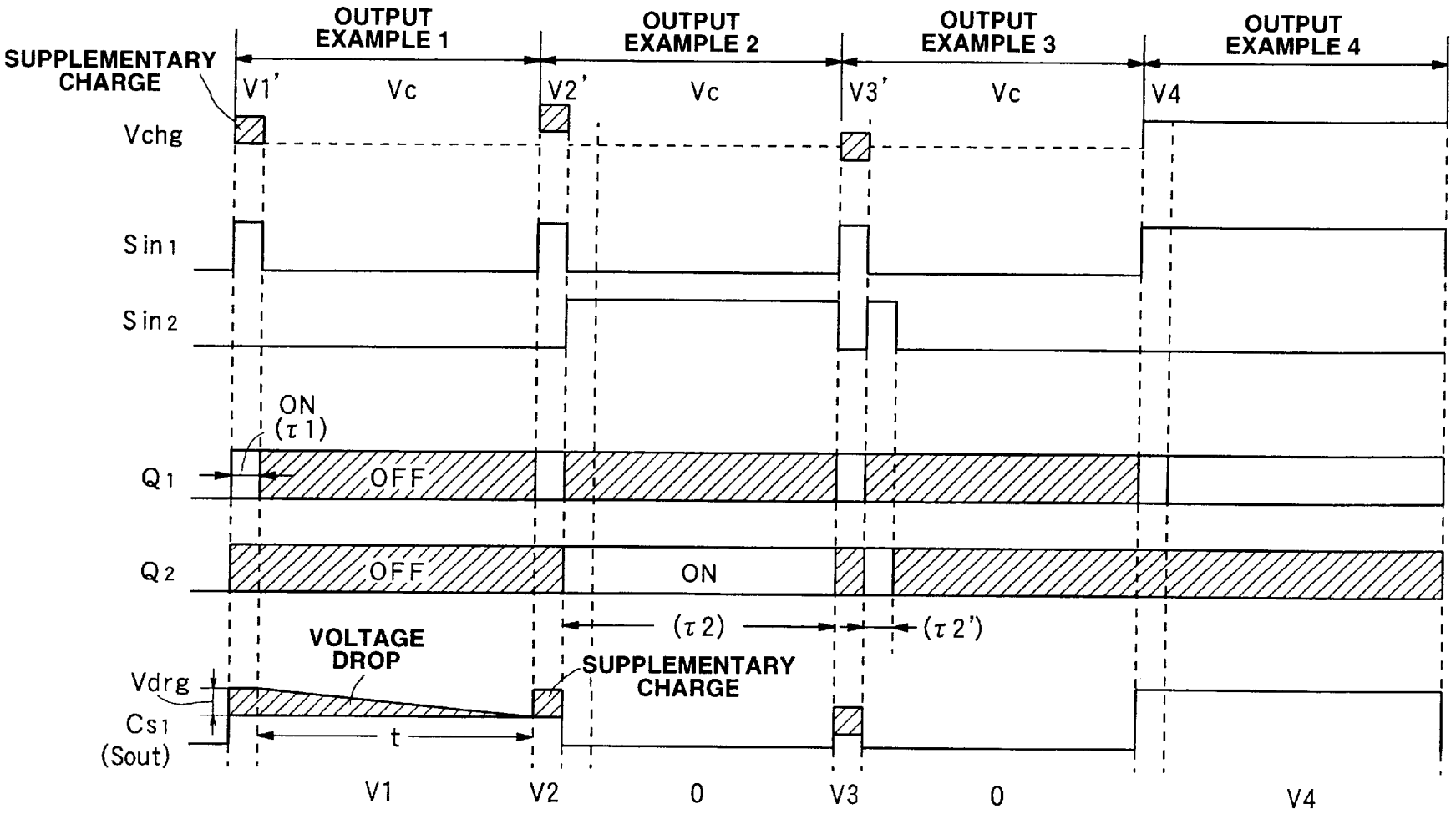
FIG. 6 is a waveform diagram showing another operation of the voltage generating circuit of the present invention.

FIGS. 5 and 6 are waveform diagrams showing operation of the voltage generating circuit of FIG. 4A. Referring to these waveform diagrams, operation of the voltage generating circuit will now be described in detail.

It is assumed that the following conditions are met when the voltage generating circuit of FIG. 4A operates. First, the nMOS transistors Q1 and Q2 will not be simultaneously set in the ON state. If the nMOS transistors Q1 and Q2 are simultaneously set in the ON state, a large through current flows from the charging voltage Vchg to the common electric potential Vss via the nMOS transistors Q1, Q2 in the ON state, thus increasing dissipation power of the voltage generating circuit.

Next, an ON time period τ1 of the nMOS transistor Q1 shown in the waveform diagram of FIG. 5 is set to be equal to or longer than a time period which enables storage of necessary electric charges to the capacitor Cs1. Time periods τ2, τ2' during which the nMOS transistor Q2 is held in the ON state are equal to or longer than a time period required for discharging necessary electric charges from the capacitor Cs1. However, in the case where the ON time period τ1 of the nMOS transistor Q1 and the time periods τ2, τ2' during which the nMOS transistor Q2 is held in the ON state are insufficient, the voltage at both ends of the capacitor Cs1 at that point becomes the output voltage.

When the nMOS transistor Q1 is held in the OFF state, the charging voltage Vchg can be set arbitrarily. In addition, in the case where no electric charge is injected by the nMOS transistor Q2 after discharge from the capacitor Cs1, or in the case where voltage fluctuation, if any, causes no problem, the nMOS transistor Q2 may be set in the OFF state.

On the assumption that all the above-mentioned conditions are met, operation of the voltage generating circuit of FIG. 4A will be described.

In an output example 1, during the charging voltage Vchg is set at V1, the input signal Sin1 is held at the high level for the time period τ1 and the input signal Sin2 is held at the low level. Thus, the nMOS transistor Q1 is held in the ON state for the time period τ1 and the nMOS transistor Q2 is held in the OFF state. As a result, the output signal Sout is set at the V1 level and the capacitor Cs1 is charged to the voltage V1. This operation is hereinafter referred to as pre-charge, and a period for carrying out pre-charge is referred to as a pre-charge period.

After the end of the pre-charge period, both of the input signals Sin1, Sin2 are held at the low level, and both of the nMOS transistors Q1, Q2 are set in the OFF state. At this point, since the capacitor Cs1 is charged to the voltage V1, the output signal Sout is held at the V1 level. After the end of the pre-charge period, since the nMOS transistor Q1 is set in the OFF state, the charging voltage Vchg may be an arbitrary electric potential (Vc).

In an output example 2, during the charging voltage Vchg is held at a V2 level, the nMOS transistor Q1 is held in the ON state for the time period τ1 and the nMOS transistor Q2 is held in the OFF state. As a result, the output signal Sout is set at the V2 level and the capacitor Cs1 is charged to the voltage V2.

After the end of the pre-charge period, the input signal Sin2 is held at the high level for the time period τ2, and the nMOS transistor Q2 is held in the ON state for the time period τ2. As a result, electric charges are discharged from the capacitor Cs1, and the output signal Sout is held at the level of the common electric potential Vss, for example, 0 V.

In an output example 3, during the charging voltage Vchg is held at a V3 level, the nMOS transistor Q1 is held in the ON state for the time period τ1 and the nMOS transistor Q2 is held in the OFF state. As a result, the output signal Sout is set at the V3 level and the capacitor Cs1 is charged to the voltage V3.

After the end of the pre-charge period, the input signal Sin2 is held at the high level for the time period τ2', and the nMOS transistor Q2 is held in the ON state for the time period τ2'. As a result, electric charges are discharged from the capacitor Cs1, and the output signal Sout is held at the common electric potential Vss, for example, 0 V.

In the output example 3, on the assumption that there is no inflow of electric charges from the output side or that the output voltage may have fluctuation, the nMOS transistor Q2 is held in the OFF state after the lapse of the time period τ2'.

In an output example 4, the charging voltage Vchg is constantly held at the level of a voltage V4 during the operation period. During the operation period of the voltage generating circuit, the input signal Sin1 is constantly held at the high level and the input signal Sin2 is constantly held at the low level. Thus, the nMOS transistor Q1 is constantly held in the ON state during the operation period and the nMOS transistor Q2 is constantly held in the OFF state.

Therefore, for example, in the case where a heavy external load is driven by the output signal Sout, the voltage V4 can be supplied to the outside via the transistor Q1.

In the output examples 1 to 4, the charging voltage Vchg is set at a predetermined voltage level at least during the pre-charge period, that is, during the period in which the nMOS transistor Q1 is held in the ON state. Therefore, this embodiment is effective in the case where a circuit having a large time constant such that this period can be ignored is driven, or in the case where the output period is sufficiently long with respect to the pre-charge period.

Meanwhile, in the case where a driving target circuit of the voltage generating circuit has a large load, it is considered that electric charges accumulated in the capacitor during the pre-charge period are taken for the load, thus lowering the voltage of the output signal Sout by the amount of Vdrp.

Also, in the case where there is an outflow of electric charges from the output node for a certain reason such as leakage of the load of the output node, it is considered that the voltage of the output signal Sout is lowered by the amount of Vdrp.

In such cases, it is desired that the charging voltage Vchg is set at a level higher than the ultimate potential which enables supplement with the amount of the voltage drop, in anticipation of the voltage drop of the output signal Sout, thus carrying out supplementary charge.

On the contrary, in the case where an inflow of electric charges to the output node is anticipated, the charging voltage Vchg may be set at a level lower than the ultimate potential.

FIG. 6 is a waveform diagram showing operation in the case where the driving target circuit of the voltage generating circuit has a large load, for example, in the case where it is considered that electric charges accumulated in the capacitor Cs1 during the pre-charge period are take for the load. Referring to FIG. 6, operation of the voltage generating circuit in this case will be described.

As shown in FIG. 6, in the present embodiment, the load circuit has a small impedance, and electric charges accumulated in the capacitor Cs1 during the driving operation of the voltage generating circuit flow through the load circuit, thus lowering the voltage of the output signal Sout by the amount of Vdrp. In this embodiment, this is overcome by carrying out supplementary charge in which the charging potential is made higher than the ultimate potential.

In output examples 1 to 3 shown in FIG. 6, in consideration of the voltage drop during the driving period after charging, the charging voltage Vchg is set at levels V1', V2' and V3' which can supplement the voltage drop, during the pre-charge period. Thus, in the output examples 1 to 3, as pre-charge is carried out, the output signal Sout is set at voltages V1, V2 and V3, respectively. In an output example 4, similar to the output example 4 of FIG. 3, when the load is heavy, the charging voltage Vchg is held at the V4 level during the driving operation and the nMOS transistor Q1 is constantly held in the ON state. Thus, the load circuit is driven by the charging voltage V4.

The above-described driving method of the present invention can be applied to the case where a voltage stabilizer is provided on the load side, or the case where only the initial voltage is necessary (for example, a differential value is necessary). Also, the voltage drop quantity Vdrp during a time period t can be calculated from a current Ileak flowing through the capacitor Cs1 and to the outside, in accordance with the following equation.

$$Vdrp=q/Cs=(t\times Ileak)/Cs \quad (1)$$

In this equation, q represents the quantity of electric charges flowing through the load circuit, and Cs represents the electrostatic capacity of the capacitor Cs1. By carrying out supplementary charge for the voltage drop quantity Vdrp calculated in accordance with the equation (1), at the time of initial charge, the driving voltage necessary for the load circuit can be supplied.

As is described above, in the voltage generating circuit of the present embodiment, the ON/OFF state of the pMOS transistor or nMOS transistor as the first level setting means is controlled by the pre-charge signal as the first input signal, and the ON/OFF state of the pMOS transistor or nMOS transistor as the second level setting means is controlled by the second input signal supplied from the control circuit.

In this voltage generating circuit, when the first level setting means is in the ON state, the output node is set at the first level and the capacitor is charged to the first level. When the first level setting means is in the OFF state and the second level setting means is in the OFF state, too, the electric potential of the output node is held at the first level by the electric charges accumulated in the capacitor.

Also, in this voltage generating circuit, when the second setting means is set in the ON state by the second signal supplied from the control circuit, electric charges are discharged from the capacitor and the electric potential of the output node is set at the second level.

Thus, though having the simple structure, the voltage generating circuit of the present embodiment enables appropriate output of signals of two levels, and enables switching of the potential level of the output node with a small amplitude of approximately the threshold voltage of the pMOS transistor or nMOS transistor. Thus, reduction in dissipation power can be realized.

In the following description, the driving method using this voltage generating circuit is referred to as a pre-charge driving method.

2. Spatial Light Modulating Element

A spatial light modulating element having a voltage generating circuit as described above will now be described.

The spatial light modulating element has a plurality of pixels and is adapted for modulating a light by each pixel in accordance with pixel data based on an image signal to be displayed. The spatial light modulating element has a voltage generating circuit as described above for each pixel.

The spatial light modulating element changes the light modulation characteristic of a liquid crystal material forming the pixel, on the basis of an output signal supplied from the voltage generating circuit in accordance with the pixel data, thereby modulating a light transmitted through the spatial light modulating element or a light reflected by spatial light modulation As such a spatial light modulating element, there is known a liquid crystal display which uses liquid crystal used in a twisted nematic operation mode (hereinafter referred to as TN liquid crystal), liquid crystal used in a super-twisted nematic operation mode (hereinafter referred to as STN liquid crystal), ferroelectric liquid crystal having a higher response speed than TN liquid crystal and STN liquid crystal (hereinafter referred to as FLC), or anti-ferroelectric liquid crystal, as a substance for modulating a light.

2-1. Principle of Light Modulation of Spatial Light Modulating Element Using TN Liquid Crystal and STN Liquid Crystal The principle of light modulation of a spatial light modulating element using TN liquid crystal and STN liquid crystal as substances for modulating a light will be described.

2-1-1. Structure of Spatial Light Modulating Element Using TN Liquid Crystal and STN Liquid Crystal The spatial light modulating element 10 using TN liquid crystal and STN liquid crystal has a pair of glass substrates 11, 12, and a liquid crystal material 13 is sandwiched between these pair of glass substrates 11, 12, as shown in FIGS. 7A and 7B.

On facing surfaces of the pair of glass substrates 11, 12, transparent electrodes 14, 15, and orientation films 16, 17 for arranging molecules of the liquid crystal material 13 into uniform directions are provided, respectively.

The direction of orientation of the orientation film 16 provided on the one glass substrate 11 and the direction of orientation of the orientation film 17 provided on the other glass substrate 12 are orthogonal to each other. Therefore, in the state where a voltage is not applied to the transparent electrodes 14, 15, the liquid crystal material 13 is in a twisted state such that the direction of molecules is gradually changed from the glass substrate 11 to the glass substrate 12, as shown in FIG. 7A.

Figure 7B:
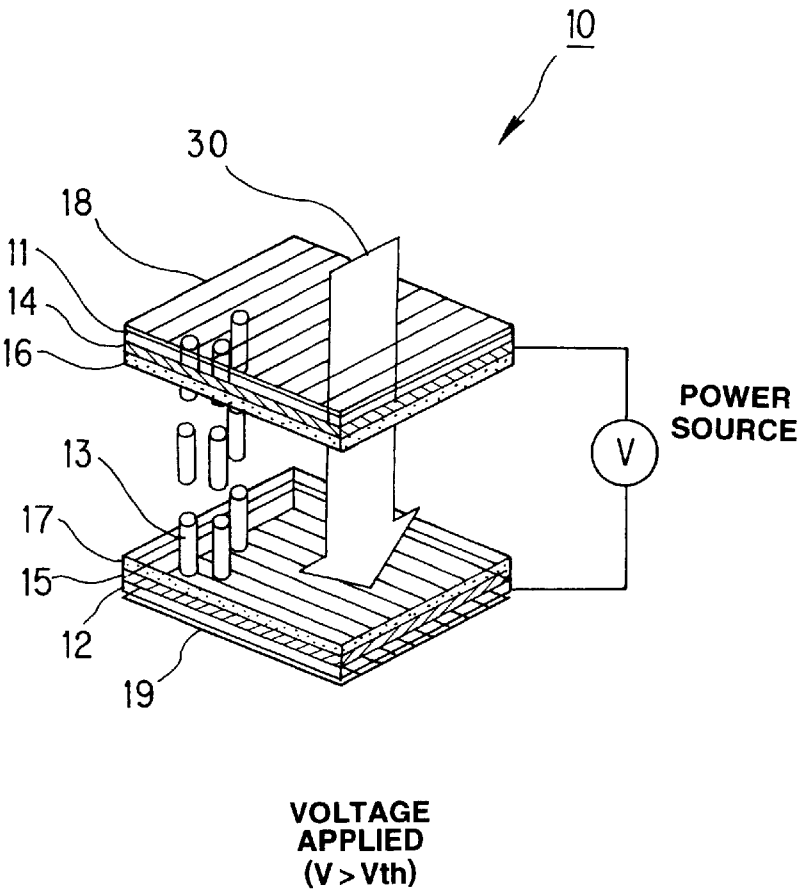
FIGS. 7A and 7B schematically show a spatial light modulating element using TN liquid crystal and STN liquid crystal.
Figure 7A:
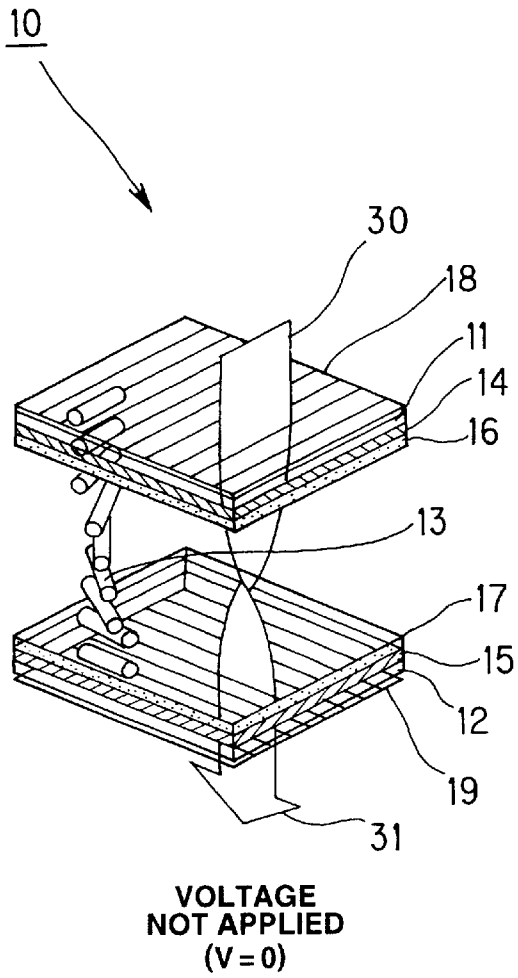

When a voltage is applied to the transparent electrodes 14, 15, the molecules of the liquid crystal material 13 are arrayed in the vertical direction under the influence of the electric field, as shown in FIG. 7B.

On a surface of the glass substrate 11 opposite to the surface on which the transparent electrode 14 and the orientation film 16 are provided, a polarizer 18 is provided. On a surface of the glass substrate 12 opposite to the surface on which the transparent electrode 15 and the orientation film 17 are provided, an analyzer 19 is provided.

The polarizer 18 is provided on the glass surface 11 in such a manner that the direction of polarization is in parallel to the direction of orientation of the orientation film 16 provided on the glass substrate 11. The analyzer 19 is provided on the glass substrate 12 in such a manner that the direction of polarization is in parallel to the direction of orientation of the orientation film 17 provided on the glass substrate 12. That is, the polarizer 18 and the analyzer 19 are so arranged that the directions of polarization thereof are orthogonal to each other.

In the spatial light modulating element 10 thus constituted, in the state where a voltage is not applied to the transparent electrodes 14, 15, the liquid crystal material 13 is in the twisted state as described above. At this point, with respect to a light radiated to the spatial light modulating element 10, a polarization component in the same direction as the direction of polarization of the polarizer 18 is transmitted through the polarizer 18 as an incident light 30, and becomes incident on the liquid crystal material 13 held between the pair of glass substrate 11, 12, through the transparent electrode 14 and the orientation film 16.

The direction of polarization of the incident light 30 incident on the liquid crystal material 13 is twisted along the molecular array of the liquid crystal material 13, and becomes orthogonal to the direction of polarization at the time of incidence on the liquid crystal material 13.

Thus, the incident light 30 is transmitted through the analyzer 19 provided on the glass substrate 12, and is emitted from the spatial light modulating element 10 as a transmitted light 31.

On the other hand, when a voltage is applied to the transparent electrodes 14, 15 of the spatial light modulating element 10, the molecules of the liquid crystal material 13 are arrayed in the vertical direction under the influence of the electric field, as described above. At this point, with respect to the light radiated to the spatial light modulating element 10, the polarization component in the same direction as the direction of polarization of the polarizer 18 is transmitted through the polarizer 18 as the incident light 30, and becomes incident on the liquid crystal material 13 held between the pair of glass substrate 11, 12, through the transparent electrode 14 and the orientation film 16.

Since direction of polarization of the incident light 30 incident on the liquid crystal material 13 is not twisted by the liquid crystal material 13, since the molecules of the liquid crystal material 13 are arrayed in the vertical direction. Thus, the incident light 30 is interrupted by the analyzer 19 provided on the other glass substrate 12 and does not appear as the transmitted light 31.

The twist angle of the molecules of the liquid crystal material 13 is 90 degrees in TN liquid crystal and 270 degrees in STN liquid crystal. In the case where STN liquid crystal is used, since the double refraction effect of the liquid crystal material is utilized, color change occurs and practical contrast can be realized in two modes of yellowish green/dark blue and blue/light yellow.

Although the spatial light modulating element of transmission type is described above, the principle of light modulation of a reflection type spatial light modulating element is similar to that of the transmission type spatial light modulating element.

Figure 8:
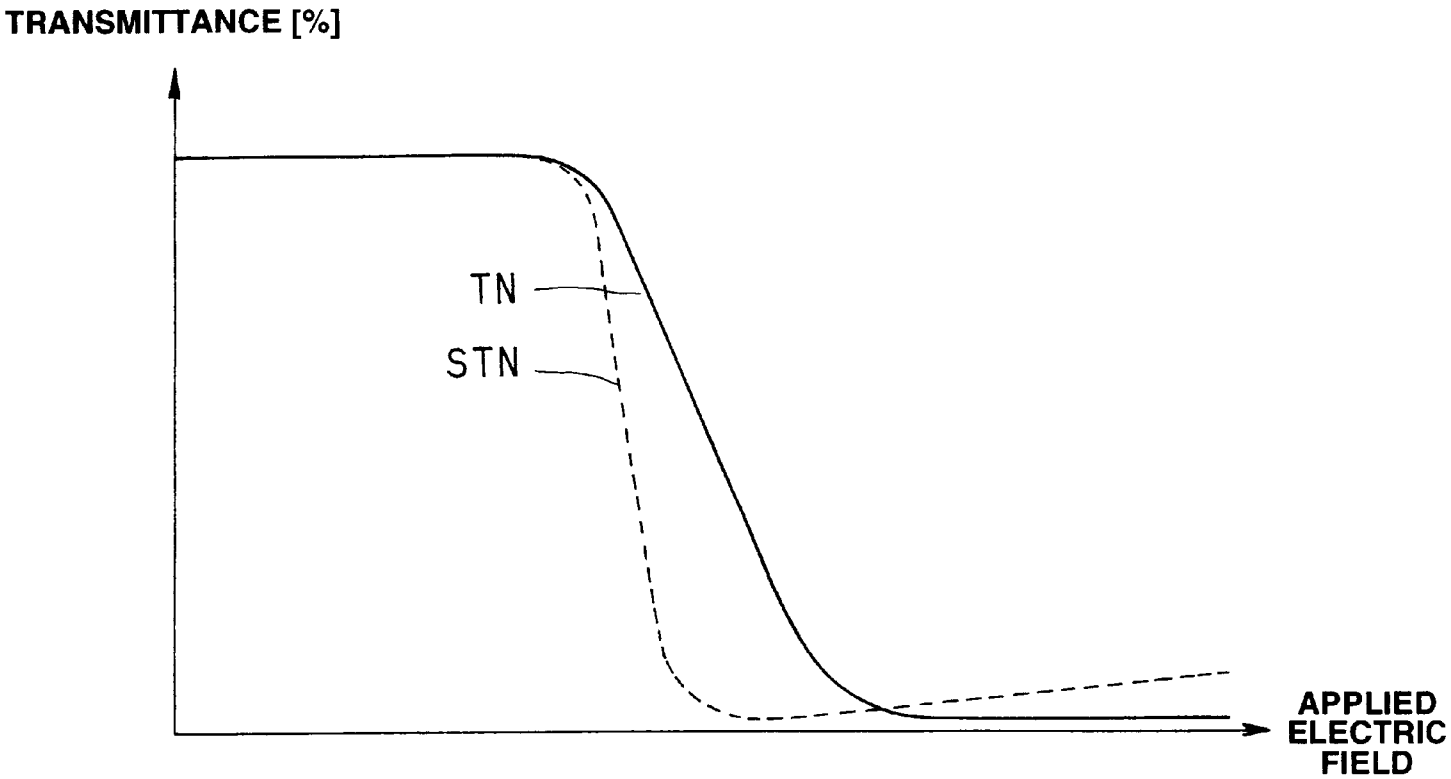
FIG. 8 shows light transmission characteristics of TN liquid crystal and STN liquid crystal.

2-1-2. Transmission Characteristic of Spatial Light Modulating Element Using TN Liquid Crystal and STN Liquid Crystal FIG. 8 shows the transmission characteristic of the spatial light modulating element using TN liquid crystal and STN liquid crystal, that is, the relation between the voltage applied to the spatial light modulating element and the transmittance. As seen from FIG. 8, the spatial light modulating element using TN liquid crystal and STN liquid crystal maintains a high transmittance until a voltage of a predetermined magnitude is applied. When a voltage of a predetermined magnitude is applied, the transmittance is suddenly lowered. The spatial light modulating element using STN liquid crystal has an acute rising characteristic in comparison with the spatial light modulating element using TN liquid crystal.

Figure 9:
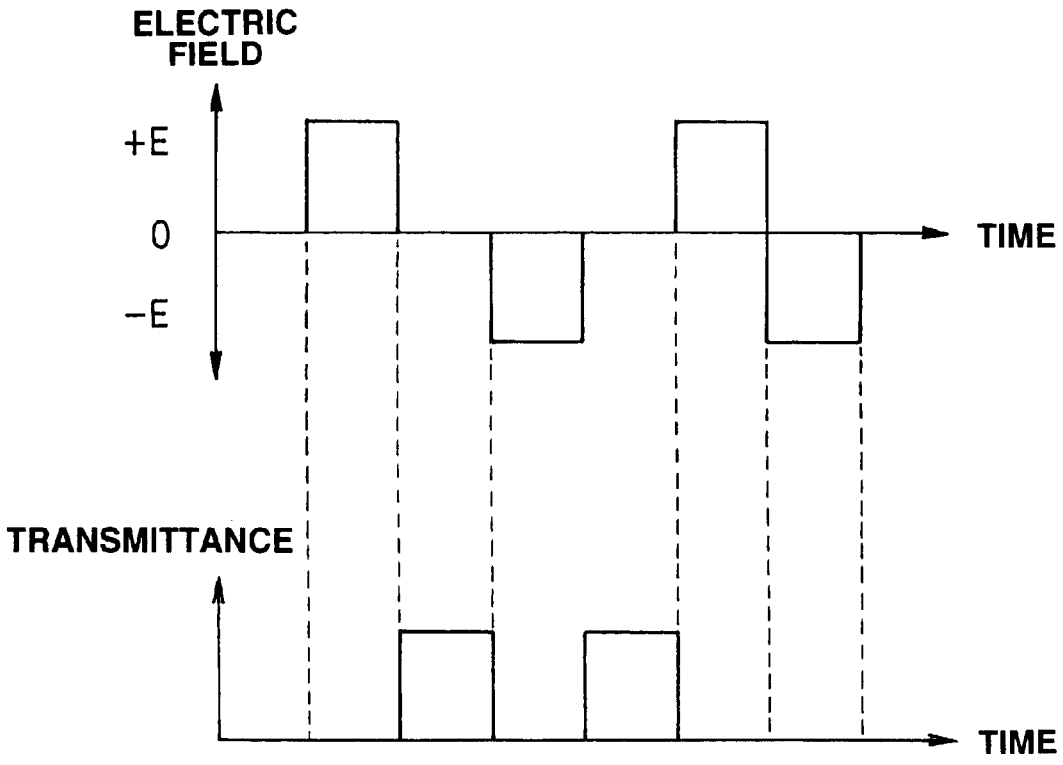
FIG. 9 is a typical driving waveform diagram of the spatial light modulating element using TN liquid crystal and STN liquid crystal.

2-1-3. Principle of Driving of Spatial Light Modulating Element Using TN Liquid Crystal and STN Liquid Crystal FIG. 9 shows a general driving waveform of the spatial light modulating element using TN liquid crystal and STN liquid crystal. As seen from FIG. 9, the transmittance of the spatial light modulating element using TN liquid crystal and STN liquid crystal is lowered, whether a positive electric field or a negative electric field is generated on application of a voltage. Thus, in the spatial light modulating element using TN liquid crystal and STN liquid crystal, so-called bipolar drive is carried out to neutralize ions inside of the liquid crystal.

2-2. Principle of Light Modulation of Spatial Light Modulating Element Using FLC The principle of light modulation of a spatial light modulating element using FLC as a substance for modulating light will now be described.

2-2-1. Structure of Spatial Light Modulating Element Using FLC

Figure 10B:
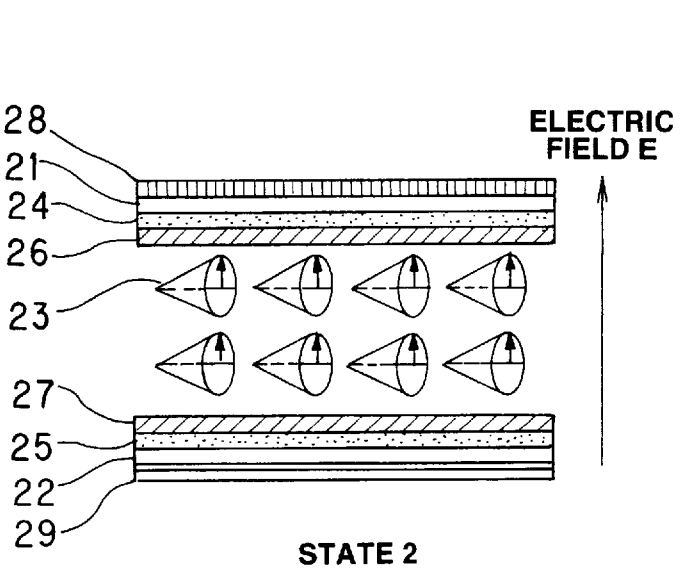
FIGS. 10A to 10C schematically show a spatial light modulating element using FLC.
Figure 10A:
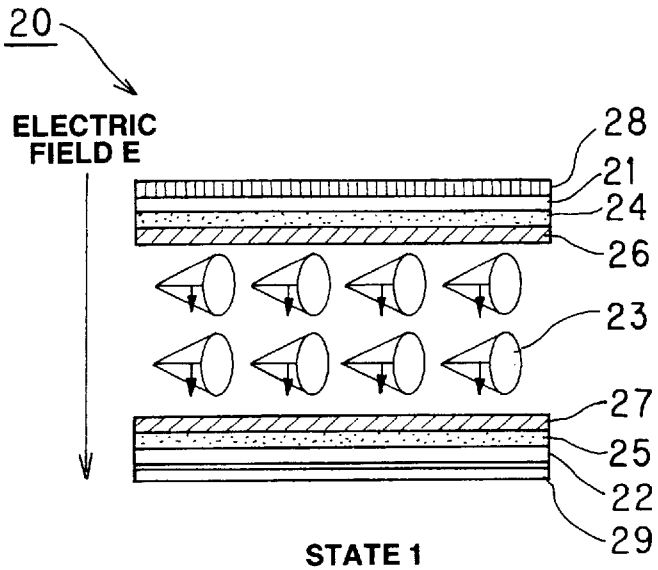

The spatial light modulating element 20 using FLC has a pair of glass substrates 21, 22, and a liquid crystal material 23 is sandwiched between these pair of glass substrates 21, 22, as shown in FIGS. 10A and 10B.

On facing surfaces of the pair of glass substrates 21, 22, transparent electrodes 24, 25, and orientation films 26, 27 for arranging molecules of the liquid crystal material 23 into uniform directions are provided, respectively. The direction of orientation of the orientation film 26 provided on the one glass substrate 21 and the direction of orientation of the orientation film 27 provided on the other glass substrate 22 are in parallel to each other.

On a surface of the glass substrate 21 opposite to the surface on which the transparent electrode 24 and the orientation film 26 are provided, a polarizer 28 is provided. On a surface of the glass substrate 22 opposite to the surface on which the transparent electrode 25 and the orientation film 27 are provided, an analyzer 29 is provided.

The polarizer 28 is provided on the glass surface 21 in such a manner that the direction of polarization is in parallel to the direction of orientation of the orientation film 26 provided on the glass substrate 21. The analyzer 29 is provided on the glass substrate 22 in such a manner that the direction of polarization is orthogonal to the direction of orientation of the orientation film 27 provided on the glass substrate 22. That is, the polarizer 28 and the analyzer 29 are so arranged that the directions of polarization thereof are orthogonal to each other.

Figure 10C:
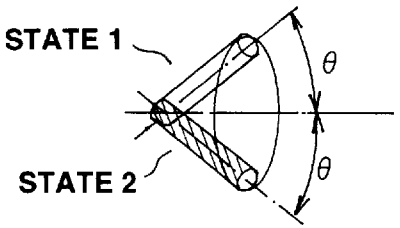

The liquid crystal material 23 sandwiched between the pair of glass substrates 21, 22 selective takes one of two states, that is, a state 1 where the double refraction effect is not generated and a state 2 where the double refraction effect is generated, in accordance with the direction of an electric field generated by an applied voltage, as shown in FIG. 10C.

On the assumption that the liquid crystal material 23 takes the state 1 when the electric field is in the direction shown in FIG. 10A, a polarization component in the same direction as the direction of polarization of the polarizer 28, of a light radiated to the spatial light modulating element 20, is transmitted through the polarizer 28 as an incident light 30, and becomes incident on the liquid crystal material 23 held between the pair of glass substrate 21, 22, through the transparent electrode 24 and the orientation film 26.

The incident light 30 incident on the liquid crystal material 23 reaches the analyzer 29 provided on the glass substrate 22, without being affected by the double refraction effect of the liquid crystal material 23. Thus, the incident light 30 is interrupted by the analyzer 29 and does not appear as a transmitted light 31.

On the assumption that the liquid crystal material 23 takes the state 2 when the electric field is in the direction shown in FIG. 10B, a polarization component in the same direction as the direction of polarization of the polarizer 28, of a light radiated to the spatial light modulating element 20, is transmitted through the polarizer 28 as an incident light 30, and becomes incident on the liquid crystal material 23 held between the pair of glass substrate 21, 22, through the transparent electrode 24 and the orientation film 26.

The incident light 30 incident on the liquid crystal material 23 reaches the analyzer 29 provided on the glass substrate 22, with its direction of polarization twisted at right angles under the influence of the double refraction effect of the liquid crystal material 23. Thus, the incident light 30 is transmitted through the analyzer 29 and is emitted from the spatial light modulating element 20 as a transmitted light 31.

Although the spatial light modulating element of transmission type is described above, the principle of light modulation of a reflection type spatial light modulating element is similar to that of the transmission type spatial light modulating element.

Figure 11:
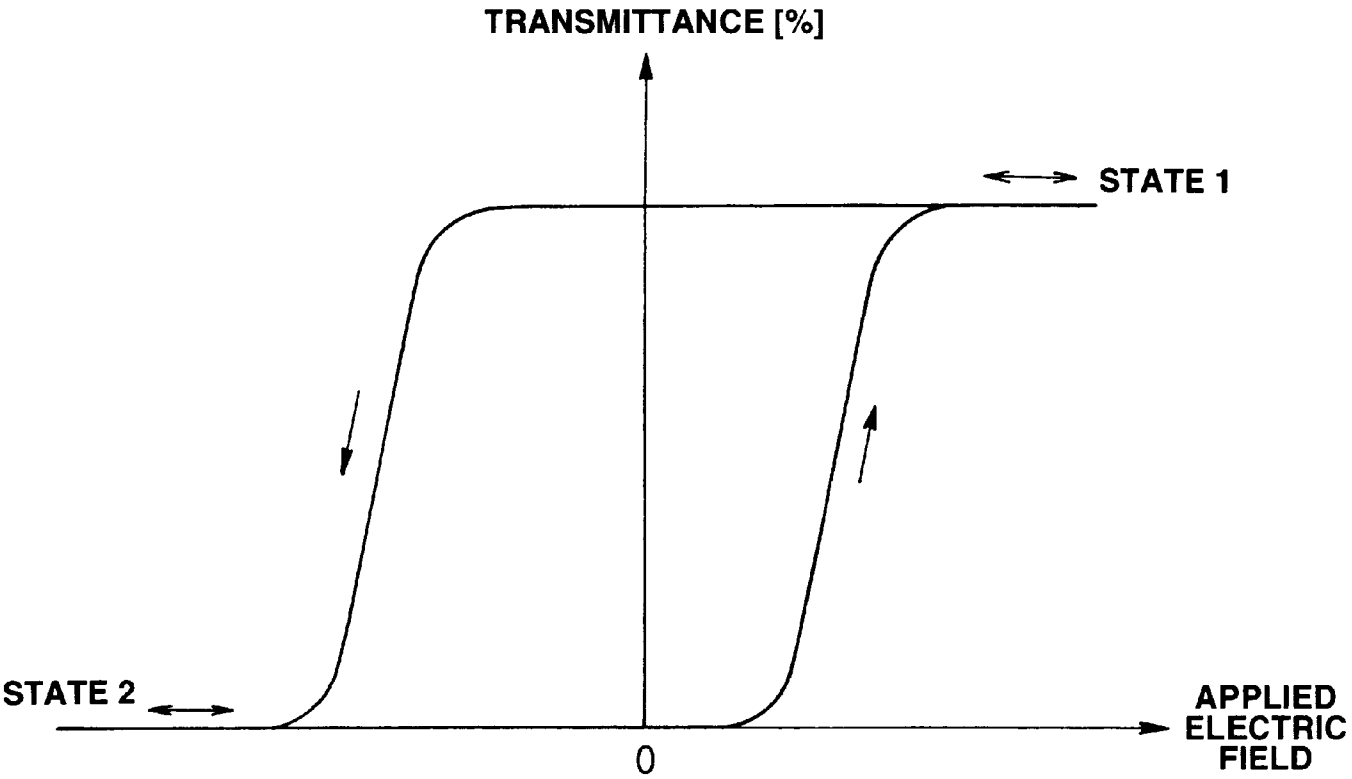
FIG. 11 is a view showing light transmission characteristics of FLC.

2-2-2. Transmission Characteristic of Spatial Light Modulating Element Using FLC FIG. 11 shows the transmission characteristic of the spatial light modulating element using FLC. As seen from FIG. 11, the spatial light modulating element using FLC exhibits the hysteresis characteristic, that is, the state memory characteristic. This is due to spontaneous polarization Ps of FLC.

In order to invert the direction of spontaneous polarization Ps of FLC, electric charges of a quantity twice the quantity of polarized electric charges are supplied. For example, when the magnitude of spontaneous polarization Ps of FLC is pS1 [C], the direction of spontaneous polarization Ps of FLC is inverted by injecting electric charges of 2×pS1 [C] to FLC. The direction of spontaneous polarization Ps of FLC is not inverted until electric charges of 2×pS1 [C] are injected to FLC. Thus, the spatial light modulating element using FLC shows the hysteresis characteristic.

2-2-3. Principle of Driving of Spatial Light Modulating Element Using FLC

Figure 12:
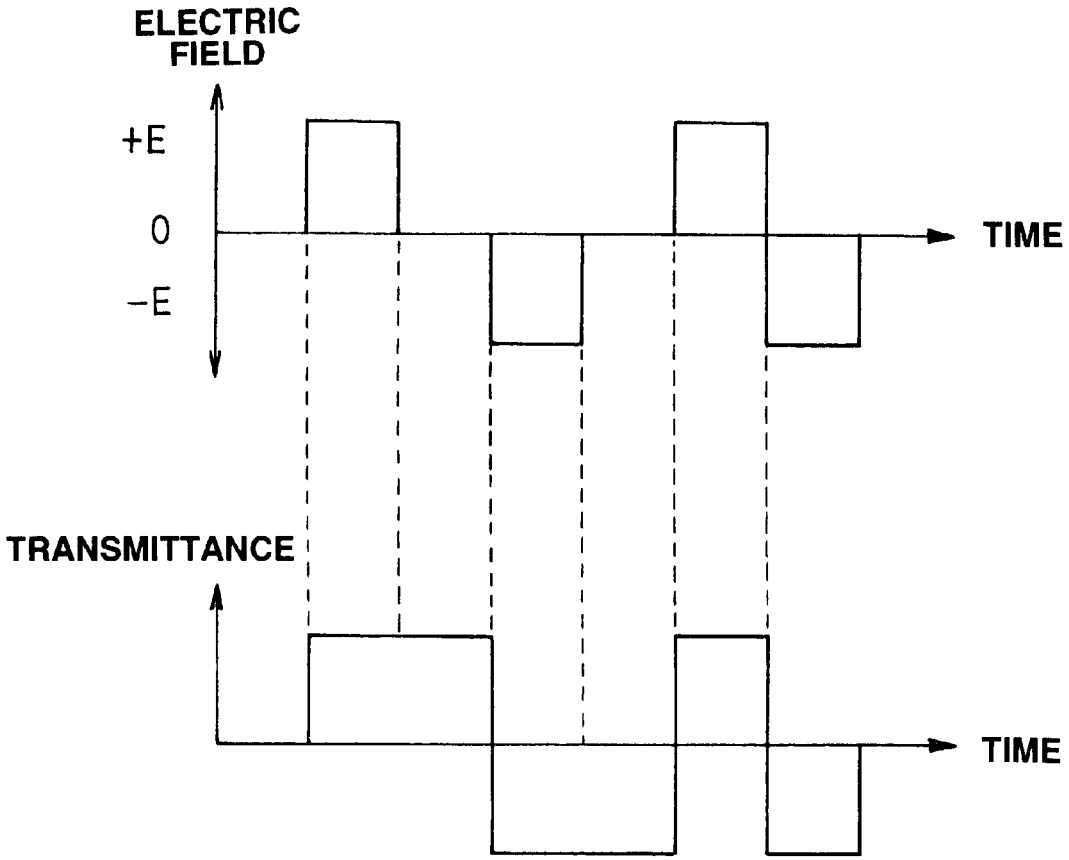
FIG. 12 is a typical driving waveform diagram of the spatial light modulating element using FLC.

FIG. 12 shows a general driving waveform of the spatial light modulating element using FLC. Since the spatial light modulating element using FLC utilizes the state memory characteristic of FLC, it can be driven by applying a voltage for a minimum required period. In the spatial light modulating element using FLC, too, bipolar drive is carried out to neutralize ions inside of the liquid crystal. However, since transmission or shutdown is determined by the direction of the electric field, unlike the spatial light modulating element using TN liquid crystal and STN liquid crystal, the driving method is more complicated.

The liquid crystal as a whole is described in detail in "Color Liquid Crystal Display" issued by Sangyo Tosho, and "Liquid Crystal Device Handbook" edited by the 142th Commission of Japan Academic Association.

2-3. Typical Scan Driving Method for Spatial Light Modulating Element

A typical scan driving method for a spatial light modulating element using a liquid crystal material will now be described.

In the spatial light modulating element using a liquid crystal material, for example, in a liquid crystal panel, it is difficult to wire each pixel and control the state of each pixel for reasons such as increase in the number of wirings. Thus, in the spatial light modulating element of this type, a plurality of scanning lines and a plurality of data lines are wired in the form of matrix, and pixels are formed corresponding to each point of intersection between the scanning line and the data line. The scanning lines are adapted for selecting a pixel line on which pixel data is to be written, and the data line are adapted for supplying pixel data to selected pixels.

Figure 13:
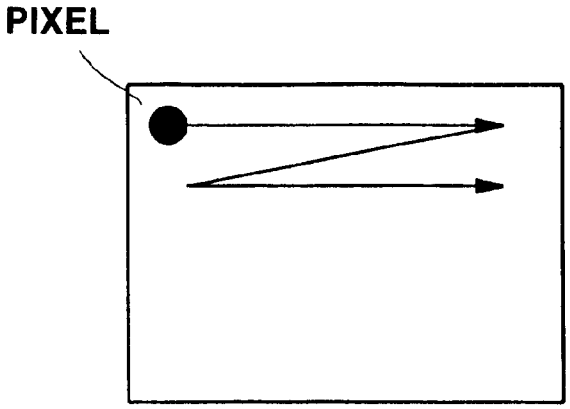
FIG. 13 is a conceptual view for explaining a method for driving the spatial light modulating element by point-sequential scan.

As the scan driving method for the spatial light modulating element, first, a point-sequential method can be employed. This point-sequential method is a method for sequentially writing data by each pixel, as shown in FIG. 13. The point-sequential method is broadly used in CRTs (cathode ray tubes) and active matrix type LCDs (liquid crystal displays) using poly-Si TFT (thin film transistor).

Figure 14:
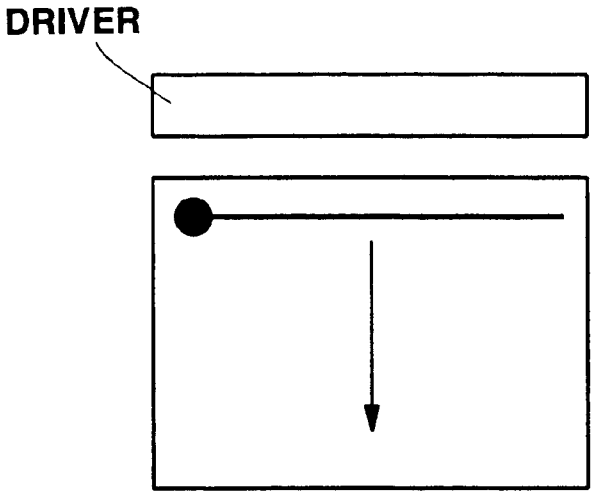
FIG. 14 is a conceptual view for explaining a method for driving the spatial light modulating element by line-sequential scan.

Also, a line-sequential method is broadly used as the scan driving method for the spatial light modulating element. This line-sequential method is a method for taking data of one line into the driver and then sequentially writing the data by each line, as shown in FIG. 14. The line-sequential method is broadly used in active matrix type LCDs and simple matrix type LCDs using amorphous silicon.

In the point-sequential method and the line-sequential method, when the number of pixels provided in the spatial light modulating element increases, the driving time per pixel must be reduced and it might be difficult to carry out satisfactory driving. Thus, an overall batched rewrite method is proposed as a method for enabling appropriate driving even in the case where the number of pixels provided in the spatial light modulating element increases.

This overall batched rewrite method is a method for providing a memory in each pixel, then taking data into the memory, and carrying out batched data writing. The overall batched rewrite method is effective in the case where a field sequential method for displaying pixel data in a time-divisional manner by each color and displaying colors utilizing the integral effect of the human eyes, or a gradation display method using PWM (pulse width modulation), is used.

Figure 15:
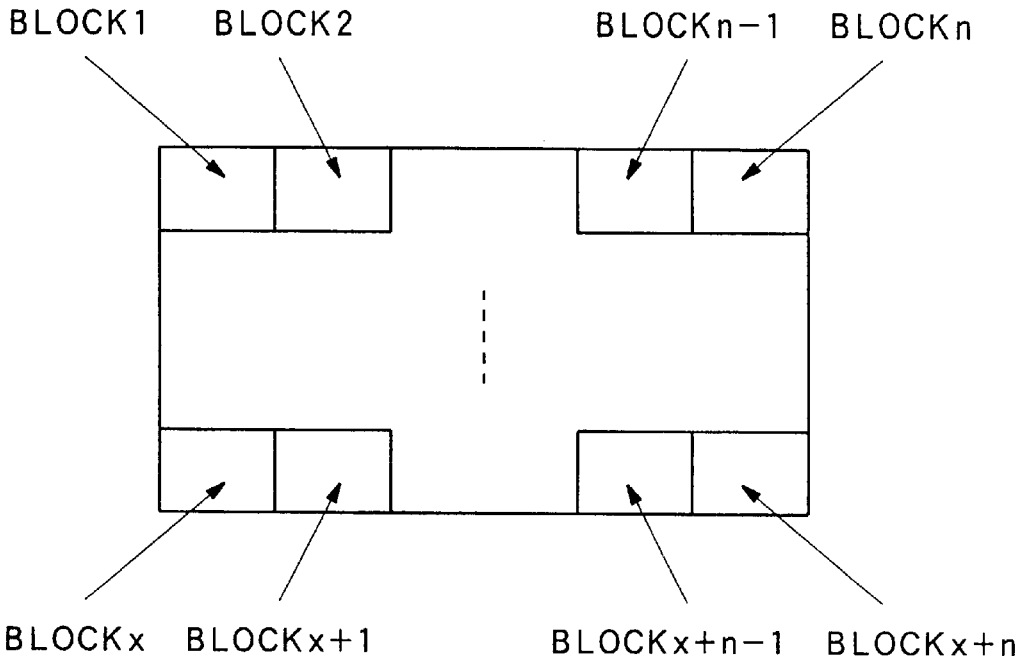
FIG. 15 is a conceptual view for explaining a method for dividing the spatial light modulating element into a plurality of blocks and carrying out batched data writing by each block.

By using the principle of the overall batched rewrite method, it is possible to divide the spatial light modulating element into a plurality of blocks and carry out batched data writing to each block, as shown in FIG. 15.

2-4. Driving Method for Spatial Light Modulating Element Based on Pre-Charge Driving Method A method for driving a spatial light modulating element based on a pre-charge driving method using the voltage generating circuit of the present invention will now be described.

Figure 16:
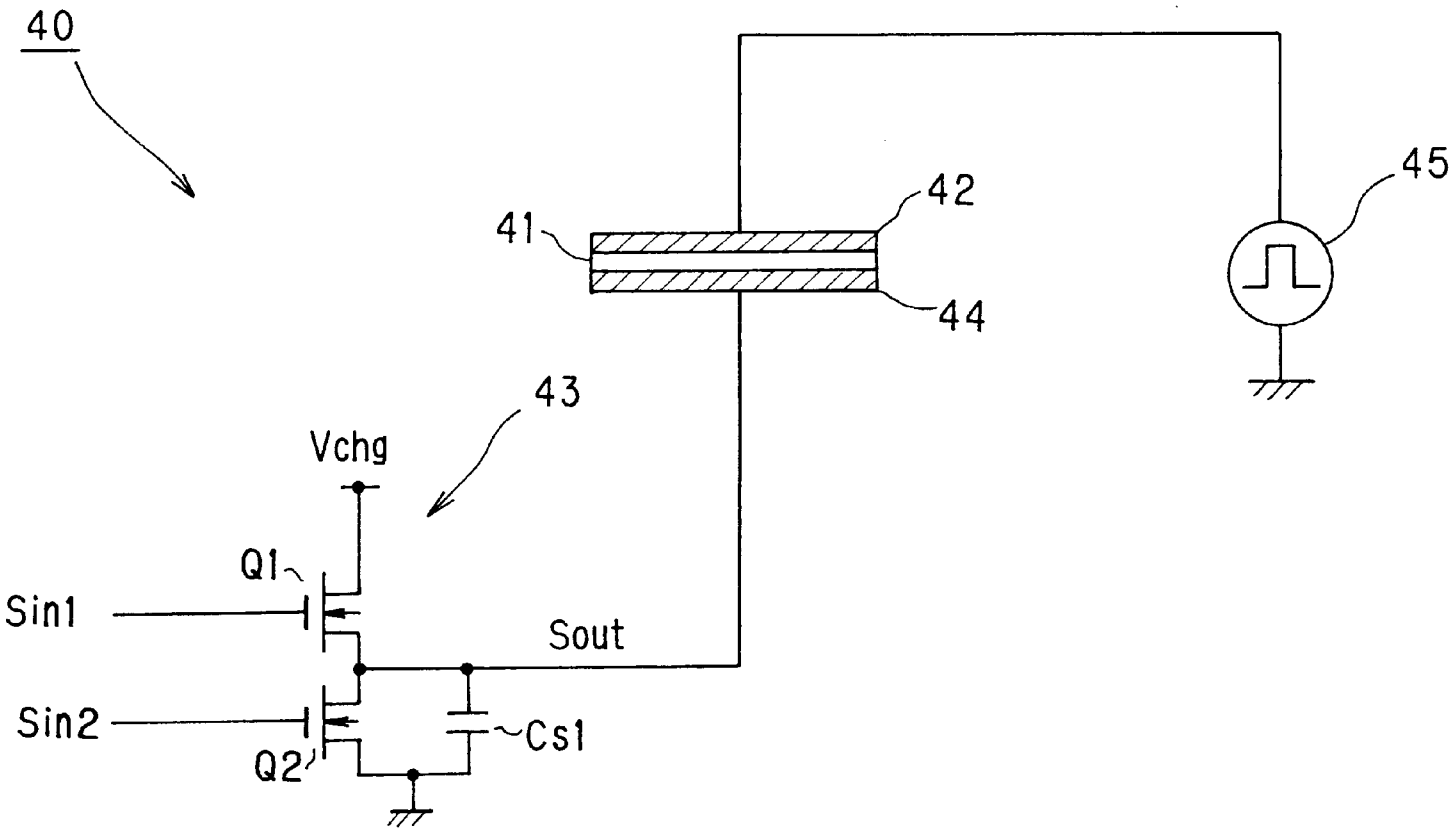
FIG. 16 shows the schematic structure of the spatial light modulating element using TN liquid crystal and STN liquid crystal.

2-4-1. Case of Spatial Light Modulating Element Using TN Liquid Crystal and STN Liquid Crystal FIG. 16 shows the schematic structure of a spatial light modulating element using TN liquid crystal and STN liquid crystal. This spatial light modulating element 40 has a basic structure similar to that of the spatial light modulating element 10 shown in FIG. 5. A transparent electrode 42 provided on one of a pair of glass substrates sandwiching a liquid crystal material 42 is connected to the output node of the voltage generating circuit 43 shown in FIG. 4A, and a transparent electrode 44 provided on the other glass substrate is connected to an oscillator 45. In FIG. 16, the pair of glass substrates, the orientation films, the polarizer and the analyzer are not shown.

In this spatial light modulating element 40, since an electric field generated between the pair of transparent electrodes 42, 44 is changed by a voltage supplied from the voltage generating circuit 43 in accordance with the pre-charge driving method and a voltage supplied from the oscillator 45, the state of the liquid crystal material 41 is changed to transmit or interrupt a light.

Figure 17:
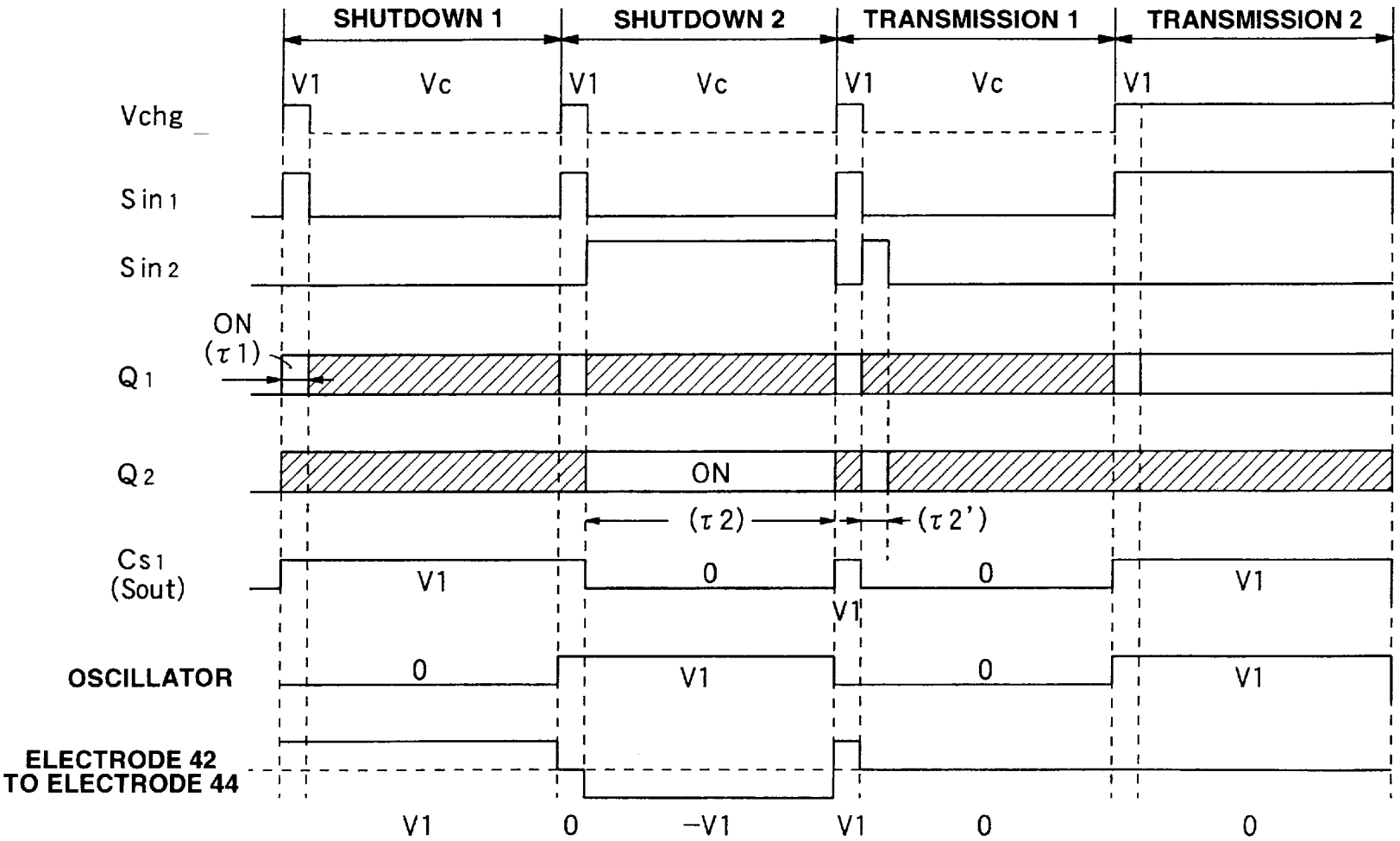
FIG. 17 is a waveform diagram showing operation of the spatial light modulating element using TN liquid crystal and STN liquid crystal.

FIG. 17 is a waveform diagram showing operation of the spatial light modulating element 40. Referring to this waveform diagram, operation of the spatial light modulating element 40 will be described hereinafter. To simplify the description, the voltage for pre-charge is made constant at V1. However, this value is arbitrary and need not be constant.

In "shutdown 1", a voltage V1 is applied to the one transparent electrode 42 by the pre-charge driving method.

At this point, since the electric potential of the other transparent electrode 44 is 0, a voltage of V1 (V1−0) is applied between the pair of transparent electrodes 42, 44, that is, to both ends of the liquid crystal material 41, thus generating a shutdown state. In the state where the nMOS transistor Q1 is set in the OFF state after the end of the pre-charge period, an arbitrary electric potential (Vc) may be used since the charging voltage Vchg does not contribute to driving.

In "shutdown 2", since electric charges are discharged from the capacitor Cs1 after pre-charge is carried out, the electric potential of the one transparent electrode 42 becomes 0. At this point, since the voltage V1 is applied to the other transparent electrode 44 from the oscillator 45, a voltage of −V1 (0−V1) is applied between the pair of transparent electrodes 42, 44, that is, to both ends of the liquid crystal material 41, thus generating a shutdown state.

In "transmission 1", since electric charges are discharged from the capacitor Cs1 after pre-charge is carried out, the electric potential of the one transparent electrode 42 becomes 0. At this point, since the electric potential of the other transparent electrode 44 is made 0, the potential difference between the pair of transparent electrodes 42, 44, that is, between both ends of the liquid crystal material 41, becomes 0 (0−0). Thus, a transmission state is generated. In this "transmission 1", the nMOS transistor Q2 is switched to the OFF state after the lapse of the time period τ2'. If there is no inflow of electric charges from the output side, as in this example, the nMOS transistor Q2 may be switched to the OFF state after the lapse of the time period τ2' necessary for discharge from the capacitor Cs1.

In "transmission 2", in order to enhance the driving capability, the nMOS transistor Q1 is held in the ON state to continue applying the voltage V1 to the one transparent electrode 42 even after pre-charge is carried out. At this point, since the voltage V1 is applied to the other transparent electrode 44 from the oscillator 45, the potential difference between the pair of transparent electrodes 42, 44, that is, between both ends of the liquid crystal material 41, becomes 0 (V1−V1). Thus, a transmission state is generated.

In the above description, the spatial light modulating element 40 is employed in which the polarizer and the analyzer are so arranged that their directions of polarization are orthogonal to each other. However, in the case where the polarizer and the analyzer are so arranged that the direction of polarization of the polarizer and the direction of polarization of the analyzer are in parallel to each other, shutdown and transmission are inverted as a matter of course.

2-4-2. Case of Spatial Light Modulating Element Using FLC

Figure 18:
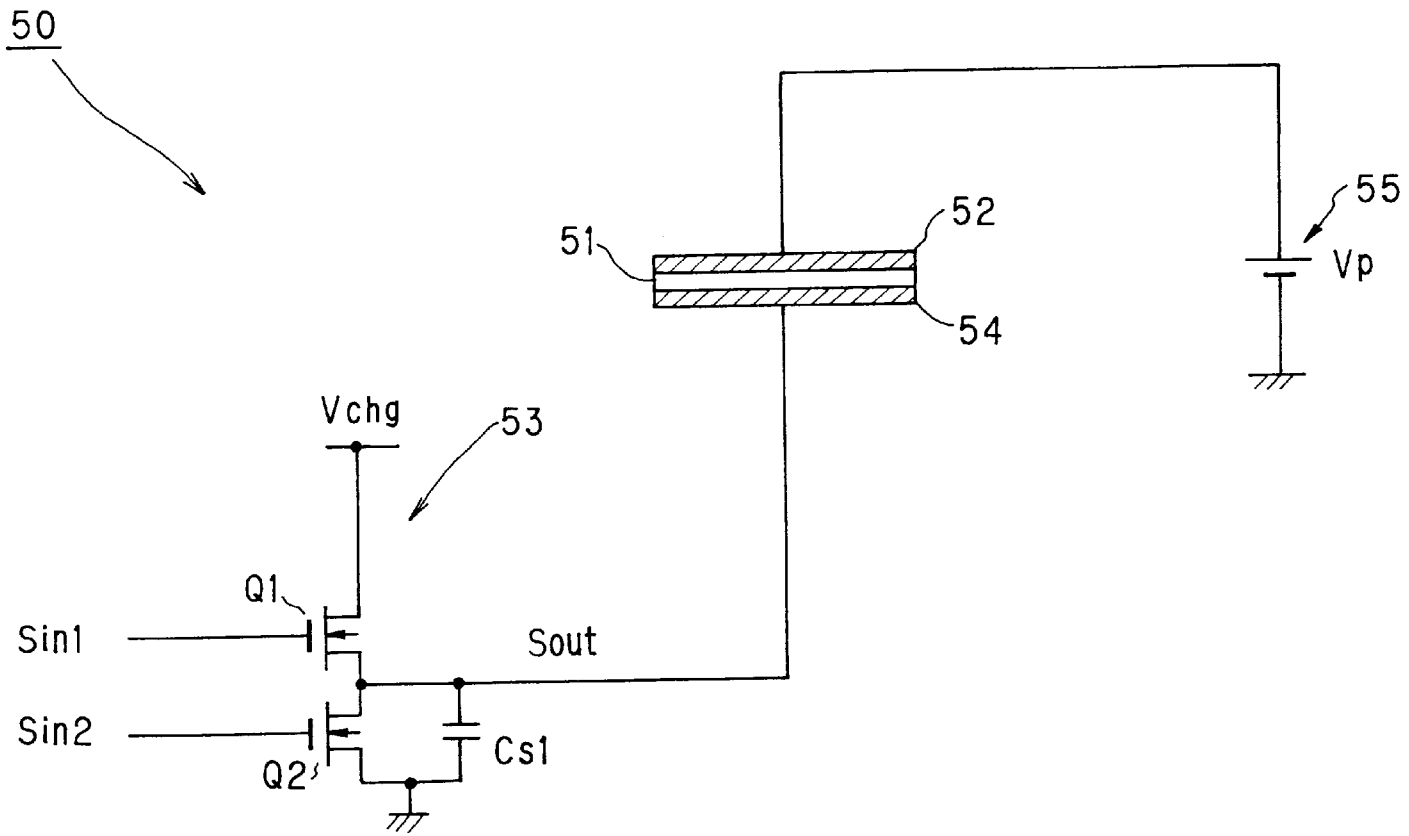
FIG. 18 shows the schematic structure of the spatial light modulating element using FLC.

FIG. 18 shows the schematic structure of a spatial light modulating element using FLC. This spatial light modulating element 50 has a basic structure similar to that of the spatial light modulating element 20 shown in FIG. 10. A transparent electrode 52 provided on one of a pair of glass substrates sandwiching a liquid crystal material 51 is connected to the output node of the voltage generating circuit 53 shown in FIG. 4A, and a transparent electrode 54 provided on the other glass substrate is connected to a power source 55. In FIG. 18, the pair of glass substrates, the orientation films, the polarizer and the analyzer are not shown.

In this spatial light modulating element 50, since an electric field generated between the pair of transparent electrodes 52, 54 is changed by a voltage supplied from the voltage generating circuit 53 in accordance with the pre-charge driving method and a voltage supplied from the power source 55, the state of the liquid crystal material 51 is changed to transmit or interrupt a light.

Figure 19:
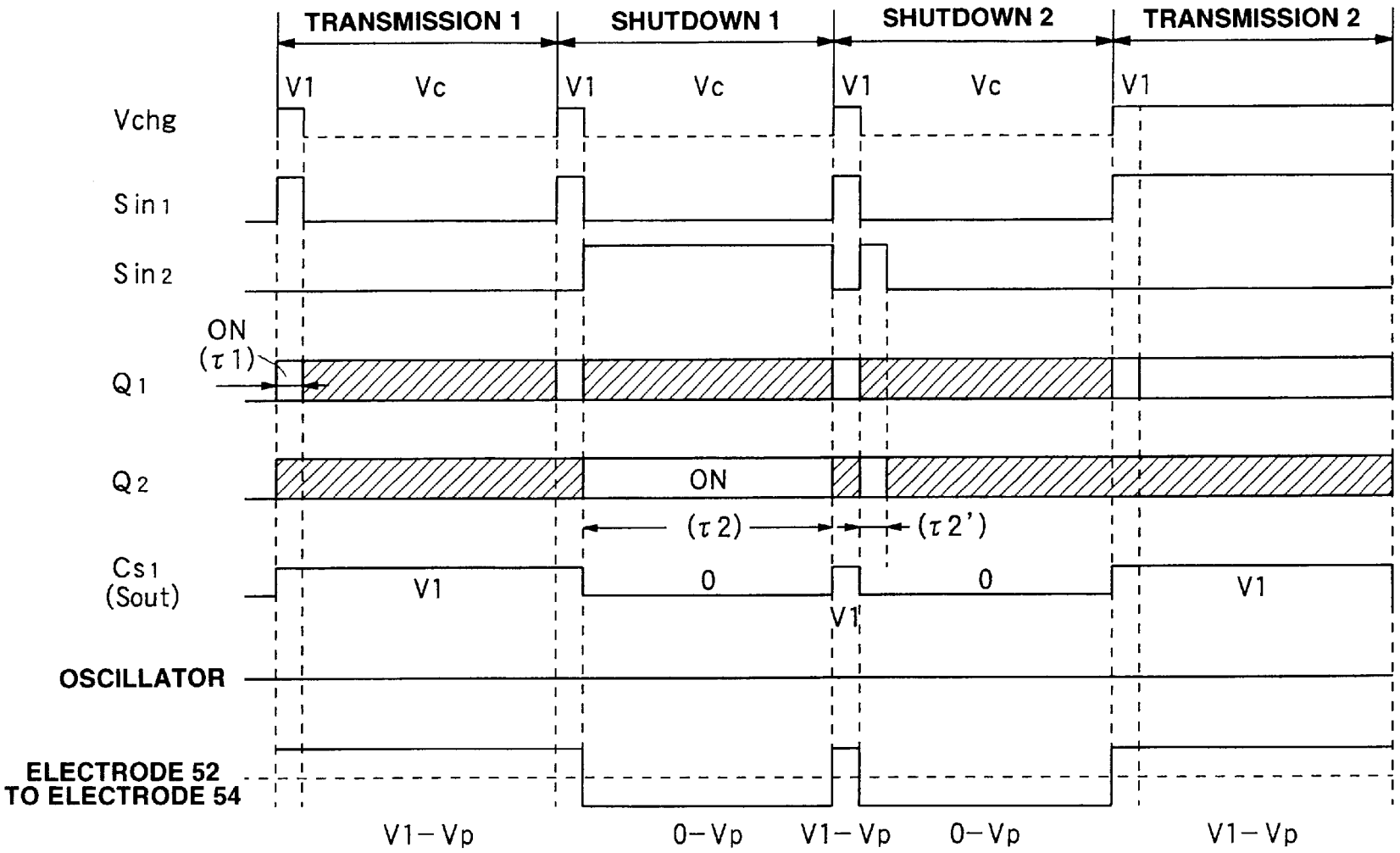
FIG. 19 is a waveform diagram showing operation of the spatial light modulating element using FLC.
Figure 20:
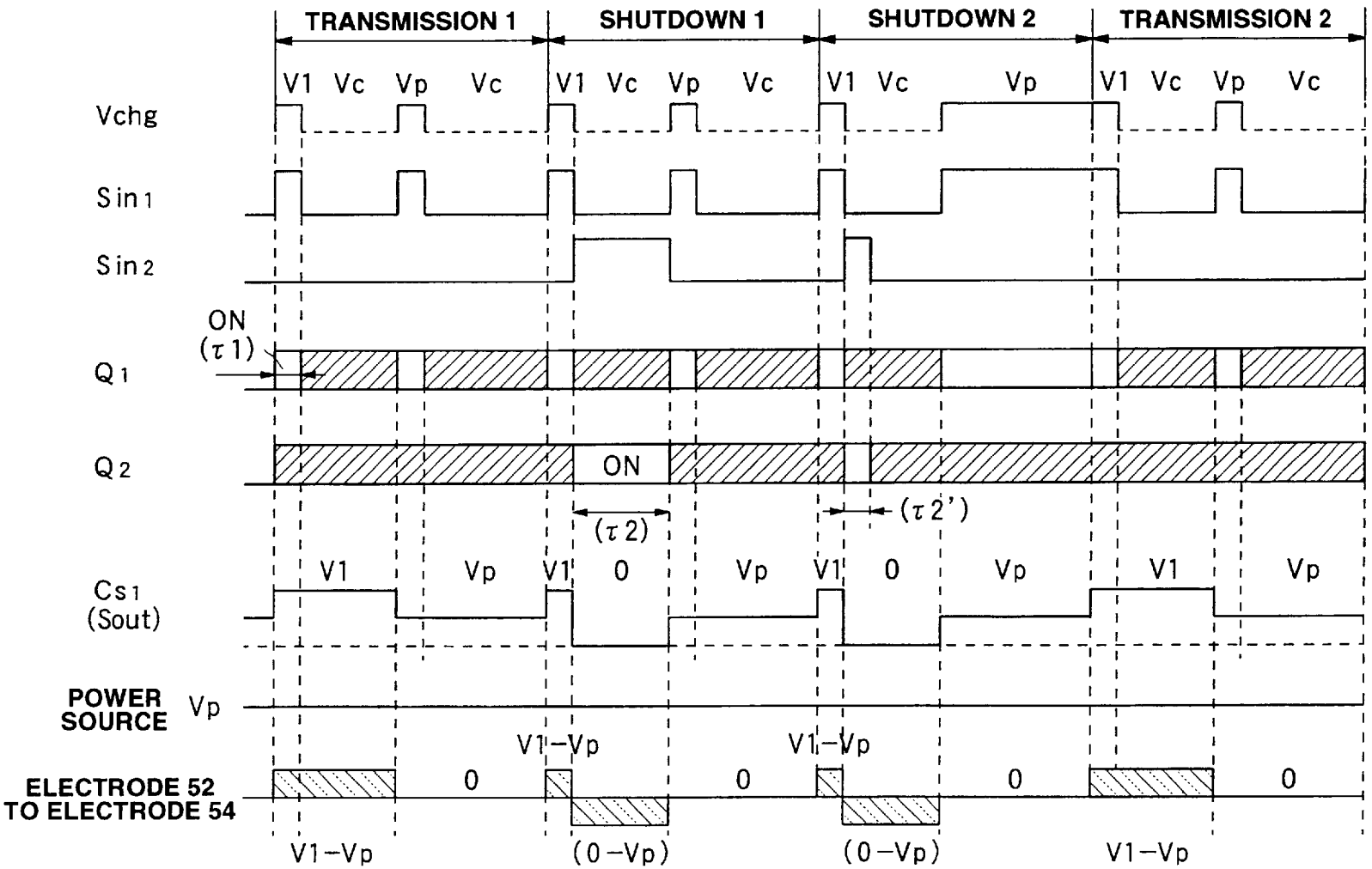
FIG. 20 is a waveform diagram showing operation of the spatial light modulating element in the case where the state memory characteristic of FLC is utilized.

FIGS. 19 and 20 are waveform diagrams showing operation of the spatial light modulating element 50. Referring to these waveform diagrams, operation of the spatial light modulating element 50 will be described hereinafter. To simplify the description, the voltage for pre-charge is made constant at V1. However, this value is arbitrary and need not be constant.

First, referring to FIG. 19, operation of the spatial light modulating element 50 in the case where the state memory characteristic of FLC is not utilized will be described.

In "transmission 1", a voltage V1 is applied to the one transparent electrode 52 by the pre-charge driving method. At this point, since a voltage Vp smaller than the voltage V1 is applied to the other transparent electrode 54 by the power source 55, a positive voltage of V1−Vp is applied between the pair of transparent electrodes 52, 54, that is, to both ends of the liquid crystal material 51, thus generating a transmission state. In the state where the nMOS transistor Q1 is set in the OFF state after the end of the pre-charge period, an arbitrary electric potential (Vc) may be used since the charging voltage Vchg does not contribute to driving.

In "shutdown 1", since electric charges are discharged from the capacitor Cs1 after pre-charge is carried out, the electric potential of the one transparent electrode 52 becomes 0. At this point, since the voltage Vp is applied to the other transparent electrode 54 from the power source 55, a voltage of −Vp (0−Vp) is applied between the pair of transparent electrodes 52, 54, that is, to both ends of the liquid crystal material 51, thus generating a shutdown state.

In "shutdown 2", similar to "shutdown 1", since electric charges are discharged from the capacitor Cs1 after pre-charge is carried out, the electric potential of the one transparent electrode 52 becomes 0. At this point, since the voltage Vp is applied to the other transparent electrode 54 from the power source 55, a voltage of −Vp (0−Vp) is applied between the pair of transparent electrodes 52, 54, that is, to both ends of the liquid crystal material 51, thus generating a shutdown state.

In this "shutdown 2", the nMOS transistor Q2 is switched to the OFF state after the lapse of the time period τ2'. If there is no inflow of electric charges from the output side, as in this example, the nMOS transistor Q2 may be switched to the OFF state after the lapse of the time period τ2' necessary for discharge from the capacitor Cs1.

Also, when "shutdown 2" starts, the voltage of the electric potential (V1−Vp) necessary for pre-charge is applied to both ends of the liquid crystal material 51. However, if the time period during which this voltage is applied is sufficiently short (approximately 1/10 or less) with respect to the response speed (generally, several hundred microseconds) of FLC, there is no problem in operation of the spatial light modulating element 50.

In "transmission 2", in order to enhance the driving capability, the nMOS transistor Q1 is held in the ON state to continue applying the voltage V1 to the one transparent electrode 52 even after pre-charge is carried out. At this point, since the voltage Vp is applied to the other transparent electrode 54 from the power source 55, a positive voltage of V1−Vp is applied between the pair of transparent electrodes 52, 54, that is, to both ends of the liquid crystal material 51, thus generating a transmission state.

In the above description, the spatial light modulating element 50 is employed in which the polarizer and the analyzer are so arranged that their directions of polarization are orthogonal to each other. However, in the case where the polarizer and the analyzer are so arranged that the direction of polarization of the polarizer and the direction of polarization of the analyzer are in parallel to each other, shutdown and transmission are inverted as a matter of course.

Next, referring to FIG. 20, operation of the spatial light modulating element 50 in the case where the state memory characteristic of FLC is utilized will be described.

As the state memory characteristic of FLC is utilized, the spatial light modulating element 50 using FLC can be driven by applying a voltage only for a minimum required period, and polarization of ions causing deterioration of FLC can be reduced.

In "transmission 1", a voltage V1 is applied to the one transparent electrode 52 by the pre-charge driving method. At this point, since a voltage Vp smaller than the voltage V1 is applied to the other transparent electrode 54 by the power source 55, a positive voltage of V1−Vp is applied between the pair of transparent electrodes 52, 54, that is, to both ends of the liquid crystal material 51, thus generating a transmission state. In the state where the nMOS transistor Q1 is set in the OFF state after the end of the pre-charge period, an arbitrary electric potential (Vc) may be used since the charging voltage Vchg does not contribute to driving.

After that, the charging voltage Vchg is set at Vp and the nMOS transistor Q1 is switched to the ON state, thereby applying the voltage Vp to the one transparent electrode 52. Thus, the potential difference between both ends of the liquid crystal material 51 becomes 0 (Vp−Vp). However, the transmission state is held by the state memory characteristic of FLC. At this point, the influence of an external electric field on internal ions is minimized.

In "shutdown 1", since electric charges are discharged from the capacitor Cs1 after pre-charge is carried out, the electric potential of the one transparent electrode 52 becomes 0. At this point, since the voltage Vp is applied to the other transparent electrode 54 from the power source 55, a voltage of −Vp (0−Vp) is applied between the pair of transparent electrodes 52, 54, that is, to both ends of the liquid crystal material 51, thus generating a shutdown state.

After that, the charging voltage Vchg is set at Vp and the nMOS transistor Q1 is switched to the ON state, thereby applying the voltage Vp to the one transparent electrode 52. Thus, the potential difference between both ends of the liquid crystal material 51 becomes 0 (Vp−Vp). However, the shutdown state is held by the state memory characteristic of FLC.

In "shutdown 2", similar to "shutdown 1", since electric charges are discharged from the capacitor Cs1 after pre-charge is carried out, the electric potential of the one transparent electrode 52 becomes 0. At this point, since the voltage Vp is applied to the other transparent electrode 54 from the power source 55, a voltage of −Vp (0−Vp) is applied between the pair of transparent electrodes 52, 54, that is, to both ends of the liquid crystal material 51, thus generating a shutdown state.

In this "shutdown 2", the nMOS transistor Q2 is switched to the OFF state after the lapse of the time period τ2'. If there is no inflow of electric charges from the output side, as in this example, the nMOS transistor Q2 may be switched to the OFF state after the lapse of the time period τ2' necessary for discharge from the capacitor Cs1.

Also, when "shutdown 2" starts, the voltage of the electric potential (V1−Vp) necessary for pre-charge is applied to both ends of the liquid crystal material 51. However, if the time period during which this voltage is applied is sufficiently short (approximately 1/10 or less) with respect to the response speed (generally, several hundred microseconds) of FLC, there is no problem in operation of the spatial light modulating element 50.

After that, the charging voltage Vchg is set at Vp and the nMOS transistor Q1 is switched to the ON state, thereby applying the voltage Vp to the one transparent electrode 52. Thus, the potential difference between both ends of the liquid crystal material 51 becomes 0 (Vp−Vp). However, the shutdown state is held by the state memory characteristic of FLC.

In this "shutdown 2", in order to enhance the driving capability, the nMOS transistor Q1 is held in the ON state after the charging voltage Vchg is set at Vp, thus continuing application of the voltage Vp to the one transparent electrode 52.

In "transmission 2", similar to "transmission 1", the voltage V1 is applied to the one transparent electrode 52 by the pre-charge driving method. At this point, since the voltage Vp smaller than the voltage V1 is applied to the other transparent electrode 54 by the power source 55, the positive voltage of V1−Vp is applied between the pair of transparent electrodes 52, 54, that is, to both ends of the liquid crystal material 51, thus generating a transmission state.

After that, the charging voltage Vchg is set at Vp and the nMOS transistor Q1 is switched to the ON state, thereby applying the voltage Vp to the one transparent electrode 52. Thus, the potential difference between both ends of the liquid crystal material 51 becomes 0 (Vp−Vp). However, the transmission state is held by the state memory characteristic of FLC.

In the above description, the spatial light modulating element 50 is employed in which the polarizer and the analyzer are so arranged that their directions of polarization are orthogonal to each other. However, in the case where the polarizer and the analyzer are so arranged that the direction of polarization of the polarizer and the direction of polarization of the analyzer are in parallel to each other, shutdown and transmission are inverted as a matter of course.

2-4-3. Spontaneous Polarization Ps of FLC and Pre-Charge Driving Method

The value at which the charging voltage should be set, in the case where the spatial light modulating element using FLC is driven by the pre-charge driving method, will now be described.

As described above, in order to change the state of molecules of FLC, the direction of spontaneous polarization Ps of FLC must be inverted. To invert the direction of spontaneous polarization Ps of FLC, it is necessary to hold, throughout the inversion period, an electric field not smaller than a threshold electric field for inverting the direction of spontaneous polarization Ps of FLC, and supply electric charges of a quantity not less than twice the quantity of polarized electric charges, during the inversion period.

That is, to invert the direction of spontaneous polarization Ps of FLC, the electric field not smaller than the threshold electric field must be held during a period necessary for supplying electric charges corresponding to a double of spontaneous polarization Ps.

Thus, the charging voltage Vchg may be set at V1' which satisfies the following equation (2).

$$Vth \leqq Vp' \leqq V1' - (Vth + \Delta V) \quad (2)$$

In this equation, Vth represents the value of an applied voltage which generates the threshold electric field for inverting the direction of spontaneous polarization Ps of FLC. Vp' represents the value of a voltage applied to a counter-electrode and is defined to satisfy Vp'≧Vth, as in the equation (2). ΔV represents the value of a voltage drop due to spontaneous polarization Ps of FLC and is expressed by ΔV=2×Ps/Cs.

Figure 21:
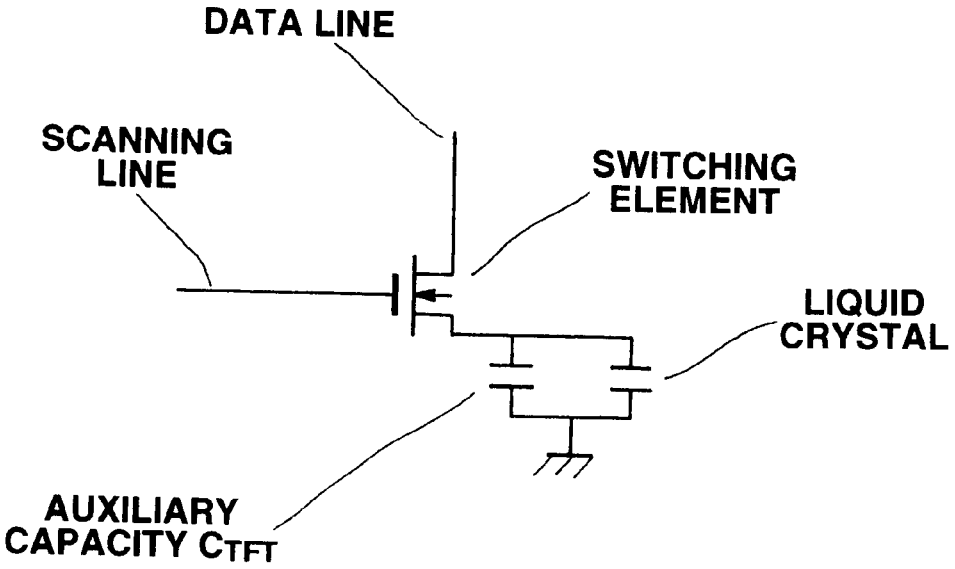
FIG. 21 is a circuit diagram of a driving section of a liquid crystal display of active matrix type.

Actually, in addition to these values, V1' and Vp' are set by using ΔV and Vth in consideration of leakage charges in other circuits and the voltage drop. Particularly, ΔV must be considered in the case where electric charges accumulated in the capacitor might flow into a load circuit, if any, even when the spatial light modulating element using TN liquid crystal or STN liquid crystal is employed. For example, in the above-described active matrix type liquid crystal display, an auxiliary capacity CTFT is connected in parallel to the liquid crystal as shown in FIG. 21, and therefore, the charging voltage and the voltage to be applied to the counter-electrode must be set in consideration that electric charges flow through this auxiliary capacity CTFT.

Figure 22:
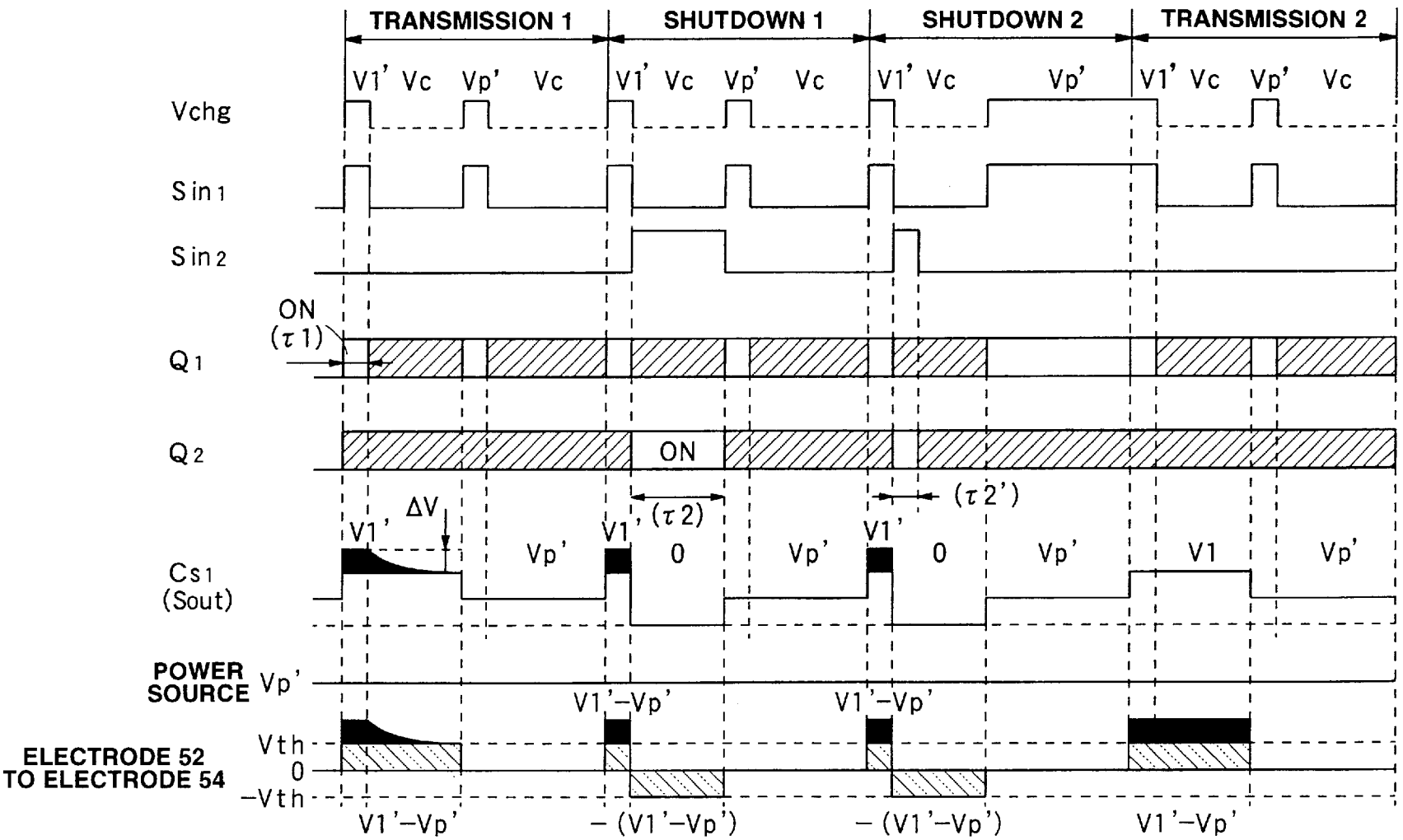
FIG. 22 is a waveform diagram showing operation of the spatial light modulating element in the case where a voltage drop due to spontaneous polarization Ps of FLC is considered.

Referring to FIG. 22, operation of the spatial light modulating element 50 in consideration of the voltage drop due to spontaneous polarization Ps of FLC will now be described.

In "transmission 1", a voltage V1' is applied to the one transparent electrode 52 by the pre-charge driving method. At this point, since a voltage Vp' is applied to the other transparent electrode 54 by the power source 55, a voltage of V1'−Vp' is applied between the pair of transparent electrodes 52, 54, that is, to both ends of the liquid crystal material 51. V1' and Vp' are pre-set at such values that V1'−Vp' holds the voltage Vth which generates an electric field not smaller than the threshold electric field throughout the period necessary for inverting the direction of spontaneous polarization Ps of FLC. Thus, the direction of spontaneous polarization Ps of FLC is inverted and a transmission state is generated. In the state where the nMOS transistor Q1 is set in the OFF state after the end of the pre-charge period, an arbitrary electric potential (Vc) may be used since the charging voltage Vchg does not contribute to driving.

After that, the charging voltage Vchg is set at Vp' and the nMOS transistor Q1 is switched to the ON state, thereby applying the voltage Vp' to the one transparent electrode 52. Thus, the potential difference between both ends of the liquid crystal material 51 becomes 0 (Vp'−Vp'). However, the transmission state is held by the state memory characteristic of FLC. At this point, the influence of an external electric field on internal ions is minimized.

In "shutdown 1", since electric charges are discharged from the capacitor Cs1 after pre-charge is carried out, the electric potential of the one transparent electrode 52 becomes 0. At this point, since the voltage Vp' is applied to the other transparent electrode 54 from the power source 55, a voltage of −Vp' (0−Vp') is applied between the pair of transparent electrodes 52, 54, that is, to both ends of the liquid crystal material 51. Vp' is pre-set at such a value that −Vp' holds the voltage Vth which generates an electric field not smaller than the threshold electric field throughout the period necessary for inverting the direction of spontaneous polarization Ps of FLC. Thus, the direction of spontaneous polarization Ps of FLC is inverted and a shutdown state is generated.

After that, the charging voltage Vchg is set at Vp' and the nMOS transistor Q1 is switched to the ON state, thereby applying the voltage Vp' to the one transparent electrode 52. Thus, the potential difference between both ends of the liquid crystal material 51 becomes 0 (Vp'−Vp'). However, the shutdown state is held by the state memory characteristic of FLC.

In "shutdown 2", similar to "shutdown 1", since electric charges are discharged from the capacitor Cs1 after pre-charge is carried out, the electric potential of the one transparent electrode 52 becomes 0. At this point, since the voltage Vp' is applied to the other transparent electrode 54 from the power source 55, a voltage of −Vp' (0−Vp') is applied between the pair of transparent electrodes 52, 54, that is, to both ends of the liquid crystal material 51, thus generating a shutdown state.

In this "shutdown 2", the nMOS transistor Q2 is switched to the OFF state after the lapse of the time period τ2'. If there is no inflow of electric charges from the output side, as in this example, the nMOS transistor Q2 may be switched to the OFF state after the lapse of the time period τ2' necessary for discharge from the capacitor Cs1.

Also, when "shutdown 2" starts, the voltage of the electric potential (V1'−Vp') necessary for pre-charge is applied to both ends of the liquid crystal material 51. However, if the time period during which this voltage is applied is sufficiently short (approximately 1/10 or less) with respect to the response speed (generally, several hundred microseconds) of FLC, there is no problem in operation of the spatial light modulating element 50.

After that, the charging voltage Vchg is set at Vp' and the nMOS transistor Q1 is switched to the ON state, thereby applying the voltage Vp' to the one transparent electrode 52. Thus, the potential difference between both ends of the liquid crystal material 51 becomes 0 (Vp'−Vp'). However, the shutdown state is held by the state memory characteristic of FLC.

In this "shutdown 2", in order to enhance the driving capability, the nMOS transistor Q1 is held in the ON state after the charging voltage Vchg is set at Vp', thus continuing application of the voltage Vp' to the one transparent electrode 52.

In "transmission 2", similar to "transmission 1", the voltage V1' is applied to the one transparent electrode 52 by the pre-charge driving method. At this point, since the voltage Vp' is applied to the other transparent electrode 54 by the power source 55, the voltage of V1'−Vp' is applied between the pair of transparent electrodes 52, 54, that is, to both ends of the liquid crystal material 51. V1' and Vp' are pre-set at such values that V1'−Vp' holds the voltage Vth which generates an electric field not smaller than the threshold electric field throughout the period necessary for inverting the direction of spontaneous polarization Ps of FLC. Thus, the direction of spontaneous polarization Ps of FLC is inverted and a transmission state is generated.

After that, the charging voltage Vchg is set at Vp' and the nMOS transistor Q1 is switched to the ON state, thereby applying the voltage Vp' to the one transparent electrode 52. Thus, the potential difference between both ends of the liquid crystal material 51 becomes 0 (Vp'−Vp'). However, the transmission state is held by the state memory characteristic of FLC.

In the above description, the spatial light modulating element 50 is employed in which the polarizer and the analyzer are so arranged that their directions of polarization are orthogonal to each other. However, in the case where the polarizer and the analyzer are so arranged that the direction of polarization of the polarizer and the direction of polarization of the analyzer are in parallel to each other, shutdown and transmission are inverted as a matter of course.

2-5. Specific Scan Driving Method for Spatial Light Modulating Method

Specific scan driving methods for a spatial light modulating element will now be described. A scan driving method for a spatial light modulating element based on the point-sequential method and a scan driving method for a spatial light modulating element based on the line-sequential method are described hereinafter. A scan driving method for a spatial light modulating element based on the overall batched rewrite method will be described later.

The spatial light modulating element has a liquid crystal panel having a plurality of pixels, a scanning driver, and a data driver, as shown in FIGS. 23 to 26. In the spatial light modulating element, a scanning line is selected by the scanning driver and pixel data is written on the selected scanning line by the data driver. The scanning driver generally employs a shift register structure. As described above, writing of pixel data is sequentially carried out by each pixel in the case of the point-sequential method, or by each line in the case of the line-sequential method.

Figure 23:
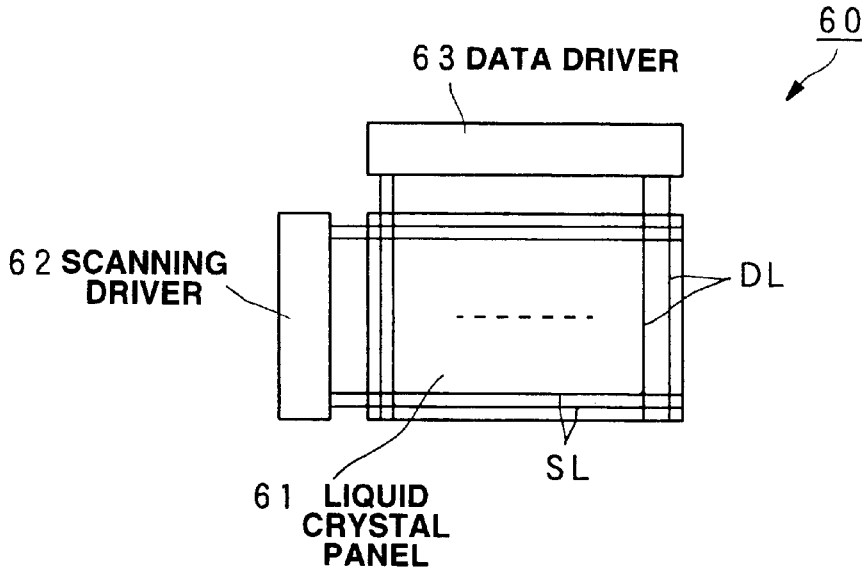
FIG. 23 is a view for explaining a scan driving method for the spatial light modulating element.

In a spatial light modulating element 60 shown in FIG. 23, a single scanning driver 62 connected to a plurality of pixels of a liquid crystal panel 61 through a plurality of scanning lines SL is arranged along one side of the liquid crystal panel 61, and a single data driver 63 connected to the plurality of pixels of the liquid crystal panel 61 through a plurality of data lines DL is arranged along one side orthogonal to the side of the liquid crystal panel 61 on which the scanning driver 62 is arranged.

In this spatial light modulating element 60, the data driver 63 writes pixel data from one direction onto the pixels on the scanning line SL selected by the scanning driver 62.

Figure 24:
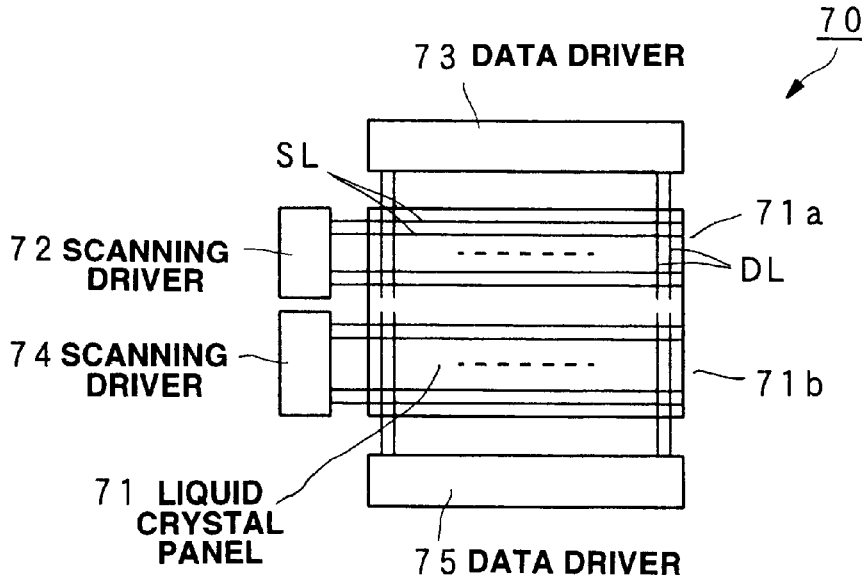
FIG. 24 is a view for explaining another scan driving method for the spatial light modulating element.

In a spatial light modulating element 70 shown in FIG. 24, a liquid crystal panel 71 is divided into two upper and lower panels. To individual pixels provided on the upper panel 71*a*, a first scanning driver 72 is connected through a plurality of scanning lines SL and a first data driver 73 is connected through a plurality of data lines DL. To individual pixels provided on the lower panel 71*b*, a second scanning driver 74 is connected through a plurality of scanning lines SL and a second data driver 75 is connected through a plurality of data lines DL.

In this spatial light modulating element 70, with respect to the upper panel 71*a*, the first data driver 73 writes pixel data onto the pixels on the scanning line SL selected by the first scanning driver 72, and with respect to the lower panel 71*b*, the second data driver 75 writes pixel data onto the pixels on the scanning line SL selected by the second scanning driver 74.

Figure 25:
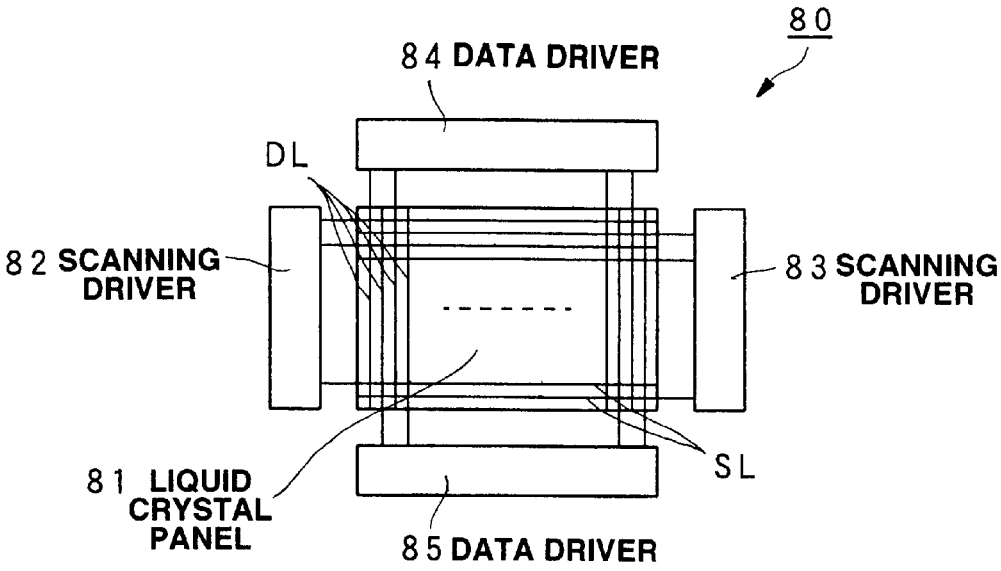
FIG. 25 is a view for explaining still another scan driving method for the spatial light modulating element.

In a spatial light modulating element 80 shown in FIG. 25, a first scanning driver 82 connected to a plurality of pixels of a liquid crystal panel 81 through a plurality of scanning lines SL is arranged along one side of the liquid crystal panel 81, and a second scanning driver 83 connected to a plurality of pixels of the liquid crystal panel 81 through a plurality of scanning lines SL is arranged along the side parallel to the side of the liquid crystal panel 81 on which the first scanning driver 82 is arranged. Also, in this spatial light modulating element 80, a first data driver 84 connected to a plurality of pixels of the liquid crystal panel 81 through a plurality of data lines DL is arranged along one side orthogonal to the side of the liquid crystal panel 81 on which the first scanning line driver 82 is arranged, and a second data driver 85 connected to a plurality of pixels of the liquid crystal panel 81 through a plurality of data lines DL is arranged along the side parallel to the side of the liquid crystal panel 81 on which the first data driver 84 is arranged.

In this spatial light modulating element 80, the first and second data drivers 84, 85 write pixel data from both directions onto the pixels on the scanning lines SL selected by the first and second scanning drivers 82, 83.

Figure 26:
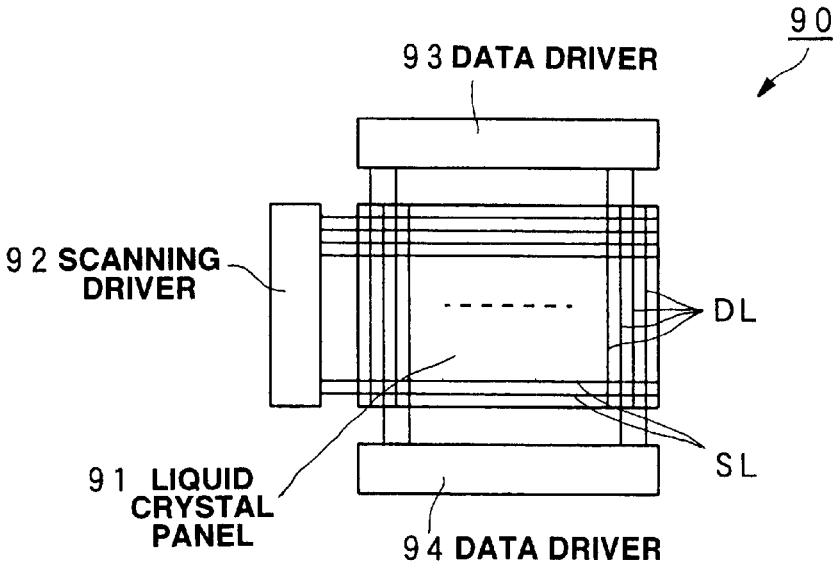
FIG. 26 is a view for explaining still another scan driving method for the spatial light modulating element.

In a spatial light modulating element 90 shown in FIG. 26, a single scanning driver 92 connected to a plurality of pixels of a liquid crystal panel 91 through a plurality of scanning lines SL is arranged along one side of the liquid crystal panel 91. Also, in this spatial light modulating element 90, a first data driver 93 connected to a plurality of pixels of the liquid crystal panel 91 through a plurality of data lines DL is arranged along one side orthogonal to the side of the liquid crystal panel 91 on which the first scanning line driver 92 is arranged, and a second data driver 94 connected to a plurality of pixels of the liquid crystal panel 91 through a plurality of data lines DL is arranged along the side parallel to the side of the liquid crystal panel 91 on which the first data driver 93 is arranged.

In this spatial light modulating element 90, the first and second data drivers 93, 94 write pixel data from both directions onto the pixels on the scanning line SL selected by the scanning drivers 92.

2-5-1. Structure of Data Driver in Case of Point-Sequential Method

A data driver of a spatial light modulating element driven by the point-sequential method will now be described in detail.

Figure 27:
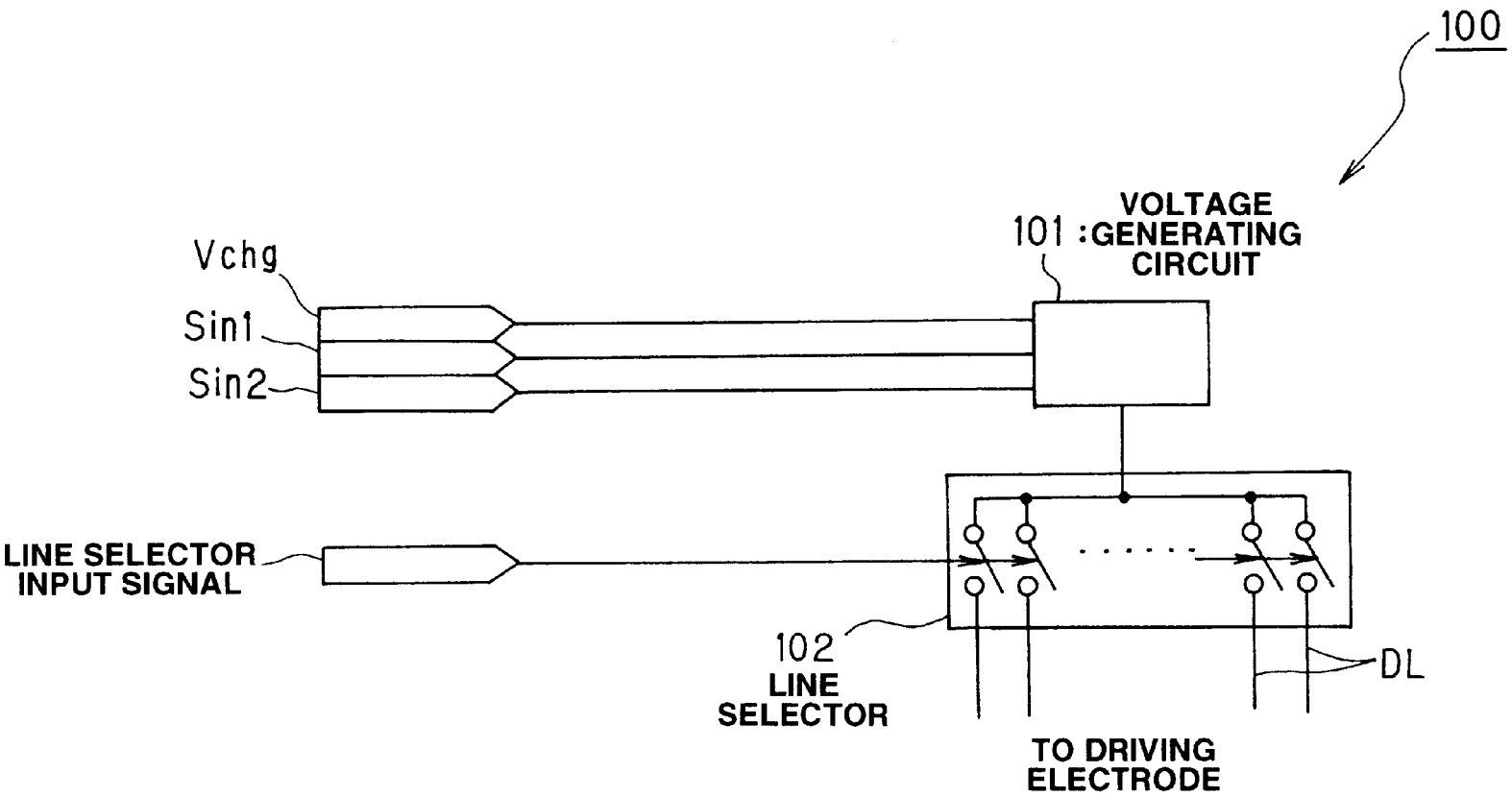
FIG. 27 is a schematic view showing an exemplary structure of a data driver provided in a spatial light modulating element driven by the point-sequential method.

FIG. 27 shows an exemplary structure of the data driver provided in the spatial light modulating element driven by the point-sequential method.

The data driver 100 shown in FIG. 27 has a voltage generating circuit 101 for outputting a signal corresponding to pixel data by the pre-charge driving method, and a line selector 102 for selecting, from among a plurality of data lines DL, a data line DL for supplying the signal from the voltage generating circuit 101.

In this data driver 100, the signal from the voltage generating circuit 101 is outputted to the data line DL selected by the line selector 102 in accordance with a line selector input signal. Thus, in the data driver 100, since the signal corresponding to pixel data is outputted to each data line DL from the single voltage generating circuit 101, there is little unevenness of the signals on the data lines DL and a simple structure may be employed.

Figure 28:
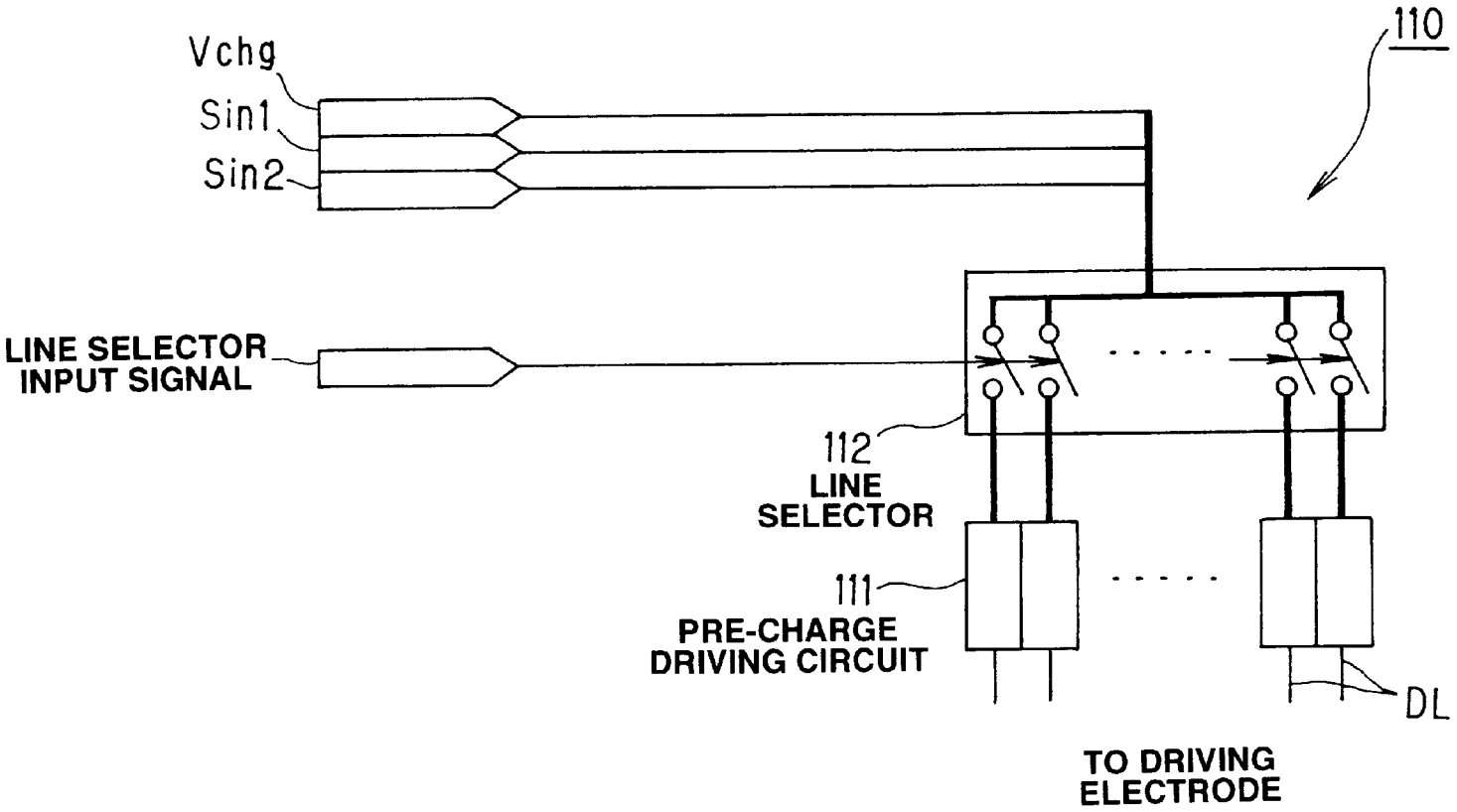
FIG. 28 is a schematic view showing another exemplary structure of the data driver provided in the spatial light modulating element driven by the point-sequential method.

FIG. 28 shows another exemplary structure of the data driver provided in the spatial light modulating element driven by the point-sequential method.

In the data driver 110 shown in FIG. 28, a voltage generating circuit 111 for outputting a signal corresponding to pixel data by the pre-charge driving method is connected to each data line DL. In this data driver 110, the voltage generating circuit 111 to which a charging voltage Vchg and input signals Sin1, Sin2 should be supplied is selected by a line selector 112.

In the data driver 110, the charging voltage Vchg and the input signals Sin1, Sin2 are supplied to the voltage generating circuit 111 selected by the line selector 112 in accordance with a line selector input signal. Then, the signal corresponding to pixel data is outputted to the data line DL connected to the selected voltage generating circuit 111.

2-5-2. Structure of Data Driver in Case of Line-Sequential Method

A data driver provided in a spatial light modulating element driven by the line-sequential method will now be described in detail.

Figure 29:
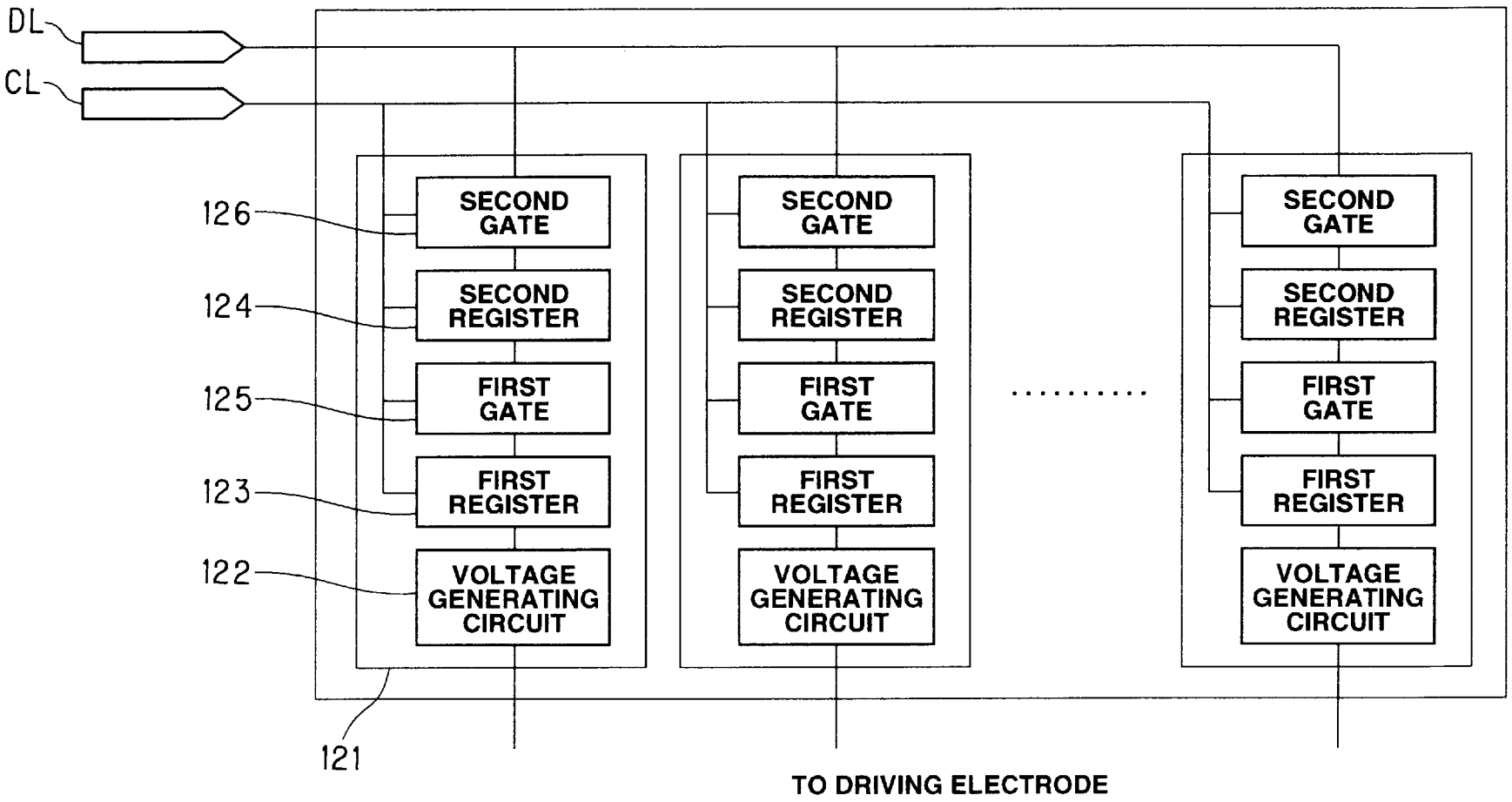
FIG. 29 is a schematic view showing an exemplary structure of a data driver provided in a spatial light modulating element driven by the line-sequential method.

FIG. 29 shows an exemplary structure of the data driver provided in the spatial light modulating element driven by the line-sequential method.

In the data driver 120 shown in FIG. 29, a driving cell 121 is provided for each pixel. The driving cell 121 includes a voltage generating circuit 122 for outputting a signal corresponding to pixel data by the pre-charge driving method, a first register 123 connected to the voltage generating circuit 122 and adapted fro holding the state of the voltage generating circuit 122, a second register 124 for holding the next data to be supplied to the voltage generating circuit 122, a first gate 125 connected between the first register 123 and the second register 124 and adapted for carrying out data transfer between the first and second registers 123 and 124, and a second gate 126 connected to the second register 124 and adapted for controlling input of pixel data supplied to the driving cell 121 through a data line DL.

The open/closed states of the first and second gates 125, 126 are controlled in accordance with a control signal from a control line CL. When the first gate 125 is set in the open state, data held by the second register 124 is transferred to the first register 123. When the second gate 126 is set in the open state, pixel data from the data line DL is supplied to the second register 124.

In this data driver 120, pixel data from the data line DL is supplied to the second register 124 through the second gate 126 and is held by the second register 124.

When data of one scanning line or one driving unit is held by the second register 124, the first gate 125 is set in the open state and the data held by the second register 124 is transferred to the first register 123 through the first gate 125.

In accordance with the data transferred to the first register 123, the voltage generating circuit 122 outputs a signal for driving each pixel by the pre-charge driving method. While the voltage generating circuit 122 outputs the signal for driving each pixel in accordance with the data transferred to the first register 123, the next data is supplied to the second register 124 through the second gate 126.

By operating as described above, the data driver 120 realizes line-sequential drive.

Figure 30:
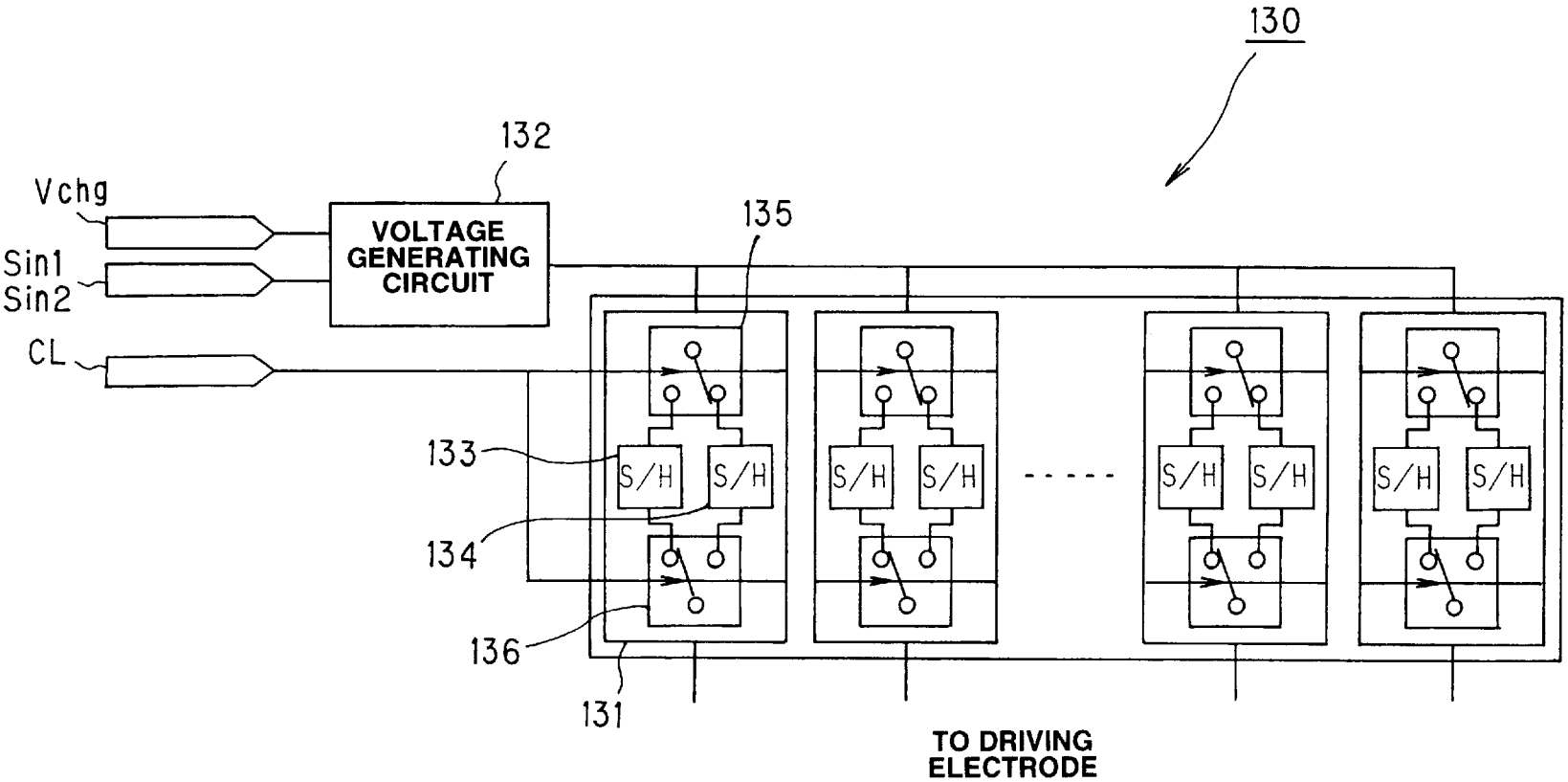
FIG. 30 is a schematic view showing another exemplary structure of the data driver provided in the spatial light modulating element driven by the line-sequential method.

FIG. 30 shows another exemplary structure of the data driver provided in the spatial light modulating element driven by the line-sequential method.

The data driver 130 shown in FIG. 30 has a driving cell 131 provided for each pixel and a single voltage generating circuit 132 connected to the respective driving cells 131.

The driving cell 131 includes first and second sample hold circuits 133, 134 for holding data from the voltage generating circuit 132, a first changeover switch 135 for switching the connection state between the voltage generating circuit 132 and the first and second sample hold circuits 133, 134, and a second changeover switch 136 for switching the connection state between the electrode of each pixel and the first and second sample hold circuits 133, 134.

The first changeover switch 135 switches the connection state between the voltage generating circuit 132 and the first and second sample hold circuits 133, 134 in accordance with a control signal from the control line CL. The second changeover switch 136 switches the connection state between the electrode of each pixel and the first and second sample hold circuits 133, 134 in accordance with a control signal from the control line CL.

In this data driver 130, for example, by setting the voltage generating circuit 132 and the first sample hold circuit 133 in the connection state and setting the voltage generating circuit 132 and the second sample hold circuit 134 in the non-connection state by the first changeover switch 135, data from the voltage generating circuit 132 is supplied to the first sample hold circuit 133. At this point, by setting the electrode of each pixel and the first sample hold circuit 133 in the non-connection state and setting the electrode of each pixel and the second sample hold circuit 134 in the connection state by the second changeover switch 136, the data from the voltage generating circuit 132 is held by the first sample hold circuit 133.

By turning the second changeover switch 136 at the time point when data of one scanning line or one driving unit is held by the first sample hold circuit 133, the data of one scanning line or one driving unit held by the first sample hold circuit 133 is supplied to the electrode of each pixel. At this point, by simultaneously turning the first changeover switch 135, the next data from the voltage generating circuit 132 is supplied to the second sample hold circuit 134 and is held by the second sample hold circuit 134.

By turning the second changeover switch 136 at the time point when data of one scanning line or one driving unit is held by the second sample hold circuit 134, the data of one scanning line or one driving unit held by the second sample hold circuit 134 is supplied to the electrode of each pixel. At this point, by simultaneously turning the first changeover switch 135, the next data from the voltage generating circuit 132 is supplied to the first sample hold circuit 133 and is held by the first sample hold circuit 133.

By operating as described above, the data driver 130 realizes line-sequential drive.

2-6. Spatial Light Modulating Element Driven by Overall Batched Rewrite Method

A spatial light modulating element driven by the overall batched rewrite method will now be described. The overall batched rewrite method is a method for providing a memory for each pixel, then taking data into each memory, and carry out batched data writing, as described above. This method enables appropriate driving even in the case where the number of pixels of the spatial light modulating element is increased.

Figure 31A:
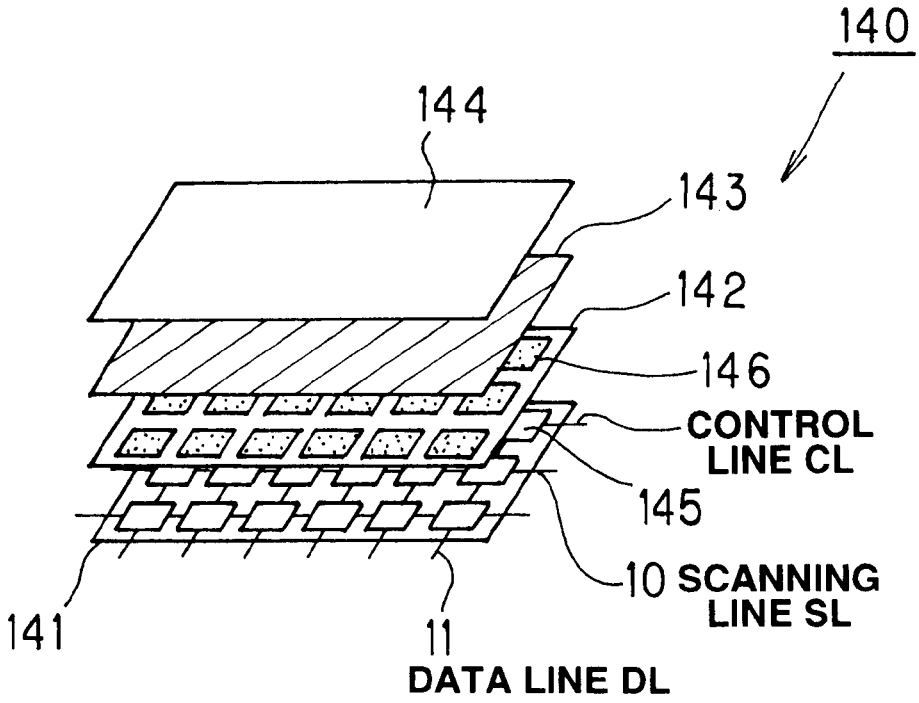
FIGS. 31A and 31B show the spatial light modulating element.
Figure 31B:
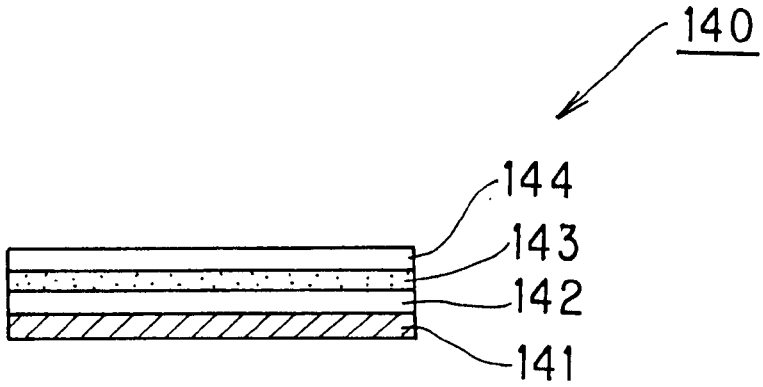

2-6-1. Structure of Spatial Light Modulating Element Driven by Overall Batched Rewrite Method FIG. 31A is an enlarged exploded perspective view showing the schematic structure of a part of a reflection type spatial light modulating element driven by the overall batched rewrite method. FIG. 31B is a cross-sectional view schematically showing a multilayer structure of this spatial light modulating element.

The spatial light modulating element 140 shown in FIGS. 31A and 31B has a driving layer 141, a reflection layer 142 arranged on the driving layer 141, a modulation layer 143 arranged on the reflection layer 142, and a transparent electrode 144 arranged on the modulation layer 143.

The driving layer 141 is a layer forming a pair of electrodes together with the transparent electrode 144. In this driving layer 141, a plurality of scanning lines SL, a plurality of data lines DL and a plurality of control lines CL are wired, and a driving circuit 145 is provided at each point of intersection between the scanning line SL and the data line DL. In the spatial light modulating element 140, an electric field can be applied to the modulation layer 143 by each driving circuit 154 provided in the driving layer 141, that is, by each pixel.

The reflection layer 142 is a layer for reflecting a light incident on the spatial light modulating element 140. In this layer, a reflection pad 146 made of a light reflective material having a high reflectivity such as aluminum is provided corresponding to each pixel. It suffices that this reflection layer 142 is constituted to reflect the light incident on the spatial light modulating element 140. For example, it may be so constituted as to reflect the light across the entire surface of the spatial light modulating element 140 without providing the reflection pad 146 for each pixel.

The modulation layer 143 is a layer for modulating the light incident on the spatial light modulating element 140, and is made of a liquid crystal material such as TN liquid crystal, STN liquid crystal or FLC, filled between the reflection layer 142 and the transparent electrode 144. In the spatial light modulating element 140, the optical transmittance can be controlled for each pixel by changing the state of the modulation layer 143 made of a liquid crystal material by an electric field applied between the driving layer 141 and the transparent electrode 144.

In the case where a material which needs orientation such as TN liquid crystal, STN liquid crystal or FLC is used for the modulation layer 143, a pair of orientation films are provided to sandwich the modulation layer 143.

In the spatial light modulating element 140 thus constituted, the light incident through the transparent electrode 144 is modulated by the modulation layer 143 and is then reflected by the reflection layer 142. The light reflected by the reflection layer 142 is modulated again by the modulation layer 143 and is then emitted as a reflected light from the spatial light modulating element 140. At this point, by controlling the electric field applied to the modulation layer 143 from the driving layer 141, the optical transmittance of the modulation layer 143 can be varied pixel by pixel.

In the spatial light modulating element 140, the driving circuit 145 of the driving layer 141 simultaneously applies the electric field to the modulation layer 143 to simultaneously drive the respective pixels, thus realizing overall batched rewrite.

Figure 32:
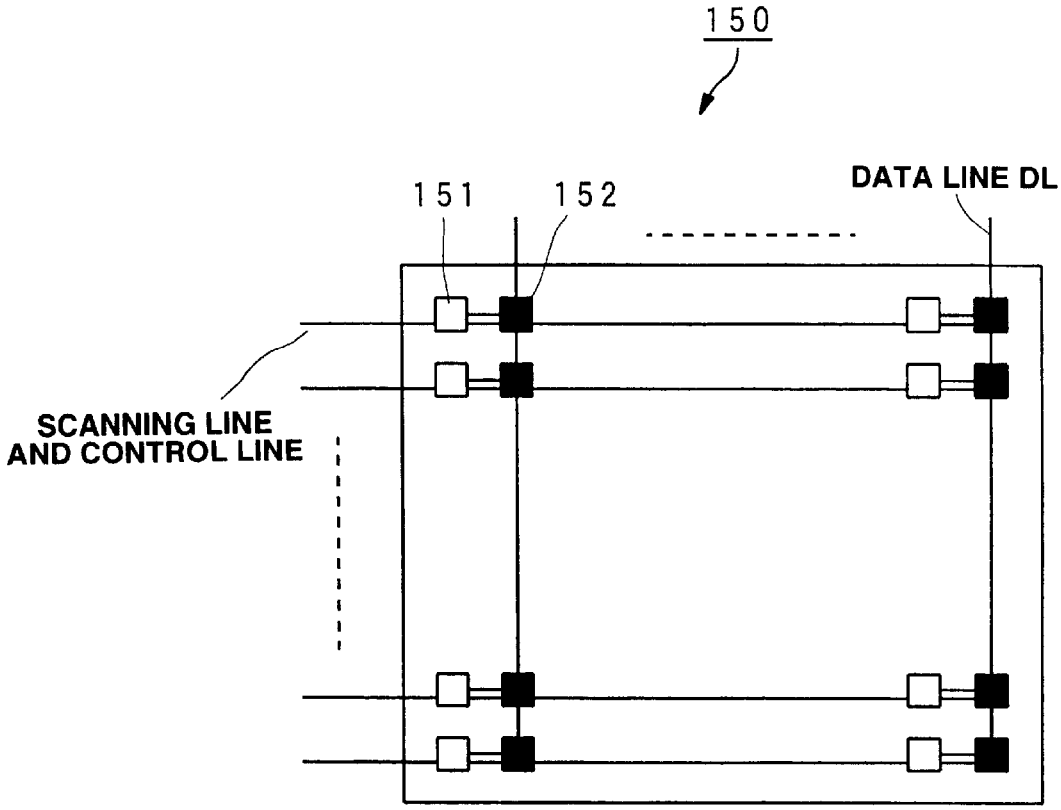
FIG. 32 is a schematic view for explaining the structure of a transmission type spatial light modulating element.

In the above description, the reflection type spatial light modulating element 140 is employed. However, a transmission type spatial light modulating element 150 can also be constituted by arranging a modulation section 151 for modulating a light and a driving circuit 152 for driving each pixel, in a planar form so that the modulation section 151 and the driving circuit 152 do not overlap each other, as shown in FIG. 32.

2-6-2. Structure of Driving Circuit of Spatial Light Modulating Element Having Voltage Generating Circuit In the following example, the above-described voltage generating circuit for outputting a signal by the pre-charge driving method is applied to a driving circuit of a spatial light modulating element driven by the overall batched rewrite method. This example will now be described in detail.

Figure 33:
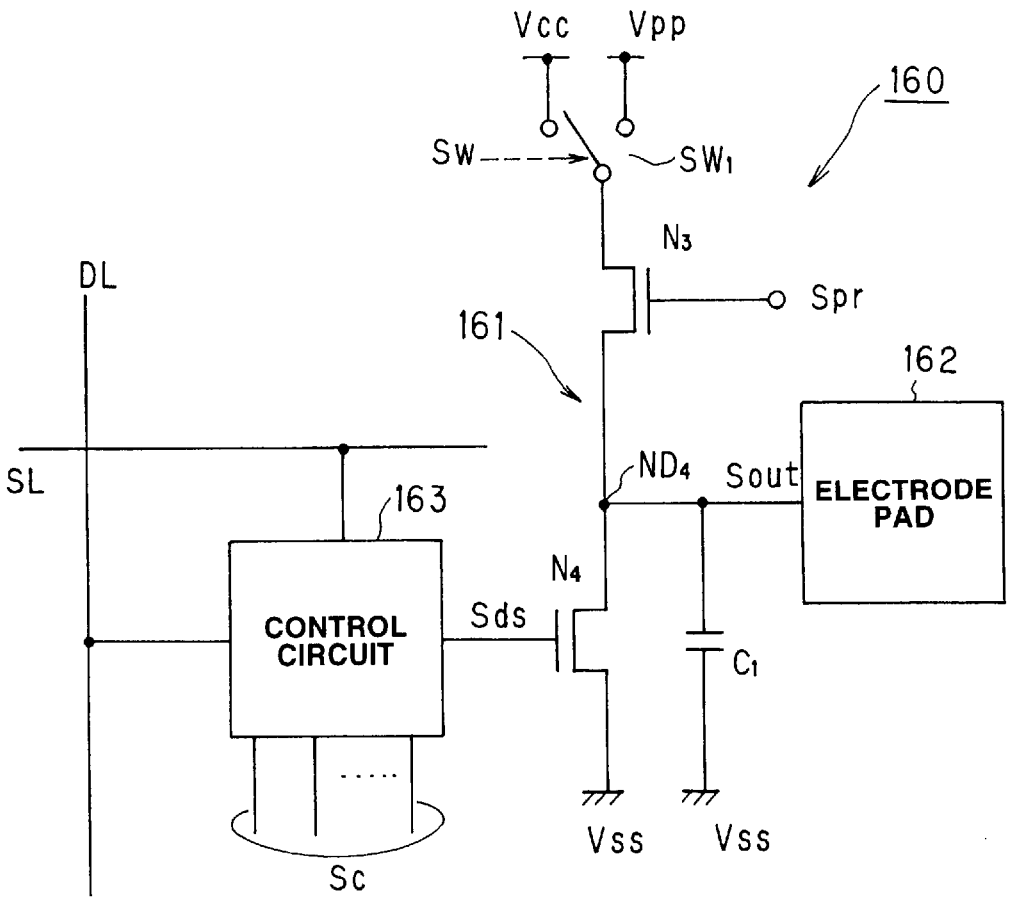
FIG. 33 is a circuit diagram of a spatial light modulating element driven by an overall batched rewrite method.

FIG. 33 is a circuit diagram of the driving circuit to which the voltage generating circuit is applied. This driving circuit 160 includes a voltage generating circuit 161, an electrode PAD 162, and a control circuit 163.

The voltage generating circuit 161 is constituted by nMOS transistors N3, N4, a capacitor C1, and a switch SW1. The electrode PAD 162 is connected to an output node ND4 of the voltage generating circuit 161. The electrode PAD 162 is driven by an output voltage Sout of the voltage generating circuit 161.

In this voltage generating circuit 161, the nMOS transistor N3 forms first level setting means. The ON/OFF state of the nMOS transistor N3 is controlled in accordance with a pre-charge signal Spr as a first input signal. When the nMOS transistor N3 is set in the ON state, the capacitor C1 is charged to a first level by a voltage selected by the switch SW1.

Also, in the voltage generating circuit 161, the nMOS transistor N4 forms second level setting means. The ON/OFF state of the nMOS transistor N4 is controlled in accordance with a second input signal Sds generated by the control circuit 163. When the nMOS transistor N4 is set in the ON state, electric charges are discharged from the capacitor C1. The electric potential of the output node ND4 is lowered by the discharge and is set at a second level.

The control circuit 163 is connected to the gate of the nMOS transistor N4 of the voltage generating circuit 161. This control circuit 163 generates the second input signal Sds in accordance with the signal levels of a control signal on a scanning line SL, data on a data line DL and other control signals Sc. In accordance with the second input signal Sds generated by the control circuit 163, the ON/OFF state of the nMOS transistor N4 of the voltage generating circuit 161 is controlled.

As shown in FIG. 33, the control circuit 163 is connected to the scanning line SL and the data line DL, and receives other control signals Sc from outside. In accordance with these input signals, the control circuit 163 generates the signal Sds having a predetermined level, thus controlling the ON/OFF state of the nMOS transistor N4 of the voltage generating circuit 161.

The MOS transistor N3 of the voltage generating circuit 161 has its gate connected to an input terminal for the pre-charge signal Spr. Also, the nMOS transistor N3 has its drain connected to the switch SW1 and has its source connected to the output node ND4.

The nMOS transistor N4 has its drain connected to the output node ND4 and has its source connected to a common electric potential Vss.

The capacitor C1 is connected between the output node ND4 and the common electric potential Vss. The electrode PAD 162 is connected to the output node ND4 and is driven by the output signal Sout.

The switch SW1 is connected to either a power-supply voltage Vcc or a voltage Vpp. The switch SW1 selects either the power-supply voltage Vcc or the voltage Vpp in accordance with a control signal Sw. The voltage selected by the switch SW1 becomes the charging voltage of the capacitor C1.

2-6-3. Operation of Driving Circuit of Spatial Light Modulating Element Having Voltage Generating Circuit Referring to FIG. 33, operation of this driving circuit will now be described.

In accordance with the external control signal Sw, the switch SW1 selects a predetermined voltage. The selected voltage is applied to the drain of the nMOS transistor N3.

At this point, first, the pre-charge signal Spr is held at a high level, for example, at the power-supply voltage Vcc. Thus, the nMOS transistor N3 is held in the ON state and the voltage selected by the switch SW1 is applied to the output node ND4, thus charging the capacitor C1. As the ON state of the nMOS transistor N3 is held for a predetermined time period, the capacitor C1 is charged to a voltage V1 selected by the switch SW1. Then, the nMOS transistor N3 is switched to the OFF state and the electric potential V1 of the output node ND4 is held by the capacitor C1.

Next, when the signal Sds of a high level is outputted by the control circuit 163, the nMOS transistor N4 is held in the ON state. Therefore, electric charges are discharged from the capacitor C1 and the electric potential of the output node ND4 is lowered by this discharge. As the control circuit 163 controls the time period during which the nMOS transistor N4 is held in the ON state, the electric potential of the output node ND4 can be set at a predetermined level. The output signal Sout from the output node ND4 is applied to the electrode PAD 162 as a driving voltage.

In the voltage generating circuit 161, both the transistor for charging electric charges to the capacitor C1 and the transistor for discharging electric charges from the capacitor C1 are constituted by the nMOS transistors. However, this invention is not limited to this structure. For example, both of the transistors for charge and discharge may be constituted by pMOS transistors. In addition, the transistors are not limited to MOS transistors, and for example, bipolar transistors may also be used to control charge and discharge of the capacitor C1.

In this voltage generating circuit 161, the capacitor C1 is adapted for stably holding the electric potential of the output node ND4. However, in the case where there is little possibility of potential fluctuation, the capacitor C1 may be constituted by a parasitic capacity existing between the output node ND4 and the common electric potential Vss, the power-supply voltage Vcc, or the voltage Vpp. Also, a resistor or a transistor having a high impedance may be connected between the output node ND4 and the power-supply voltage Vcc or the voltage Vpp so as to hold the electric potential of the output node ND4.

2-6-4. Structure of Control Circuit

The specific structure of the control circuit provided in this driving circuit will now be described.

Figure 34:
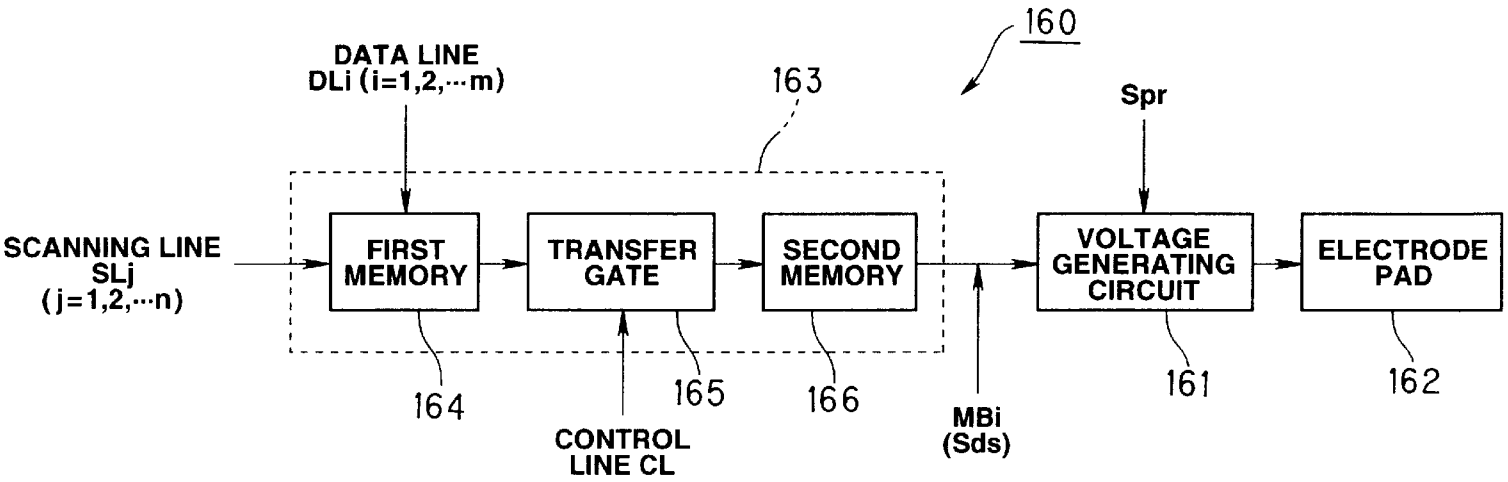
FIG. 34 is a block diagram showing an example of a driving circuit of the spatial light modulating element.

FIG. 34 is block diagram of the driving circuit 160 having the control circuit 163. As shown in FIG. 34, the control circuit 163 is constituted by a first memory 164, a transfer gate 165, and a second memory 166.

The first memory 164 is connected to a scanning line SLj (j=1, 2, . . . , n) and a data line DLi (i=1, 2, . . . , m). To the data line DLi, pixel data corresponding to an image signal is inputted. To the scanning line SLj, a control signal for controlling the ON/OFF state of a transistor provided in the first memory 164 is inputted.

The first memory 164 holds the pixel data from the data line DLi in accordance with the control signal from the scanning line SLj.

The transfer gate 165 is connected between the first memory 164 and the second memory 166. A control line CL is connected to the transfer gate 165. To the control line CL, a control signal for controlling the open/closed state of the transfer gate 165 is inputted.

The transfer gate 165 transfers the pixel data held by the first memory 164 to the second memory 166 in accordance with the control signal from the control line CL.

The second memory 166 holds the pixel data transferred from the first memory 164 through the transfer gate 165, and outputs a signal MBi corresponding to the pixel data to the voltage generating circuit 161. The signal MBi corresponds to the signal Sds for controlling the ON/OFF state of the nOS transistor N4 of the voltage generating circuit 161 shown in FIG. 33.

In the driving circuit 160, the discharge operation of the capacitor C1 of the voltage generating circuit 161 is controlled in accordance with the signal MBi from the control circuit 163. Thus, the voltage generating circuit 161 supplies the output signal Sout having an arbitrary level between the power-supply voltage and the common electric potential to the electrode PAD 162. That is, in the driving circuit 160, the electrode PAD 162 is driven by supplying a signal of a small amplitude which enables control of the ON/OFF state of the nMOS transistor N4, from the control circuit 163 to the voltage generating circuit 161.

2-6-5. Operation of Driving Circuit

Operation of the driving circuit having the control circuit as described above will now be described in detail.

The above-described driving circuit is arranged for each pixel, thus constituting a spatial light modulating element. Of a plurality of pixels arranged in a matrix, the pixels arranged in the same row are connected to one data line DLi, and pixel data is supplied thereto from the data line DLi. The pixels arranged in the same column are connected to one scanning line SLj, and the time for writing pixel data is controlled in accordance with the control signal applied to the scanning line SLj. Thus, at each pixel, the state of the modulation layer changes in accordance with the pixel data at predetermined timing.

Figure 35:
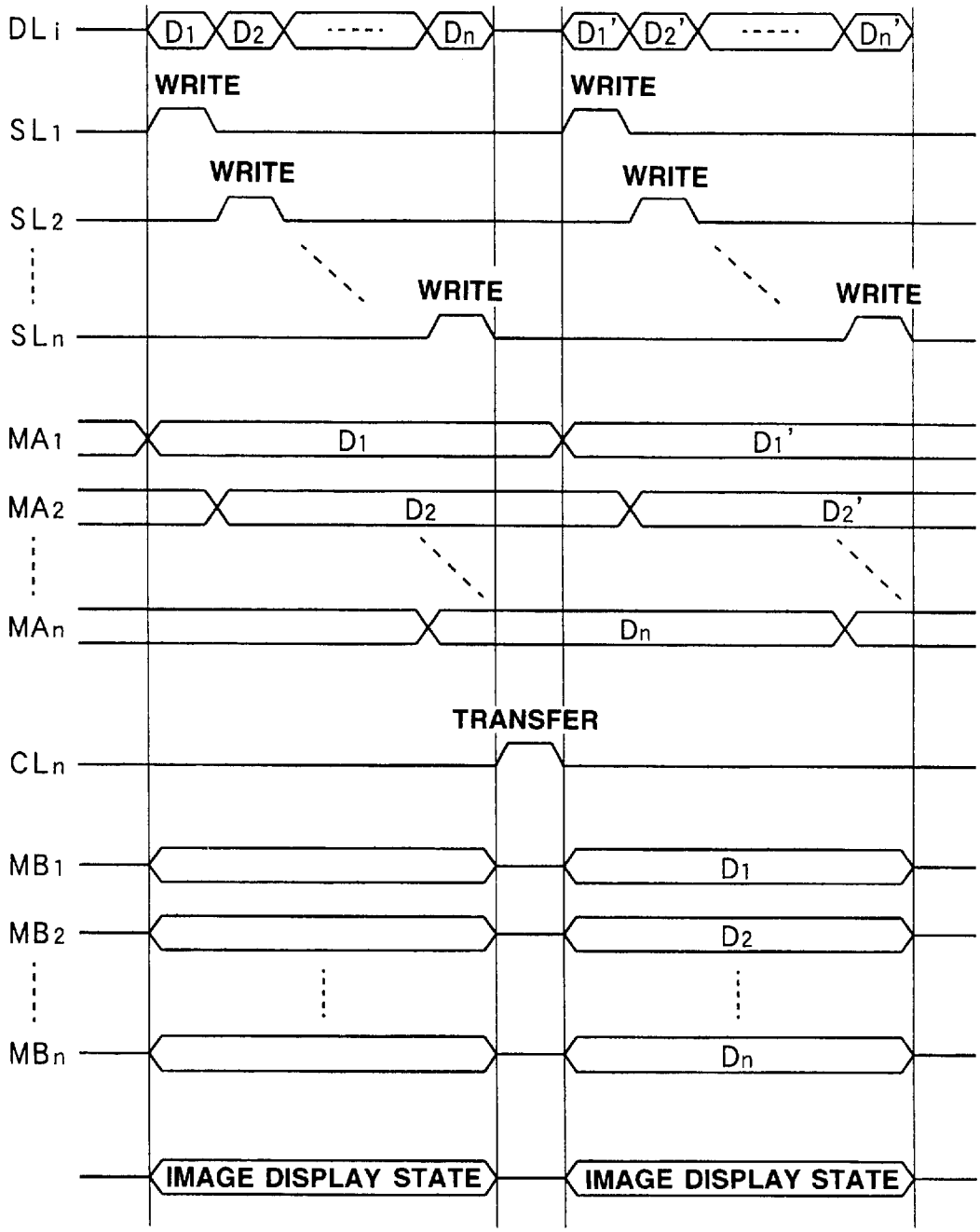
FIG. 35 is a waveform diagram showing an example of operation in driving the spatial light modulating element by the driving circuit.

FIG. 35 is a waveform diagram showing an example of operation in driving the spatial light modulating element by the above-described driving circuit. Referring to FIG. 35, the operation of this driving circuit will be described.

The waveform diagram of FIG. 35 shows only the operation of the driving circuit having the single data line DLi and n units of pixels connected thereto. In the actual spatial light modulating element, a plurality of data lines are wired in parallel, and different pixel data are inputted to the individual data lines, respectively. The pixels connected to the individual data lines are controlled in accordance with the inputted pixel data, and one complete image is displayed by the whole pixels. Thus, since substantially the same operation is carried out except that the pixel data inputted to the individual data lines are different, the operation of the driving circuit having pixels connected to the data line DLi is described here without lacking generalities.

As shown in FIG. 35, pixel data D1, D2, . . . , Dn are generated in accordance with an image signal to be displayed, and are applied to the data line DLi at predetermined timing. When the pixel data are determined, a control signal, for example, a pulse signal of a high level is applied to the scanning lines SL1, SL2, . . . , SLn. In accordance with this signal, the pixel data D1, D2, . . . , Dn on the data line DLi are held in the first memories, respectively, provided in the control circuits of the driving circuits provided for the individual pixels connected to the data line DLi. The operation for causing the first memory to hold the pixel data is referred to as write operation.

As shown in FIG. 35, when the first pixel data D1 is determined on the data line DLi, the pulse of the high level is applied to the scanning line SL1 and the pixel data D1 is written in the first memory of the first pixel. Thus, the first memory of the first pixel is ready to output a signal MA1 corresponding to the first pixel data D1.

Similarly, when the second pixel data D2 is determined on the data line DLi, the pulse of the high level is applied to the scanning line SL2 and the pixel data D2 is written in the first memory of the second pixel. Thus, the first memory of the second pixel is ready to output a signal MA2 corresponding to the second pixel data D2.

This operation is repeated up to the last pixel data Dn. As a result, the pixel data D1, D2, . . . , Dn are written in the first memories, respectively, of the individual pixels connected to the data line DLi. Thus, the first memories of the individual pixels are ready to output the signals MA1, MA2, . . . , MAn corresponding to the pixel data D1, D2, . . . , Dn, respectively.

After completion of the write operation of the pixel data D1, D2, . . . , Dn to the respective pixels, a pulse signal of the high level is applied to the control line CL, as shown in FIG. 35. In response to this signal, the transfer gates provided in the control circuits of the driving circuits of the respective pixels are held in the ON state for a period set by the pulse width. Thus, the signals MA1, MA2, . . . , MAn outputted from the first memories of the pixels are supplied to the second memories through the transfer gates. The pixel data held in the first memories are transferred to the second memories. This operation is referred to as transfer operation.

By this transfer operation, signals MB1, MB2, . . . , MBn corresponding to the written pixel data are outputted from the second memories of the respective pixels. In the second memories of the respective pixels, the pixel data previously transferred from the first memories are held until the transfer operation is carried out.

When the transfer operation is being carried out, that is, when the pulse signal of the high level is being applied to the control line CL, since the pixel data are not determined at the individual pixels, the image signal is likely to be disordered.

Therefore, during the transfer operation, the spatial light modulating element is set in the state where a light is not incident, that is, no image is displayed.

After the transfer operation of the driving circuits of the individual pixels is completed and the pixel data of the individual pixels are determined, the spatial light modulating element is set in the state where a light is incident, that is, the image display state.

2-6-6. Another Exemplary Structure of Control Circuit

Another exemplary structure of the control circuit of the driving circuit will now be described.

Figure 36:
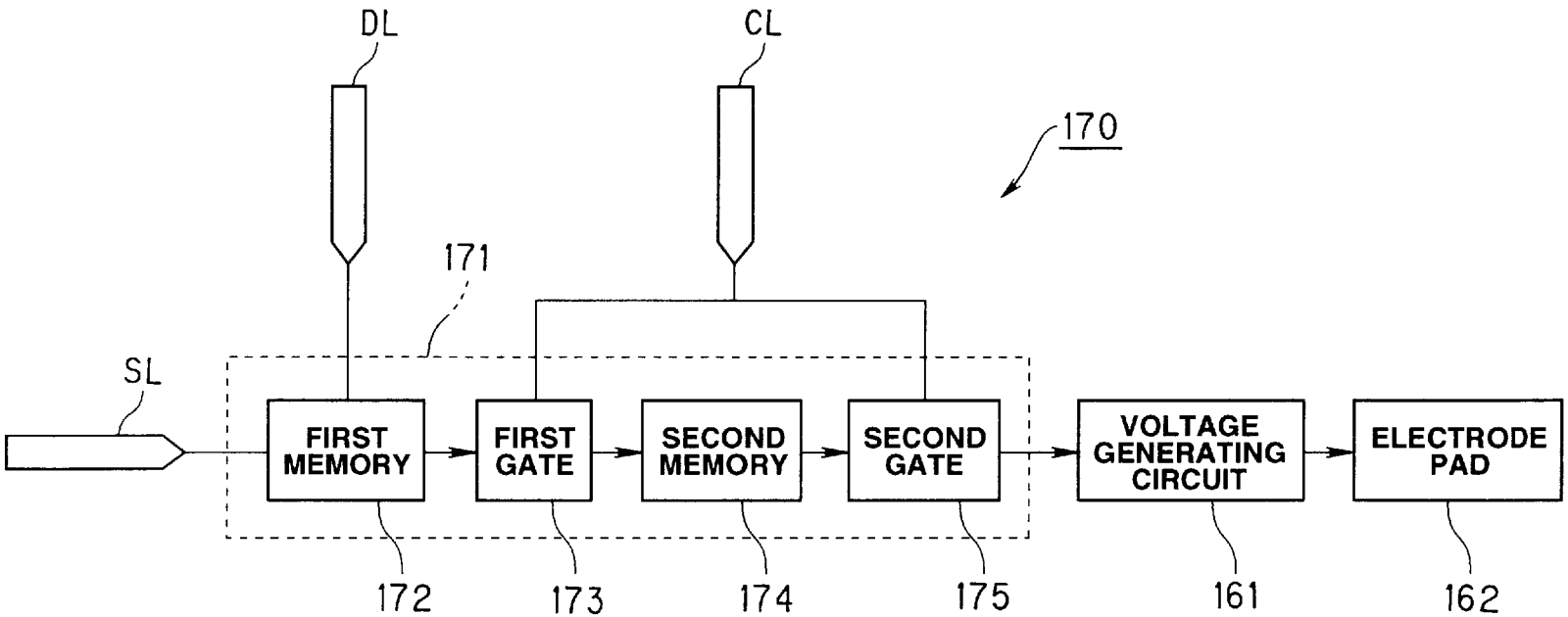
FIG. 36 is a block diagram showing another example of the driving circuit of the spatial light modulating element.
Figure 37:
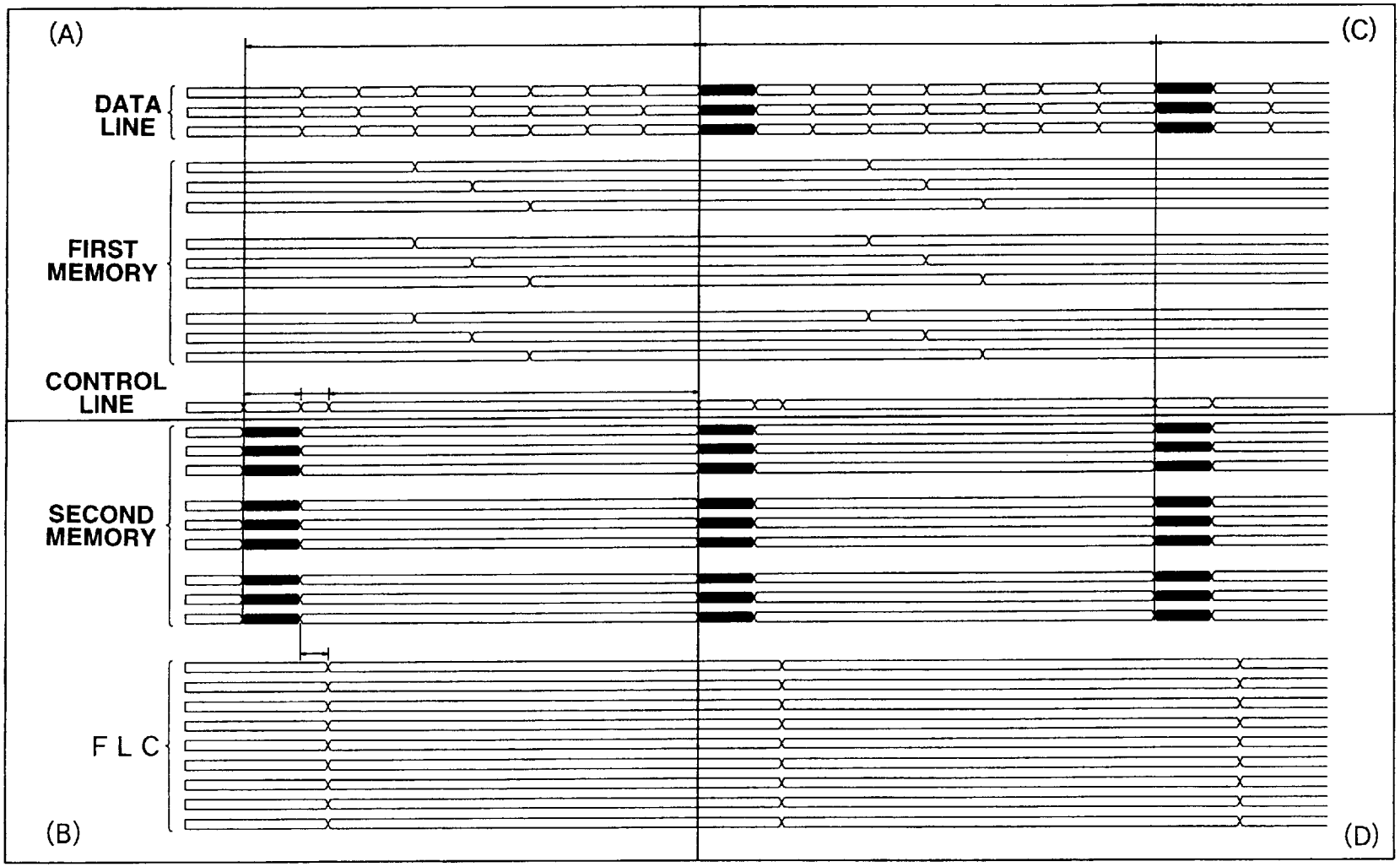
FIG. 37 is a timing chart for explaining operation of the spatial light modulating element having the driving circuit.

FIG. 36 is a block diagram of a driving circuit 170 having another control circuit 171. As shown in FIG. 36, the control circuit 171 is constituted by a first memory 172, a first gate 173, a second memory 174, and a second gate 175.

The first memory 172 is connected to a scanning line SL and a data line DL. To the data line DL, for example, pixel data corresponding to an image signal is inputted. To the scanning line SL, a control signal for controlling the ON/OFF state of a transistor of the first memory 172 is inputted.

The first memory 172 holds the pixel data from the data line DL in accordance with the control signal from the scanning line SL.

The first gate 173 is connected between the first memory 172 and the second memory 174. A control line CL is connected to the first gate 173. To the control line CL, a control signal for controlling the open/closed state of the first gate 173 is inputted.

The first gate 173 transfers the pixel data held by the first memory 172 to the second memory 174 in accordance with the control signal from the control line CL.

The second memory 174 holds the pixel data transferred from the first memory 172 through the first gate 173.

The second gate 175 is connected between the second memory 174 and the voltage generating circuit 161. A control line CL is connected to the second gate 175. To the control line CL, a control signal for controlling the open/closed state of the second gate 175 is inputted.

In this control circuit 171, the second gate 175 is set in the open state in response to the control signal from the control line CL, thereby outputting a signal corresponding to the pixel data held by the second memory 174 to the voltage generating circuit 161. The signal outputted from the second memory 174 to the voltage generating circuit 161 through the second gate 175 corresponds to the signal Sds for controlling the ON/OFF state of the nMOS transistor N4 of the voltage generating circuit 161 shown in FIG. 31.

In the driving circuit 170, similar to the driving circuit 160 shown in FIG. 32, the discharge operation of the capacitor of the voltage generating circuit 161 is controlled in accordance with the signal from the control circuit 171. Thus, the voltage generating circuit 161 supplies an output signal Sout having an arbitrary level between the power-supply voltage and the common electric potential to the electrode PAD 162. That is, in this driving circuit, the electrode PAD 162 is driven by supplying a signal of a small amplitude which enables control of the ON/OFF state of the nMOS transistor N4, from the control circuit 171 to the voltage generating circuit 161.

2-6-7. Operation of Driving Circuit

Operation of the driving circuit having the control circuit as described above will now be described in detail.

The above-described driving circuit is arranged for each pixel, thus constituting a spatial light modulating element. Of a plurality of pixels arranged in a matrix, the pixels arranged in the same row are connected to one data line DLi, and pixel data is supplied thereto from the data line DLi. The pixels arranged in the same column are connected to one scanning line SLj, and the time for writing pixel data is controlled in accordance with the control signal applied to the scanning line SLj. Thus, at each pixel, the state of the modulation layer changes in accordance with the pixel data at predetermined timing.

Figure 38:
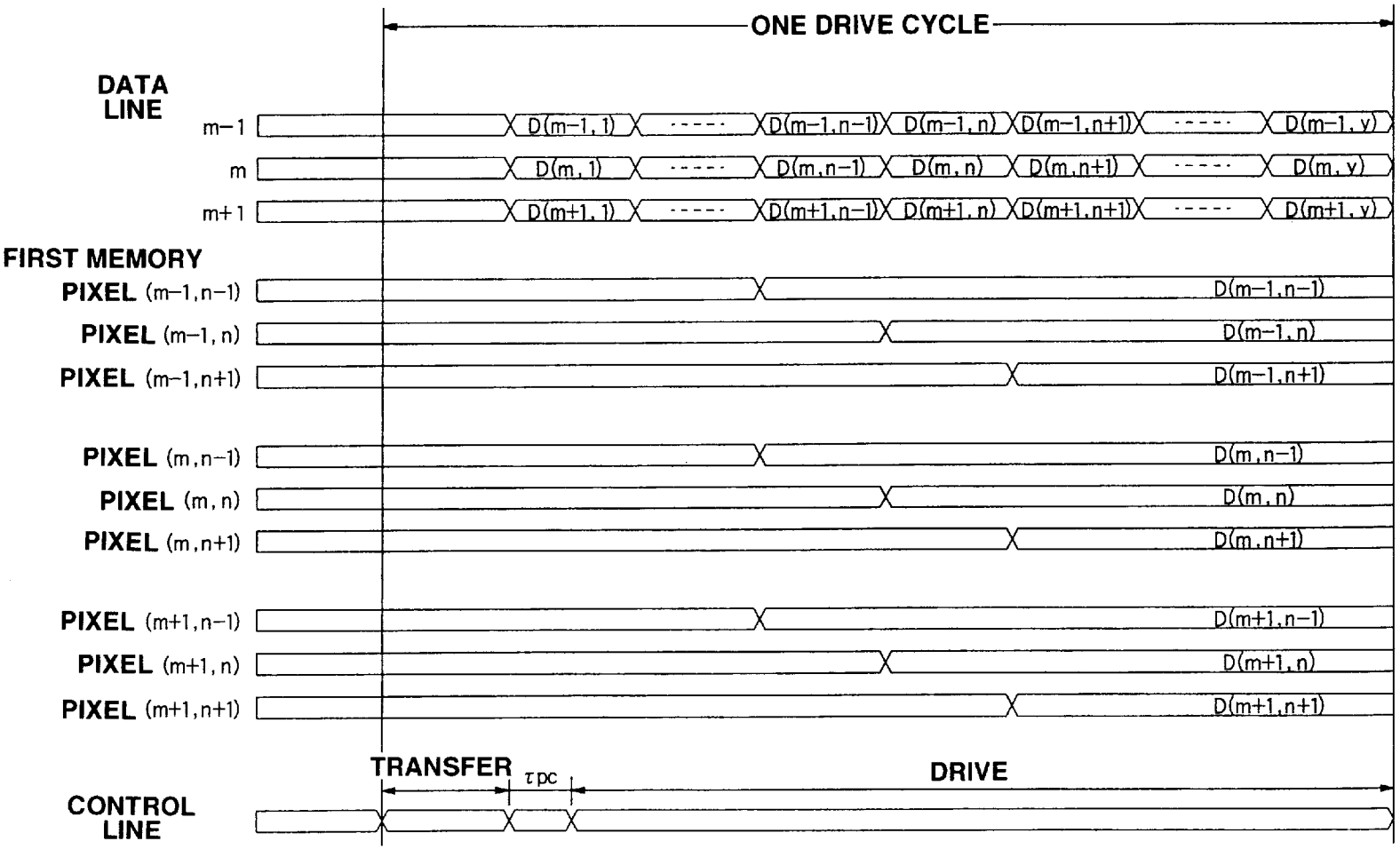
FIG. 38 is an enlarged view of section (A) in FIG. 37.
Figure 39:
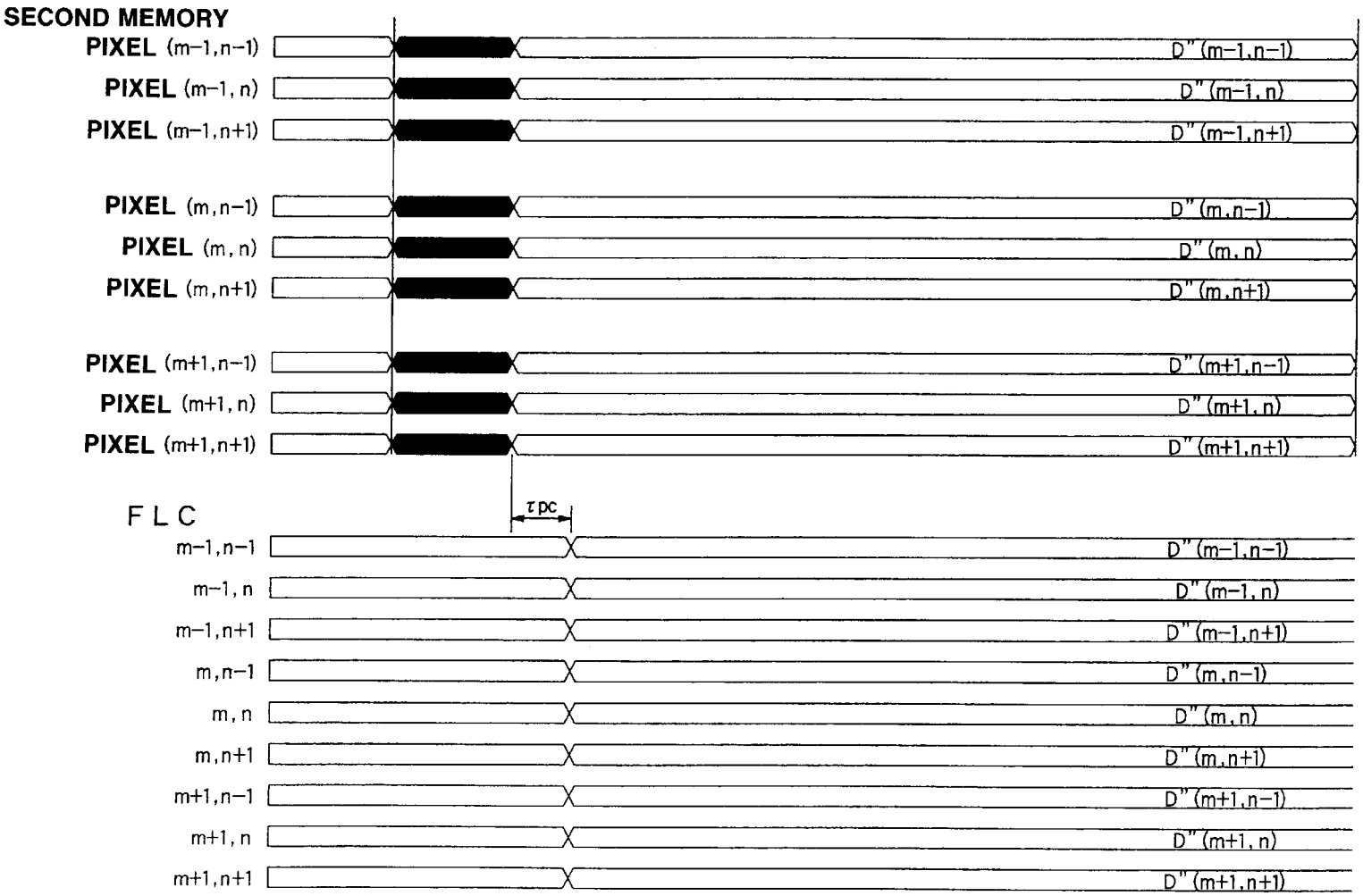
FIG. 39 is an enlarged view of section (B) in FIG. 37.
Figure 40:
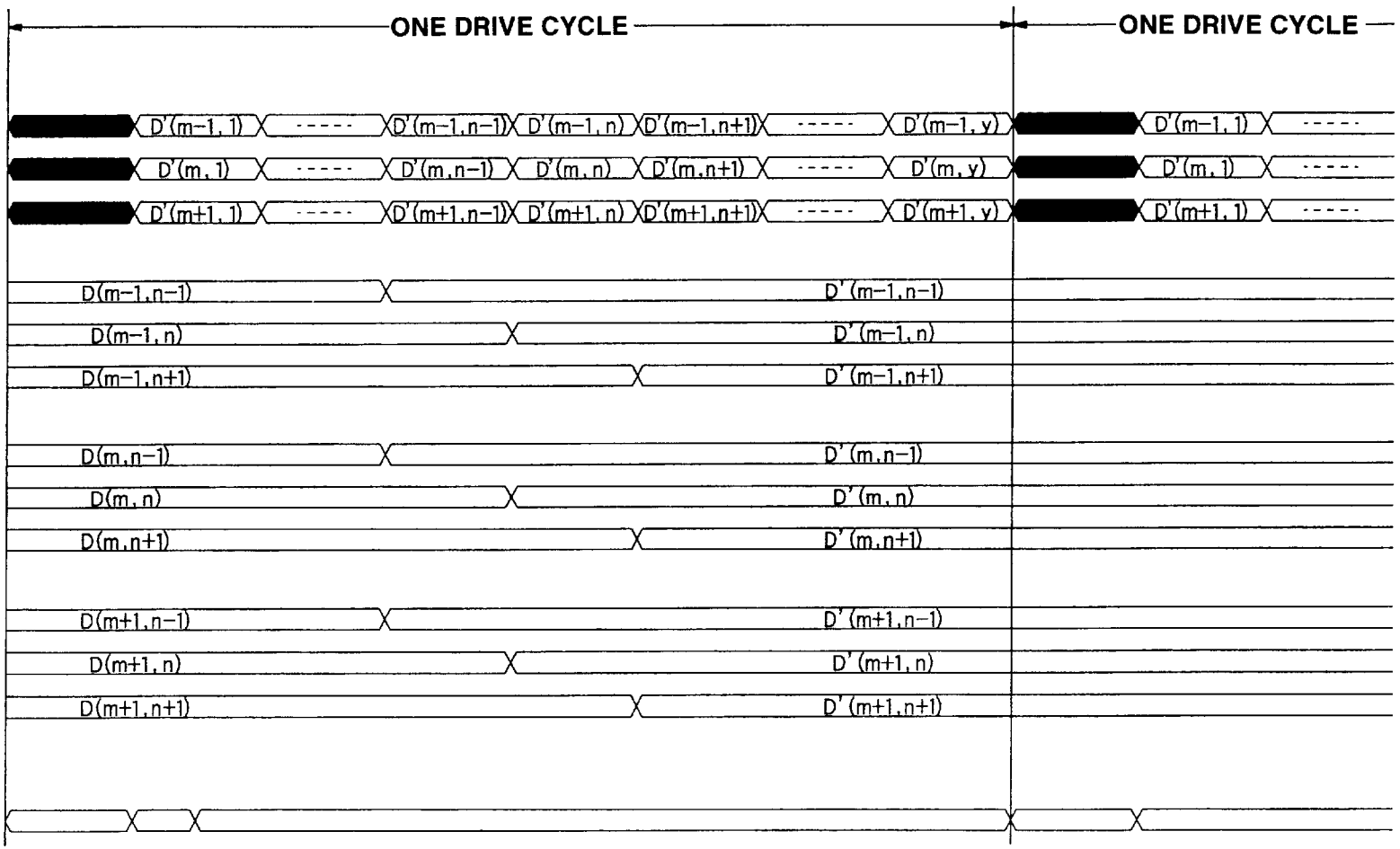
FIG. 40 is an enlarged view of section (C) in FIG. 37.
Figure 41:
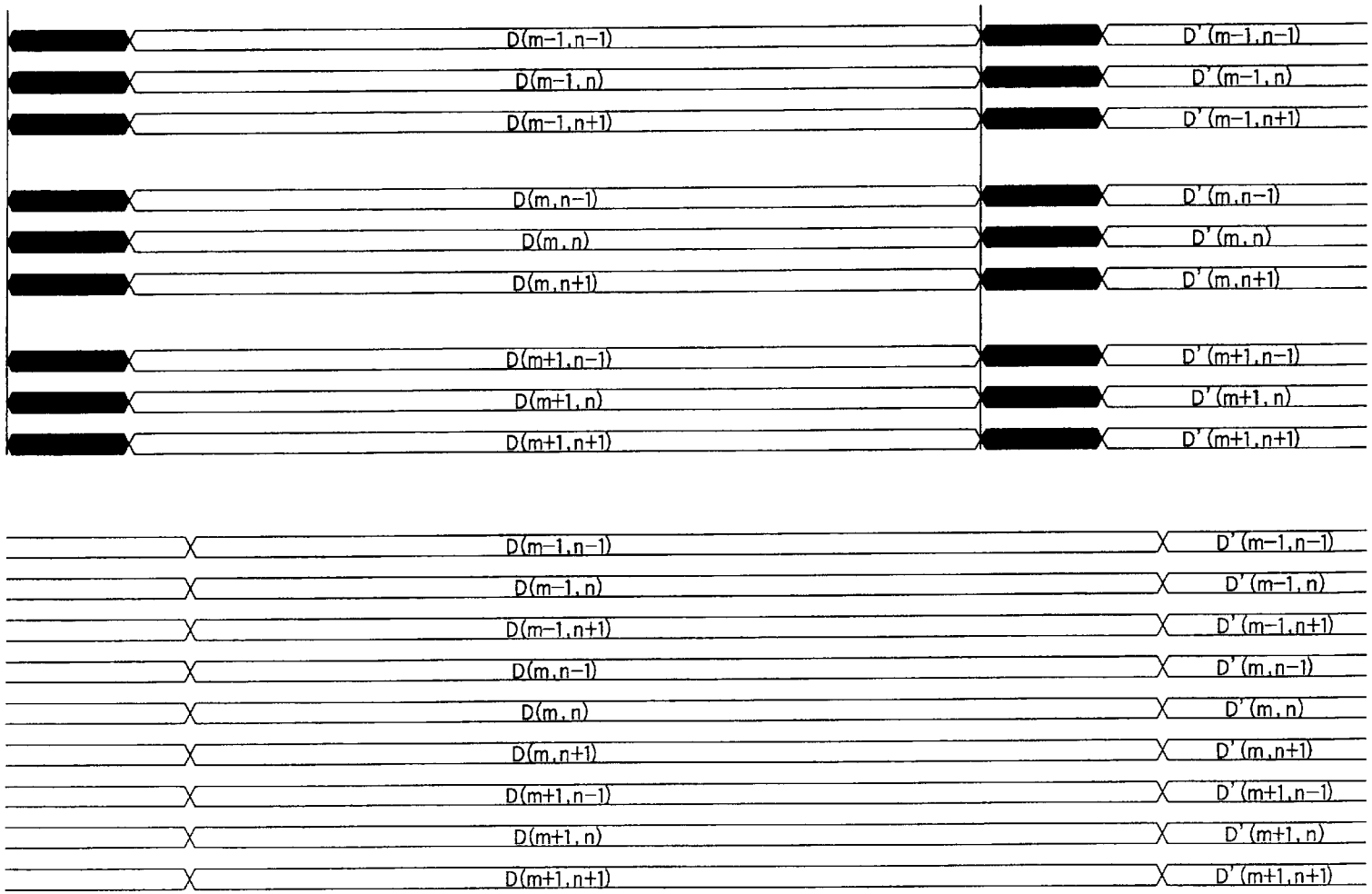
FIG. 41 is an enlarged view of section (D) in FIG. 37.

FIGS. 37 to 41 are driving timing charts of the spatial light modulating element constituted as described above. FIG. 38 is an enlarged view of section (A) in FIG. 37. FIG. 39 is an enlarged view of section (B) in FIG. 37. FIG. 40 is an enlarged view of section (C) in FIG. 37. FIG. 41 is an enlarged view of section (D) in FIG. 37. Referring to FIGS. 37 to 41, operation of the above-described driving circuit will now be described.

In the driving timing charts of FIGS. 37 to 41, only a pixel area near a data line m and a scanning line n, from among a plurality of pixels, is shown. By applying the same driving as in this pixel area to all the pixels, appropriate driving can be carried out.

In the general flow of driving in this driving circuit, first, pixel data is written in the first memory. Then, the pixel data is transferred from the first memory to the second memory. Finally, the individual pixels are driven in batched operation.

The driving by this driving circuit is hereinafter described in detail.

As shown in FIG. 38, pixel data D(m−1, 1), . . . , D(m−1, n−1), D(m−1, n), D(m−1, n+1), . . . , D(m−1, y) are generated in accordance with an image signal to be displayed, and are applied to a data line m−1 at predetermined timing. Similarly, pixel data D(m, 1), . . . , D(m, n−1), D(m, n), D(m, n+1), . . . , D(m, y) are generated in accordance with an image signal to be displayed, and are applied to a data line m at predetermined timing. Similarly, pixel data D(m+1, 1), . . . , D(m+1, n−1), D(m+1, n), D(m+1, n+1), . . . , D(m+1, y) are generated in accordance with an image signal to be displayed, and are applied to a data line m+1 at predetermined timing.

When the pixel data D(m−1, n−1), D(m−1, n), D(m−1, n+1) on the data line m−1 are determined, then the pixel data D(m, n−1), D(m, n), D(m, n+1) on the data line m are determined, and the pixel data D(m+1, n−1), D(m+1, n), D(m+1, n+1) on the data line m+1 are determined, a control signal such as a pulse signal of a high level is sequentially applied to the scanning lines n−1, n, and n+1.

Thus, the pixel data D(m−1, n−1) is written in the first memory of the pixel (m−1, n−1), and the pixel data D(m−1, n) is written in the first memory of the pixel (m−1, n) while the pixel data D(m−1, n+1) is written in the first memory of the pixel (m−1, n−1). Also, the pixel data D(m, n−1) is written in the first memory of the pixel (m, n−1), and the pixel data D(m, n) is written in the first memory of the pixel (m, n) while the pixel data D(m, n+1) is written in the first memory of the pixel (m, n+1). In addition, the pixel data D(m+1, n−1) is written in the first memory of the pixel (n+1, n+1), and the pixel data D(m+1, n) is written in the first memory of the pixel (m+1, n) while the pixel data D(m+1, n+1) is written in the first memory of the pixel (m+1, n+1).

By carrying out the above-described operation with respect to all the pixels, the pixel data is written from the data line to the first memory of each pixel.

When the pixel data from the data line is being written to the first memory of each pixel, the previous pixel data is held in the second memory of each pixel, as shown in FIG. 39. Then, the second gate of each pixel is set in the ON state in response to the control signal from the control line, and FLC is driven by the signal corresponding to the previous pixel data.

On completion of write operation of the pixel data to the first memory of each pixel, a pulse signal of the high level is applied to the control line CL, as shown in FIG. 40. In response to this pulse signal, the first gate of each pixel is held in the ON state for a period set by the pulse width. Thus, the pixel data held in the first memory of each pixel is transferred to the second memory through the first gate and is held by the second memory, as shown in FIG. 41.

On completion of transfer of the pixel data to the second memory of each pixel, the first gate is set in the OFF state in response to the control signal from the control line, as shown in FIG. 40.

After the lapse of a predetermined period τpc from when the first gate is set in the OFF state, the second gate of each pixel is set in the ON state in response to the control signal from the control line, and FLC of each pixel is driven in a batched manner by a signal corresponding to the pixel data held in the second memory, as shown in FIG. 41.

In the above example, the second gate is set in the ON state after the lapse of the predetermined period τpc from when the first gate is set in the OFF state. However, if the state transition can be ignored, τpc=0, that is, the second gate may be set in the ON state simultaneously with setting of the first gate in the OFF state. Also, the period τpc may be allocated to the pre-charge period of the voltage generating circuit.

When the first gate is set in the OFF state, pixel data corresponding to corresponding to the next image signal to be displayed are generated and applied to the data line at predetermined timing, as shown in FIG. 40. The pixel data applied to the data line are sequentially written in the first memory.

By repeating the above-described operation, FLC of each pixel is driven in accordance with the pixel data and sequentially changes its light modulation characteristic.

In the above example, the modulation layer driven by the driving circuit is made of FLC, and the spatial light modulating element having two levels for driving gradation is described. However, driving by the driving circuit of the similar structure can be carried out even in the case where other materials such as TN liquid crystal and STN liquid crystal are used for the modulation layer and where multi-levels are employed for driving gradation.

2-6-8. Spatial Light Modulating Circuit Driven by Driving Circuit

A spatial light modulating element having two memories in a control circuit as described above and having a driving circuit capable of driving by the overall batched rewrite method will now be described in detail.

Figure 42:
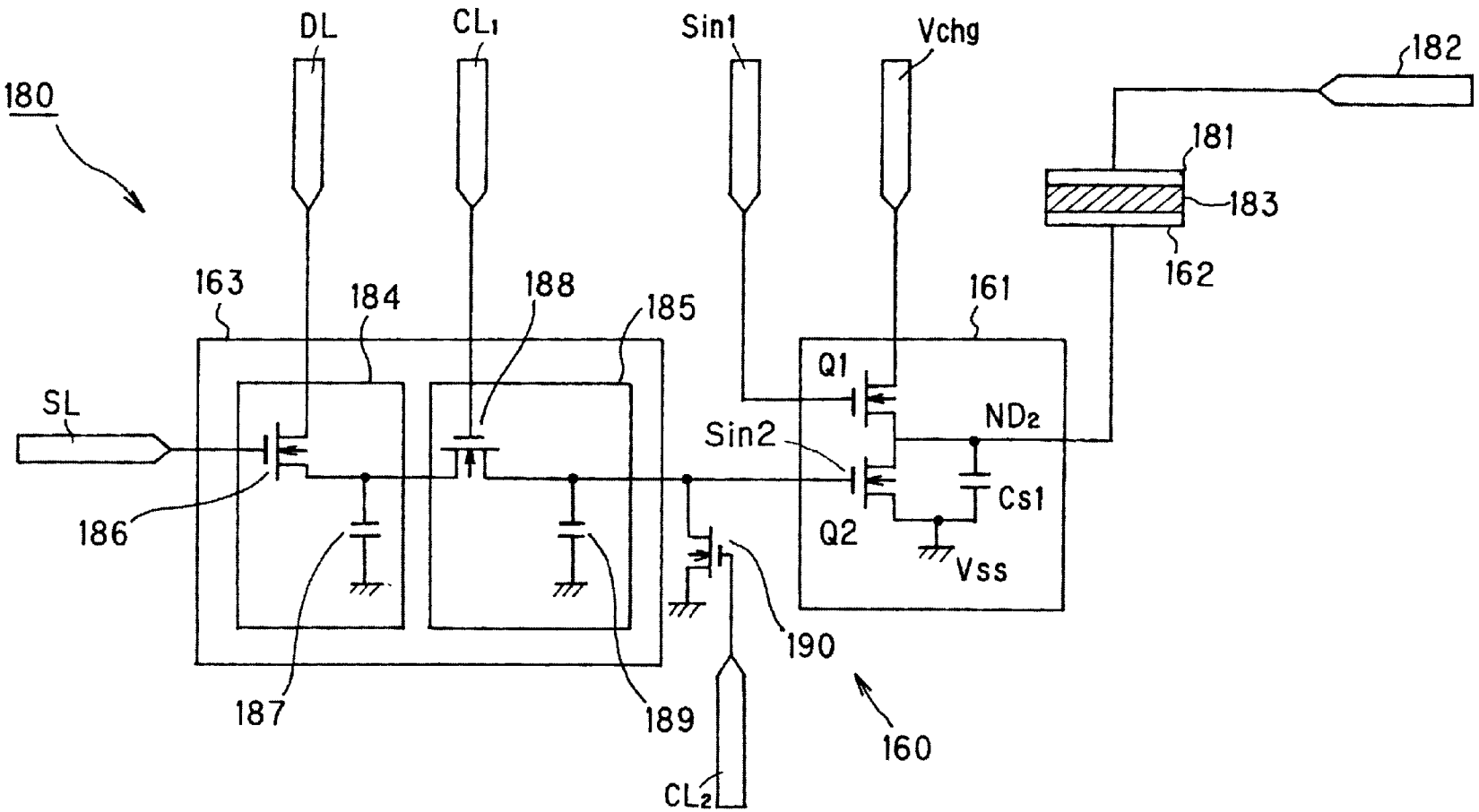
FIG. 42 is a circuit diagram of a portion corresponding to one pixel of a spatial light modulating element having two memories.
Figure 43:
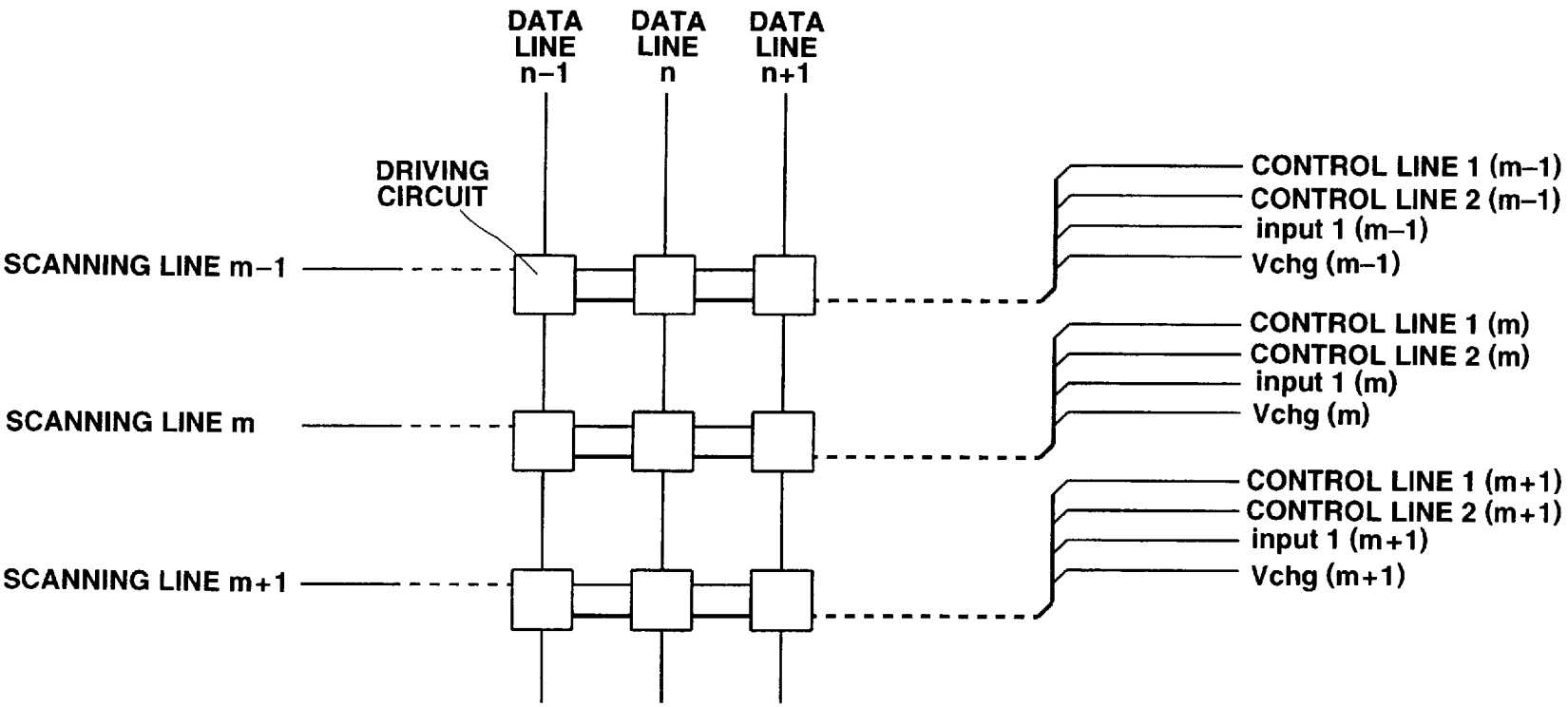
FIG. 43 is a schematic view showing the structure of a driving layer near scanning lines m and data lines n of the spatial light modulating element.
Figure 44:
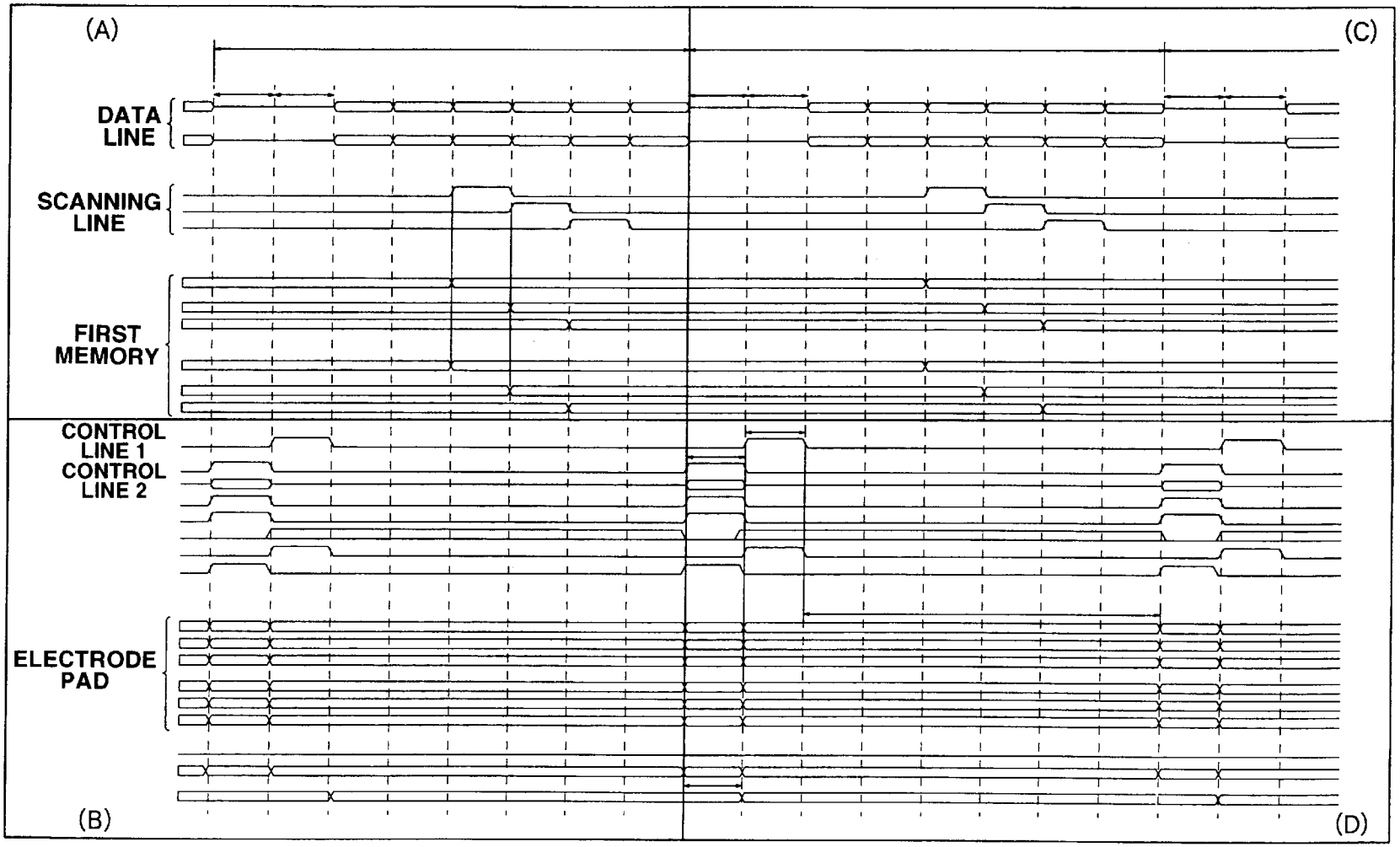
FIG. 44 is a timing chart for explaining operation of the spatial light modulating element.

FIG. 42 is a circuit diagram showing a portion corresponding to one pixel of the spatial light modulating element. FIG. 43 is a schematic view showing the structure of a driving layer near a scanning line m and a data line n of the spatial light modulating element.

This spatial light modulating element 180 includes, for each pixel, a driving circuit 160 having a voltage generating circuit 161, a control circuit 163 and an electrode PAD 162. The spatial light modulating element 180 also includes, for each pixel, a counter-electrode 181 and a power source 182 for applying a predetermined voltage to the counter-electrode 181, as shown in FIG. 42. FLC 183 is held between the electrode PAD 162 and the counter-electrode 181.

In this spatial light modulating element 180, the control circuit 163 has a first memory 184 and a second memory 185.

The first memory 184 is constituted by a DRAM type memory cell, and includes one nMOS transistor 186 and one capacitor 187. The nMOS transistor 186 has its gate connected to a scanning line SL. Also, the nMOS transistor 186 has its drain connected to a data line DL and has its source connected to the capacitor 187.

The second memory 185, similar to the first memory 184, is constituted by a DRAM memory cell, and includes one nMOS transistor 188 and one capacitor 189. The nMOS transistor 188 has its gate connected to a first control line CL1. Also, the nMOS transistor 188 has its drain connected to the capacitor 187 of the first memory 184 and has its source connected to the capacitor 189. The nMOS transistor 188 of the second memory 185 forms a transfer date for transferring data held in the first memory 184 to the second memory 185 in accordance with a control signal supplied from the first control line CL1.

Between the capacitor 189 of the second memory 185 and a common electric potential, an nMOS transistor 190 for controlling discharge operation of the capacitor 189 of the second memory 185 is provided. This nMOS transistor 190 has its gate connected to a second control line CL2. Also, the nMOS transistor 190 has its drain connected to the capacitor 189 of the second memory 185 and has its source connected to the common electric potential. The ON/OFF state of the nMOS transistor 190 is controlled in accordance with a control signal supplied from the second control line CL2. When the nMOS transistor 190 is set in the ON state, electric charges are discharged from the capacitor 189 of the second memory 185, thus resetting the data held in the capacitor 189 of the second memory 185.

The voltage generating circuit 161 is constituted by two nMOS transistors Q1, Q2 and a capacitor Cs1, as previously shown in FIG. 4A. In this voltage generating circuit, the nMOS transistor Q1 forms first level setting means and the nMOS transistor Q2 forms second level setting means.

As shown in FIG. 42, an input signal Sin1 is applied to the gate of the nMOS transistor Q1 and an input signal Sin2 is applied to the gate of the nMOS transistor Q2.

The drain of the nMOS transistor Q1 is connected to a charging voltage Vchg. The source of the nMOS transistor Q1 is connected to the drain of the nMOS transistor Q2, and the connection point forms an output node ND2. The source of the nMOS transistor Q2 is connected to a common electric potential Vss.

The capacitor Cs1 is connected between the output node ND2 and the common electric potential Vss.

The electrode PAD 182 is connected to the output node ND2 of the voltage generating circuit 161. The counter-electrode 181 is connected to the power source 182. The FLC 183 is held between the electrode PAD 162 and the counter-electrode 181.

Figure 45:
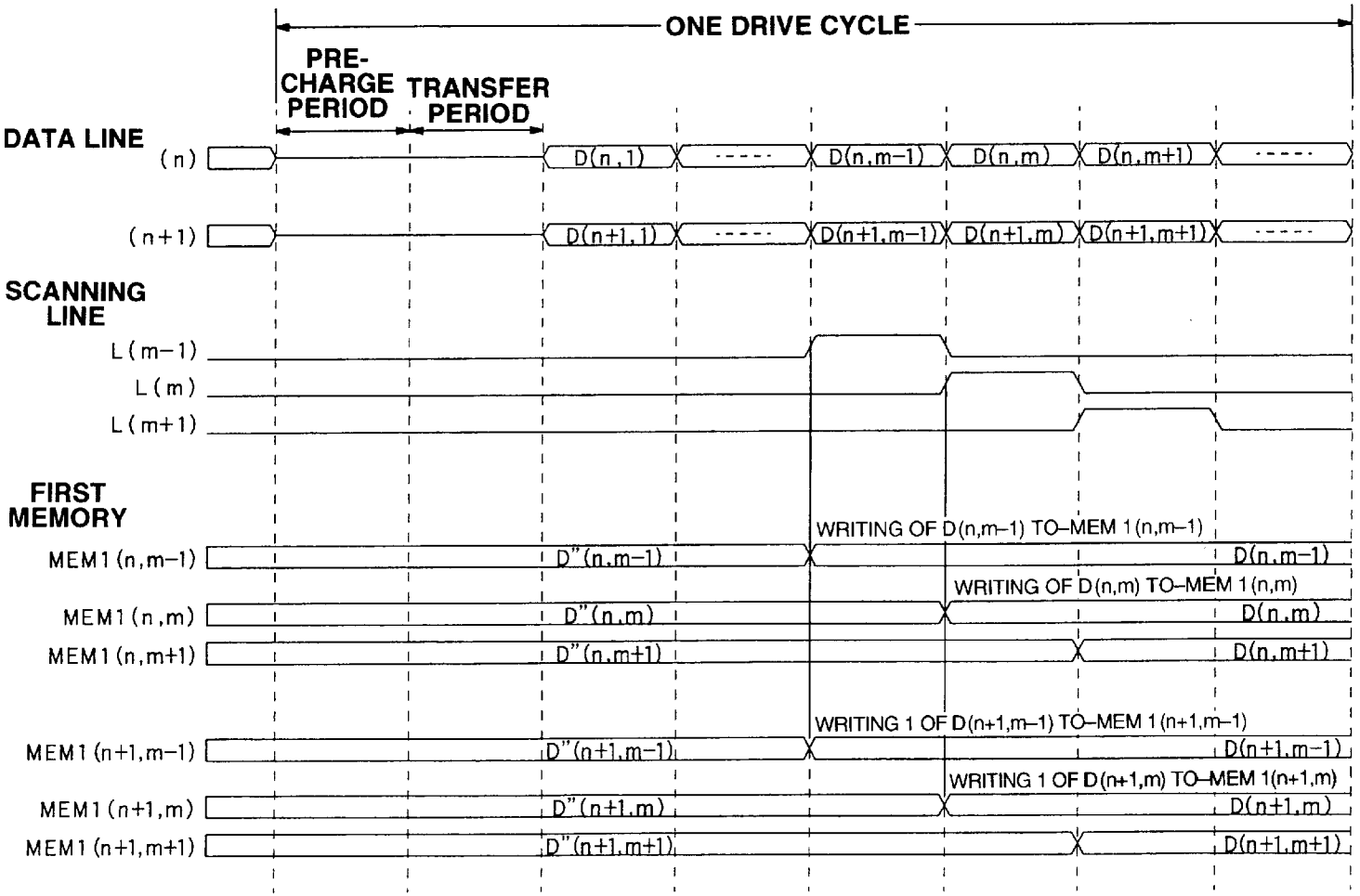
FIG. 45 is an enlarged view of section (A) in FIG. 44.
Figure 46:
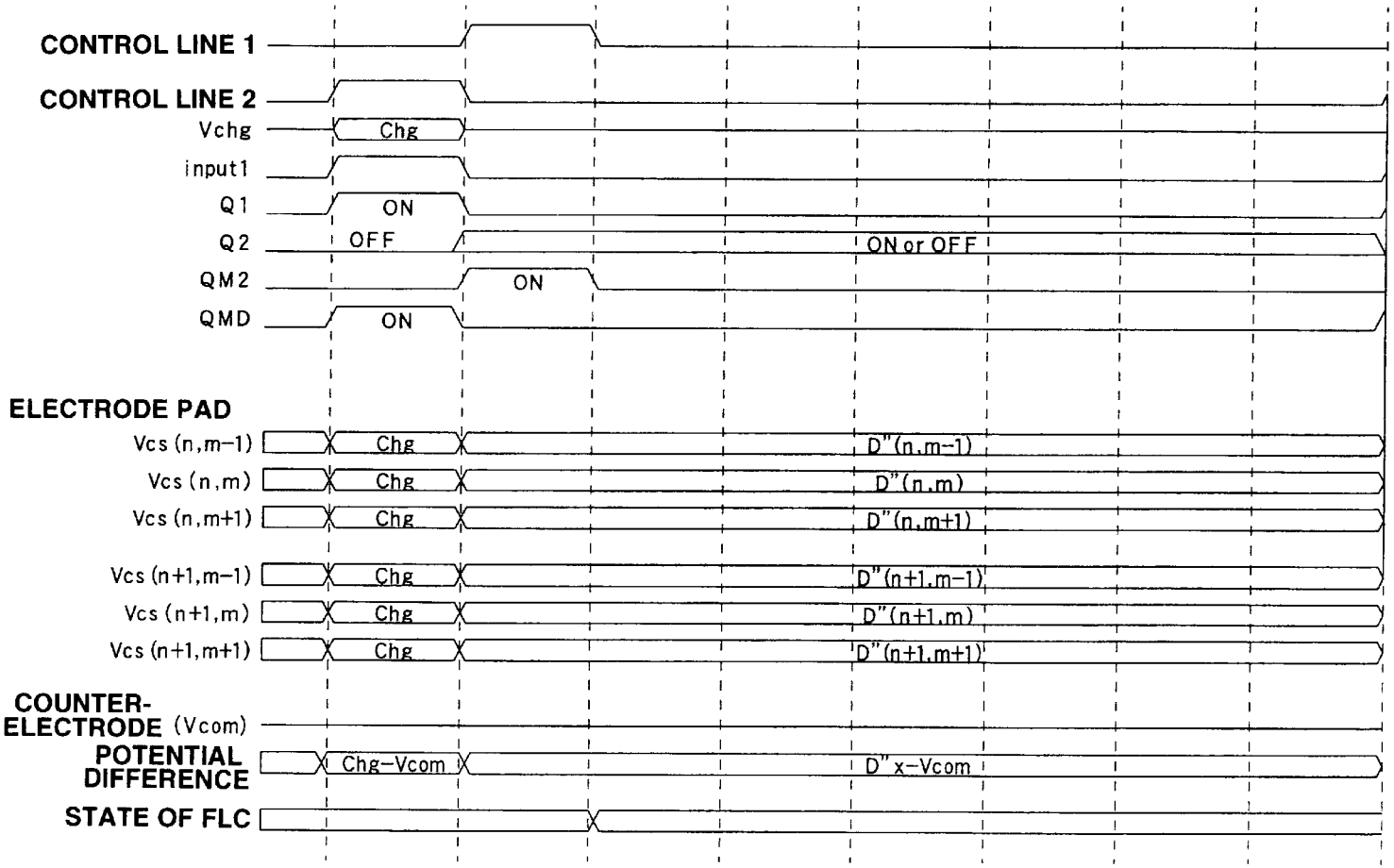
FIG. 46 is an enlarged view of section (B) in FIG. 44.
Figure 47:
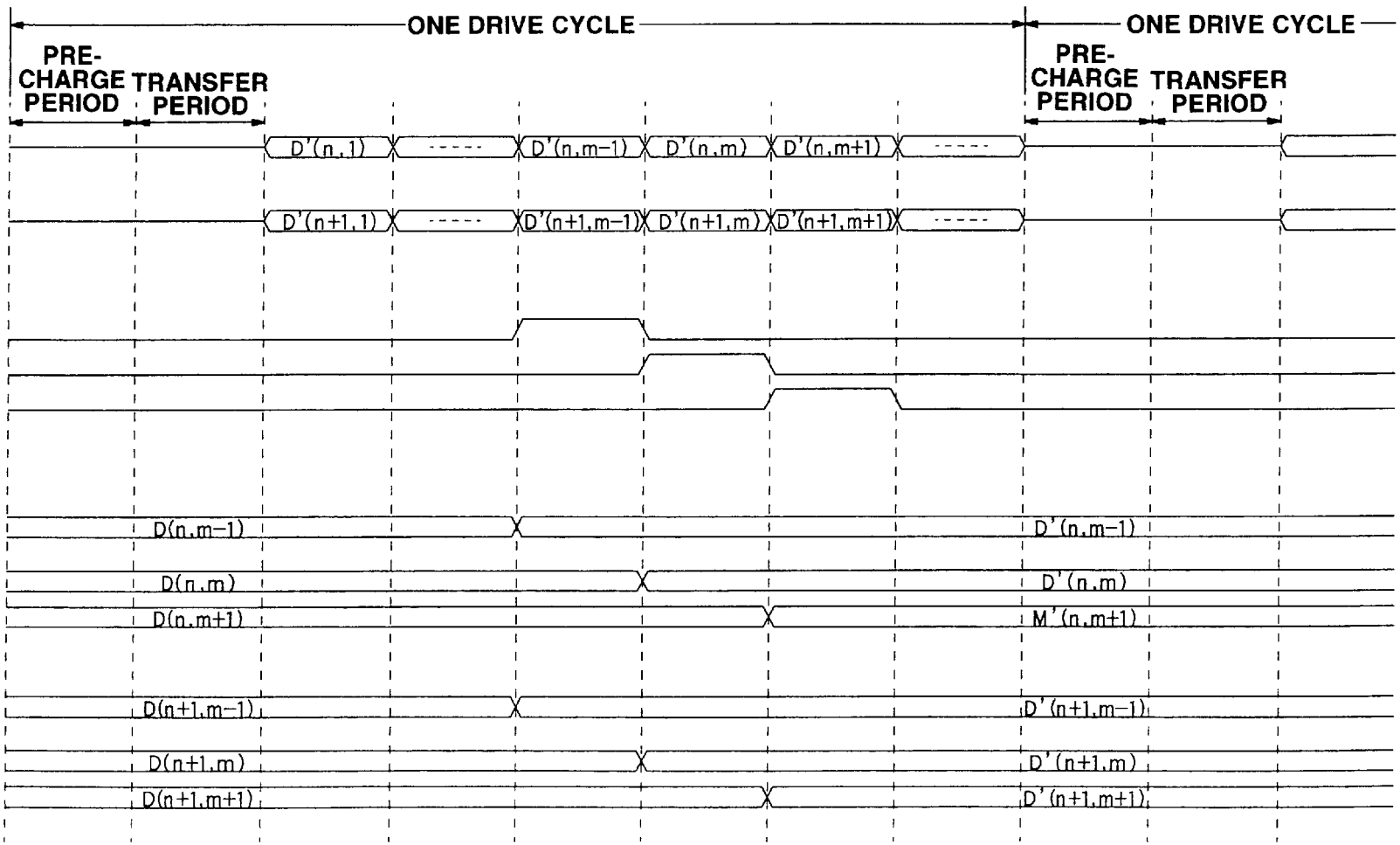
FIG. 47 is an enlarged view of section (C) in FIG. 44.
Figure 48:
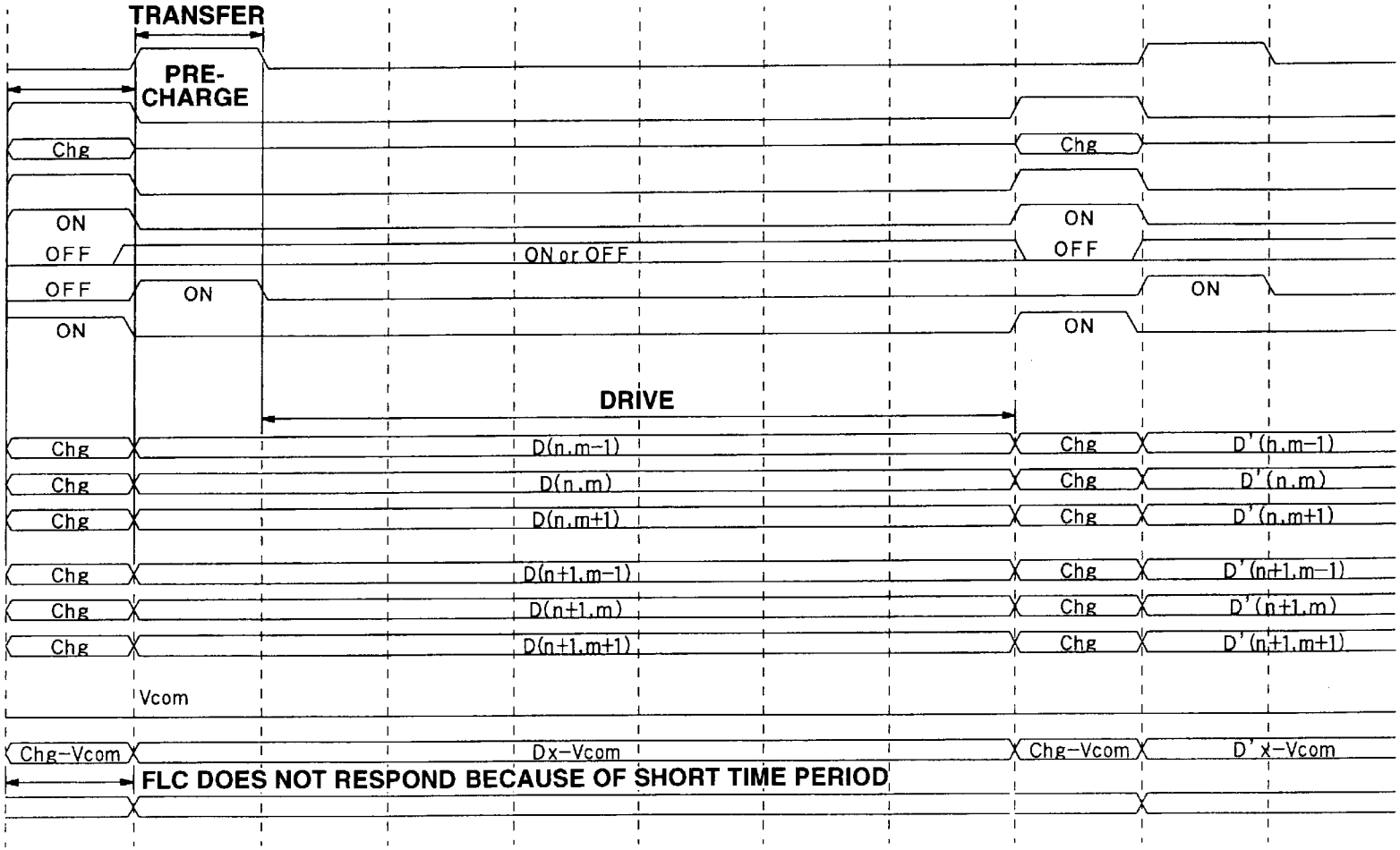
FIG. 48 is an enlarged view of section (D) in FIG. 44.
Figure 49:
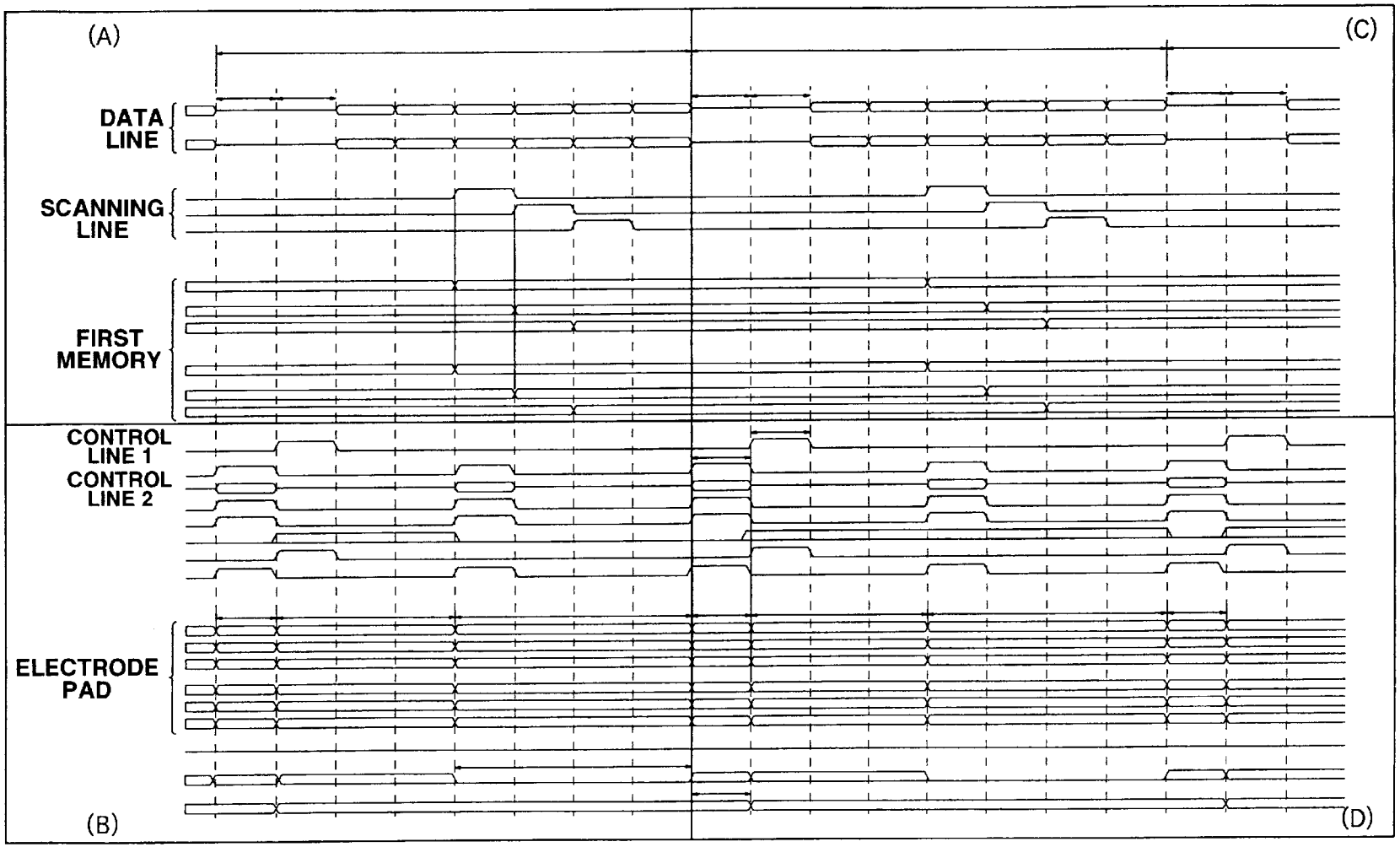
FIG. 49 is a timing chart for explaining another example of operation of the spatial light modulating element.

FIGS. 44 to 48 are driving timing charts of the spatial light modulating element 180 constituted as described above. FIG. 45 is an enlarged view of section (A) in FIG. 44. FIG. 46 is an enlarged view of section (B) in FIG. 44. FIG. 47 is an enlarged view of section (C) in FIG. 44. FIG. 48 is an enlarged view of section (D) in FIG. 44. Referring to FIGS. 44 to 48, operation of the spatial light modulating element 180 will now be described.

In the driving timing charts of FIGS. 44 to 48, only a pixel area near a data line n and a scanning line m, from among a plurality of pixels, is shown. By applying the same driving as in this pixel area to all the pixels, appropriate driving can be carried out.

In the general flow of operation of this spatial light modulating element 180, first, pixel data is written in the first memory 184 of the control circuit 163. Then, the nMOS transistor 190 is set in the ON state to reset data held in the second memory 185 of the control circuit 163, and the nMOS transistor Q2 of the voltage generating circuit 161 is set in the OFF state. At this point, pre-charge is carried out by the voltage generating circuit 161.

Next, the pixel data is transferred from the first memory 184 of the control circuit 163 to the second memory 185 of the control circuit 163, and the individual pixels are driven in batched operation in accordance with the pixel data.

The driving of this spatial light modulating element 180 is hereinafter described in detail.

As shown in FIG. 45, pixel data D(n, 1), . . . , D(n, m−1), D(n, m), D(n, m+1), . . . are generated in accordance with an image signal to be displayed, and are applied to a data line n at predetermined timing. Similarly, pixel data D(n+1, 1), . . . , D(n+1, m−1), D(n+1, m), D(n+1, m+1), . . . are generated in accordance with an image signal to be displayed, and are applied to a data line n+1 at predetermined timing.

When the pixel data D(n, m−1), D(n, m), D(n, m+1) on the data line n are determined and then the pixel data D(n+1, m−1), D(n+1, m), D(n+1, m+1) on the data line n+1 are determined, a control signal such as a pulse signal of a high level is sequentially applied to the scanning lines m−1, m, and m+1.

Thus, the pixel data D(n, m−1) is written in the first memory 184 of the pixel (n, m−1), and the pixel data D(n, m) is written in the first memory 184 of the pixel (n, m) while the pixel data D(n, m+1) is written in the first memory 184 of the pixel (n, m+1). Also, the pixel data D(n+1, m−1) is written in the first memory 184 of the pixel (n+1), m−1), and the pixel data D(n+1, m) is written in the first memory 184 of the pixel (n+1, m.) while the pixel data D(n+1, m+1) is written in the first memory 184 of the pixel (n+1, m+1).

By carrying out the above-described operation with respect to all the pixels, the pixel data is written from the data line to the first memory 184 of each pixel. Until new pixel data from the data line is written to the first memory 184, the previous pixel data is written in the first memory 184. Although not shown, when the pixel data from the data line is being written to the first memory 184, the previous pixel data is held in the second memory 185. Then, a voltage corresponding to the previous pixel data is applied to the electrode PAD 162, as shown in FIG. 46.

Specifically, when the pixel data is at the high level, the nMOS transistor Q2 of the voltage generating circuit 161 is set in the ON state and electric charges are discharged from the capacitor Cs1, thus setting the level of the output node ND2 at the level of the common electric potential. On the other hand, when the pixel data at the low level, the nMOS transistor Q2 of the voltage generating circuit 161 is set in the OFF state, and therefore a voltage of the same level as the charging voltage Vchg is applied to the electrode PAD 162.

The FLC 183 is driven by the potential difference Vflc between the electrode PAD 162 and the counter-electrode 181.

On completion of write operation of the pixel data to the first memory 184, a pulse signal of the high level is applied to the second control line CL2, as shown in FIG. 48. In response to this pulse signal, the nMOS transistor 190 is held in the ON state for a period set by the pulse width. Thus, electric charges are discharged from the capacitor 189 of the second memory 185, and the nMOS transistor Q2 of the voltage generating circuit 161 is set in the OFF state.

At the same time, the charging voltage Vchg is set at a predetermined voltage and the input signal Sin1 is set at the high level. Thus, the nMOS transistor Q1 of the voltage generating circuit 161 is set in the ON state and pre-charge is carried out. By making the period for pre-charge sufficiently shorter than the response time of the FLC, the FLC can be prevented from responding to the charging voltage.

On completion of pre-charge, a pulse signal of the high level is applied to the first control line CL1. In response to this pulse signal, the nMOS transistor 188 of the second memory 185 forming the transfer gate is set in the ON state, and the pixel data held in the first memory 184 is transferred to the second memory 185.

The voltage generating circuit 161 applies, to the electrode PAD 162, a voltage corresponding to the pixel data transferred to the second memory 185. That is, when the pixel data transferred to the second memory 185 is at the high level, the nMOS transistor Q2 of the voltage generating circuit 161 is set in the ON state and electric charges are discharged from the capacitor Cs1. Thus, the level of the output node ND2 of the voltage generating circuit 161 becomes the level of the common electric potential, and a voltage of the common electric potential level is applied to the electrode PAD 162.

On the other hand, when the pixel data transferred to the second memory 185 is at the low level, the nMOS transistor Q2 of the voltage generating circuit 161 is set in the OFF state. Therefore, a voltage of the same level as the charging voltage Vchg is applied to the electrode PAD 162.

The FLC 183 is driven by the potential difference Vflc between the electrode PAD 162 and the counter-electrode 181.

As the pixel data held in the first memory 184 is transferred to the second memory 185, pixel data is newly generated in accordance with the next image signal to be displayed and is applied to the data line at predetermined timing, as shown in FIG. 45. When the pixel data on the data line is determined, a control signal is sequentially applied to the scanning line. In response to this control signal, the pixel data corresponding to the image signal to be displayed is written to the first memory 184 of each pixel.

By repeating the above-described operation, FLC of each pixel is driven in accordance with the pixel data and sequentially changes its light modulation characteristic.

In the above example, the modulation layer driven by the driving circuit is made of FLC, and the spatial light modulating element having two levels for driving gradation is described. However, driving by the driving circuit of the similar structure can be carried out even in the case where other materials such as TN liquid crystal and STN liquid crystal are used for the modulation layer and where multi-levels are employed for driving gradation.

2-6-9. Another Example of Operation of Spatial Light Modulating Element

The operation of the spatial light modulating element 180 in which the applied voltage is set at 0 V to prevent polarization of ions after the state of FLC is stabilized will now be described with reference to FIGS. 49 to 53. Utilizing the state memory characteristic of the FLC 183, the spatial light modulating element 180 holds the previous state of the FLC 183 even after the applied voltage is set at 0 V.

The structure of the spatial light modulating element 180 is similar to that of FIG. 42, in which the control circuit 163 includes the first memory 184 and the second memory 185.

In the general flow of operation of this spatial light modulating element 180, first, pixel data is written in the first memory 184 of the control circuit 163. Then, the nMOS transistor 190 is set in the ON state to reset data held in the second memory 185 of the control circuit 163, and the nMOS transistor Q2 of the voltage generating circuit 161 is set in the OFF state. At this point, the above-described pre-charge is carried out by the voltage generating circuit 161.

Next, the pixel data is transferred from the first memory 184 of the control circuit 163 to the second memory 185 of the control circuit 163, and the individual pixels are driven in batched operation in accordance with the pixel data. Finally, an auxiliary capacity is charged to equalize the electric potential of the electrode PAD 162 with the electric potential of the counter-electrode 181.

The driving of this spatial light modulating element 180 is hereinafter described in detail.

Figure 50:
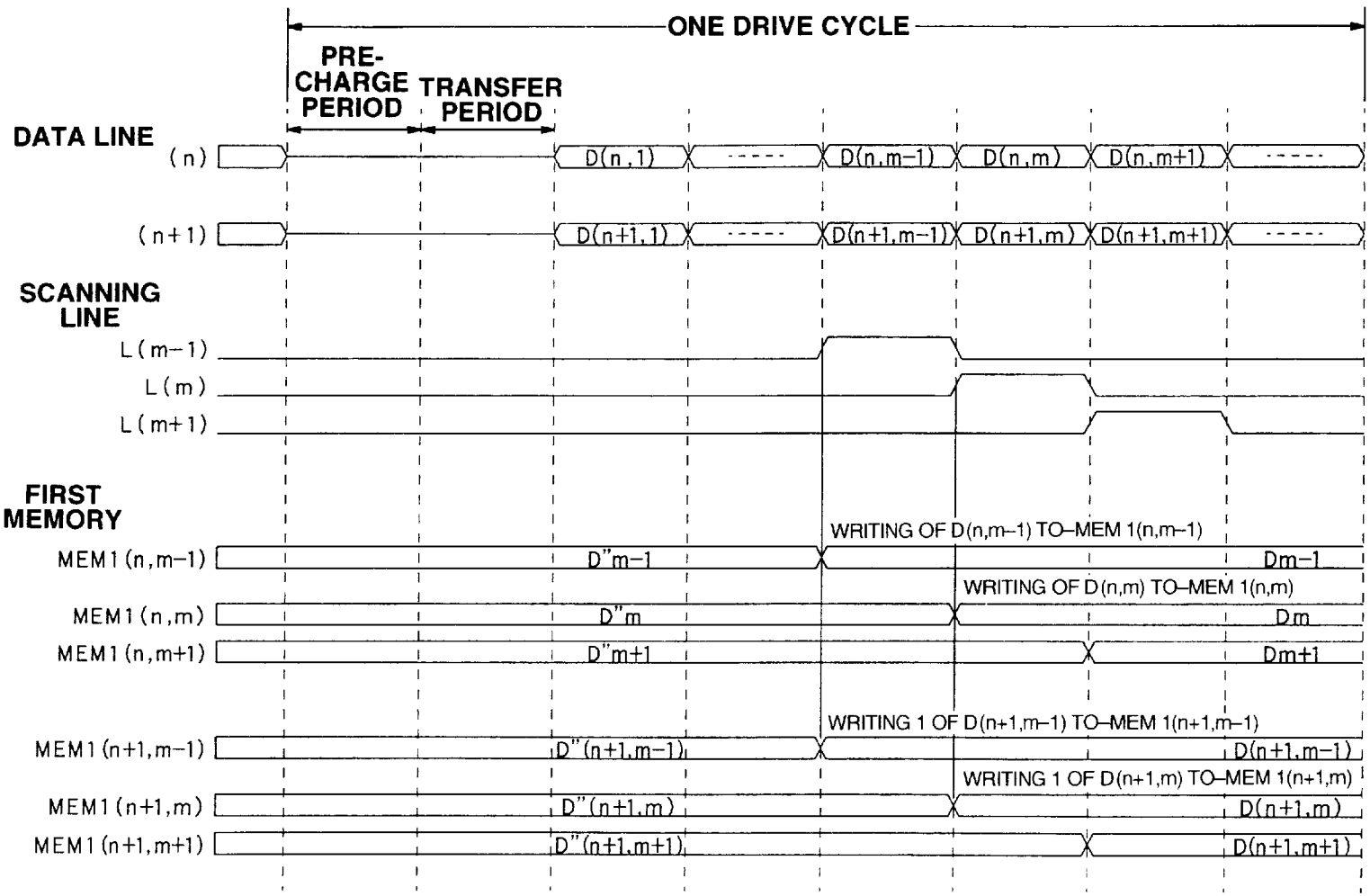
FIG. 50 is an enlarged view of section (A) in FIG. 49.

As shown in FIG. 50, pixel data D(n, 1), . . . , D(n, m−1), D(n, m), D(n, m+1), . . . are generated in accordance with an image signal to be displayed, and are applied to a data line n at predetermined timing. Similarly, pixel data D(n+1, 1), . . . , D(n+1, m−1), D(n+1, m), D(n+1, m+1), . . . are generated in accordance with an image signal to be displayed, and are applied to a data line n+1 at predetermined timing.

When the pixel data D(n, m−1), D(n, m), D(n, m+1) on the data line n are determined and then the pixel data D(n+1, m−1), D(n+1, m), D(n+1, m+1) on the data line n+1 are determined, a control signal such as a pulse signal of a high level is sequentially applied to the scanning lines m−1, m, and m+1.

Thus, the pixel data D(n, m−1) is written in the first memory 184 of the pixel (n, m−1), and the pixel data D(n, m) is written in the first memory 184 of the pixel (n, m) while the pixel data D(n, m+1) is written in the first memory 184 of the pixel (n, m+1). Also, the pixel data D(n+1, m−1) is written in the first memory 184 of the pixel (n+1, m−1), and the pixel data D(n+1, m) is written in the first memory 184 of the pixel (n+1, m) while the pixel data D(n+1, m+1) is written in the first memory 184 of the pixel (n+1, m+1).

Figure 51:
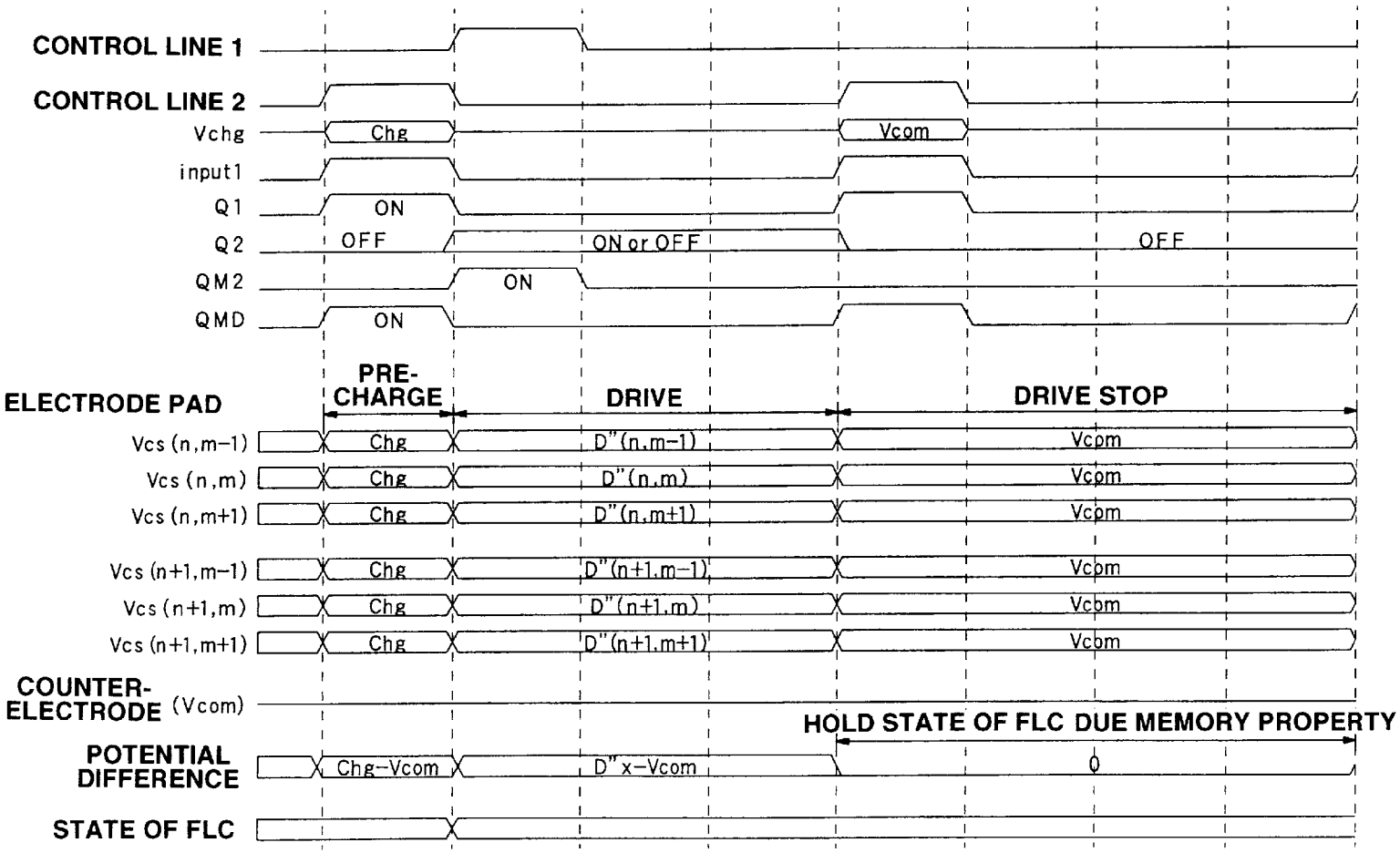
FIG. 51 is an enlarged view of section (B) in FIG. 49.

By carrying out the above-described operation with respect to all the pixels, the pixel data is written from the data line to the first memory 184 of each pixel. Until new pixel data from the data line is written to the first memory 184, the previous pixel data is written in the first memory 184. Although not shown, when the pixel data from the data line is being written to the first memory 184, the previous pixel data is held in the second memory 185. Then, a voltage corresponding to the previous pixel data is applied to the electrode PAD 162 until the capacitor Cs1 is charged with the auxiliary capacity for equalizing the electric potential of the electrode PAD 162 with the electric potential of the counter-electrode 181, as shown in FIG. 51.

Figure 53:
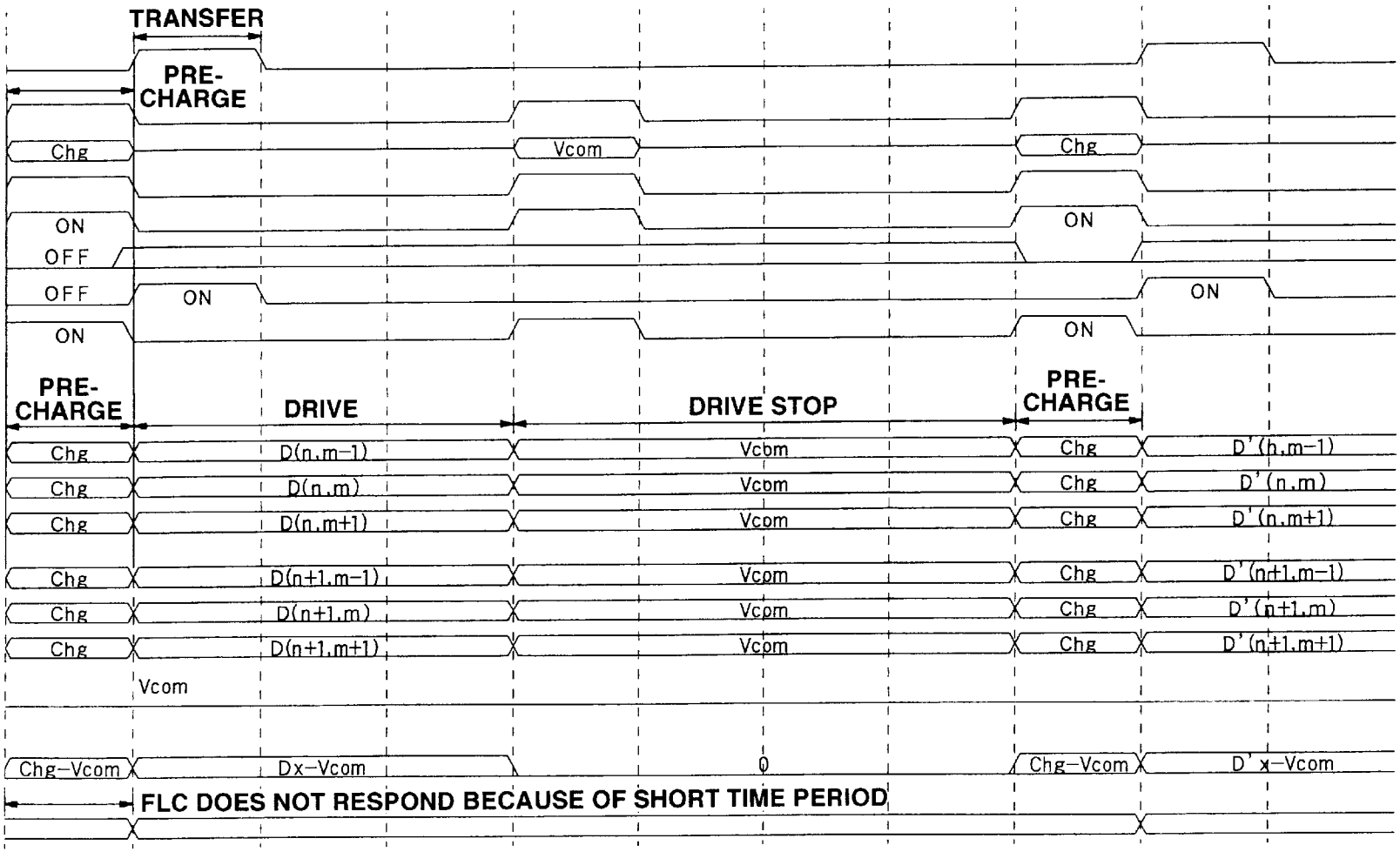
FIG. 53 is an enlarged view of section (D) in FIG. 49.

On completion of write operation of the pixel data to the first memory 184, a pulse signal of the high level is applied to the second control line CL2, as shown in FIG. 53. In response to this pulse signal, the nMOS transistor 190 is held in the ON state for a period set by the pulse width. Thus, electric charges are discharged from the capacitor 189 of the second memory 185, and the nMOS transistor Q2 of the voltage generating circuit 161 is set in the OFF state.

At the same time, the charging voltage Vchg is set at a predetermined voltage and the input signal Sin1 is set at the high level. Thus, the nMOS transistor Q1 of the voltage generating circuit 161 is set in the ON state and pre-charge is carried out. By making the period for pre-charge sufficiently shorter than the response time of the FLC, the FLC can be prevented from responding to the charging voltage.

On completion of pre-charge, a pulse signal of the high level is applied to the first control line CL1. In response to this pulse signal, the nMOS transistor 188 of the second memory 185 forming the transfer gate is set in the ON state, and the pixel data held in the first memory 184 is transferred to the second memory 185.

The voltage generating circuit 161 applies, to the electrode PAD 162, a voltage corresponding to the pixel data transferred to the second memory 185. That is, when the pixel data transferred to the second memory 185 is at the high level, the nMOS transistor Q2 of the voltage generating circuit 161 is set in the ON state and electric charges are discharged from the capacitor Cs1. Thus, the level of the output node ND2 of the voltage generating circuit 161 becomes the level of the common electric potential, and a voltage of the common electric potential level is applied to the electrode PAD 162.

On the other hand, when the pixel data transferred to the second memory 185 is at the low level, the nMOS transistor Q2 of the voltage generating circuit 161 is set in the OFF state. Therefore, a voltage of the same level as the charging voltage Vchg is applied to the electrode PAD 162.

The FLC 183 is driven by the potential difference Vflc between the electrode PAD 162 and the counter-electrode 181.

After the state of the FLC 183 is stabilized, a pulse signal of the high level is applied to the second control line CL2. In response to this pulse signal, the nMOS transistor 190 is held in the ON state for a period set by the pulse width. Thus, electric charges are discharged from the capacitor 189 of the second memory 185, and the nMOS transistor Q2 of the voltage generating circuit 161 is set in the OFF state.

At the same time, the charging voltage Vchg is set at a value obtained by adding the amount of voltage drop Vdrp to the voltage from the power source 182. The input signal Sin1 is set at the high level and the nMOS transistor Q1 of the voltage generating circuit 161 is set in the ON state. Thus, a voltage of the same level as the voltage from the power source 182 is applied to the electrode PAD 162, and the potential difference between the electrode PAD 162 and the counter-electrode 181 becomes 0 V. Even when the applied voltage becomes 0 V, the previous state of the FLC 182 is held by its state memory characteristic.

Figure 52:
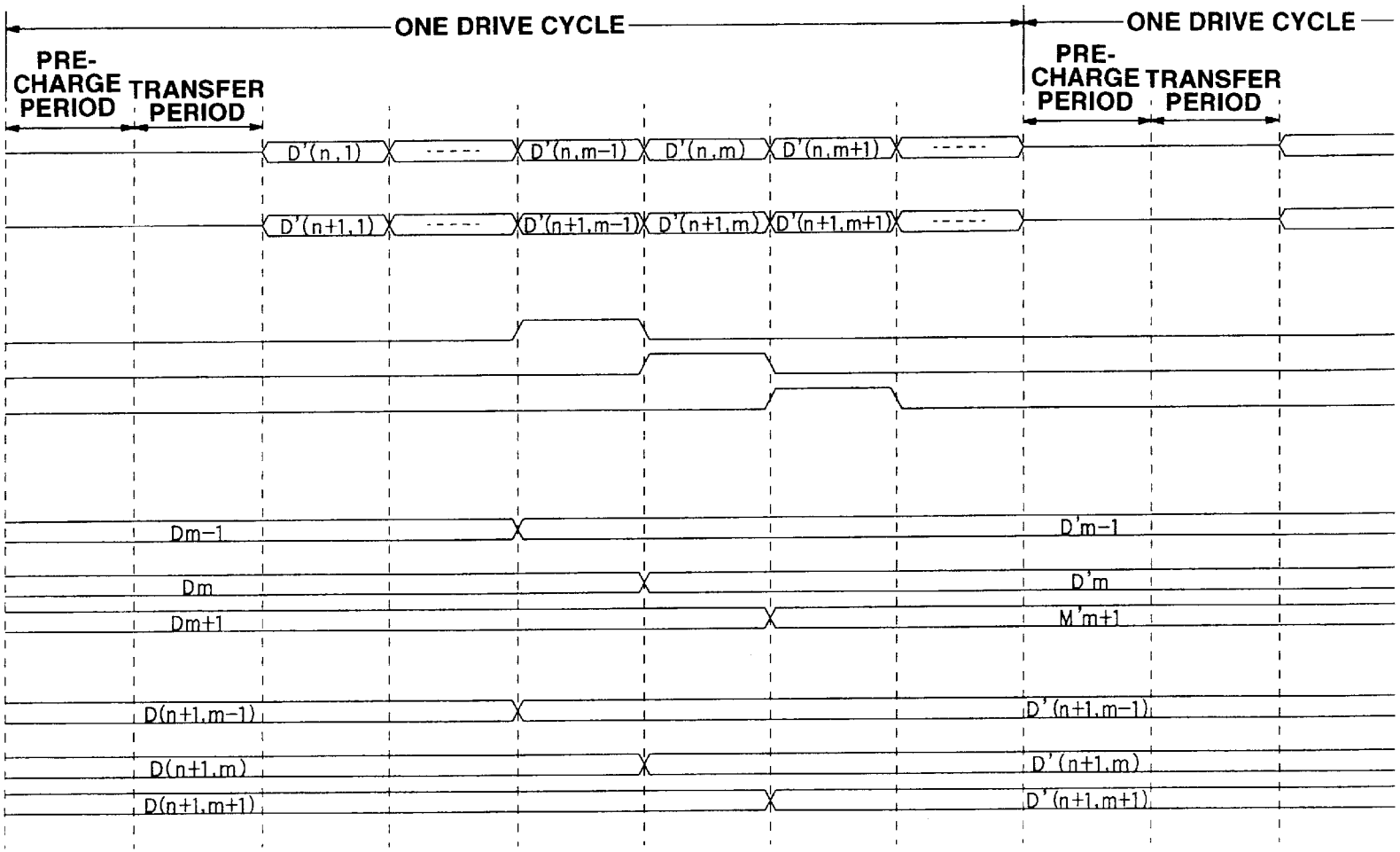
FIG. 52 is an enlarged view of section (C) in FIG. 49.

As the pixel data held in the first memory 184 is transferred to the second memory 185, pixel data is newly generated in accordance with the next image signal to be displayed and is applied to the data line at predetermined timing, as shown in FIG. 52. When the pixel data on the data line is determined, a control signal is sequentially applied to the scanning line. In response to this control signal, the pixel data corresponding to the next image signal to be displayed is written to the first memory 184 of each pixel.

By repeating the above-described operation, FLC of each pixel is driven in accordance with the pixel data and sequentially changes its light modulation characteristic.

In the above example, the modulation layer driven by the driving circuit is made of FLC, and the spatial light modulating element having two levels for driving gradation is described. However, driving by the driving circuit of the similar structure can be carried out even in the case where other materials such as TN liquid crystal and STN liquid crystal are used for the modulation layer and where multi-levels are employed for driving gradation.

3. Display System

A display system having a spatial light modulating element as described above will now be described.

Figure 54:
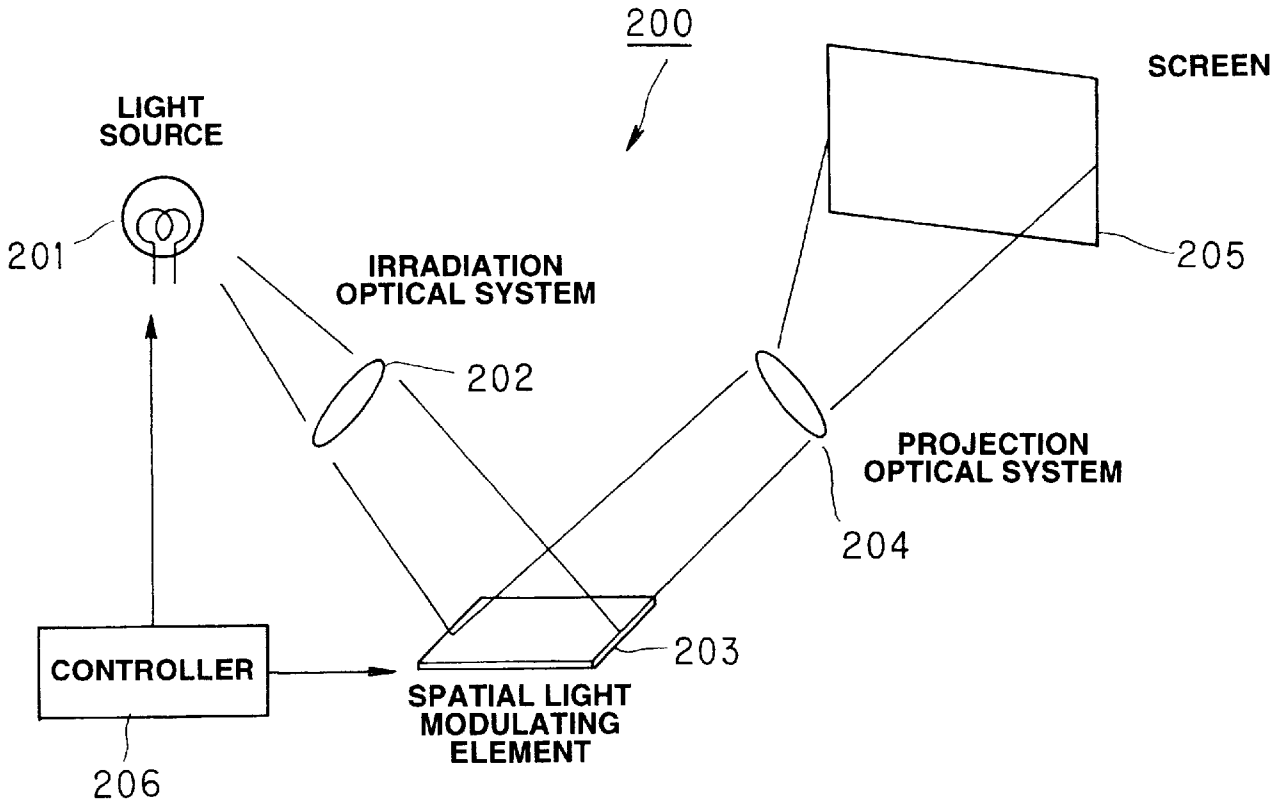
FIG. 54 is a schematic view showing the structure of a reflection type display system.
Figure 55:
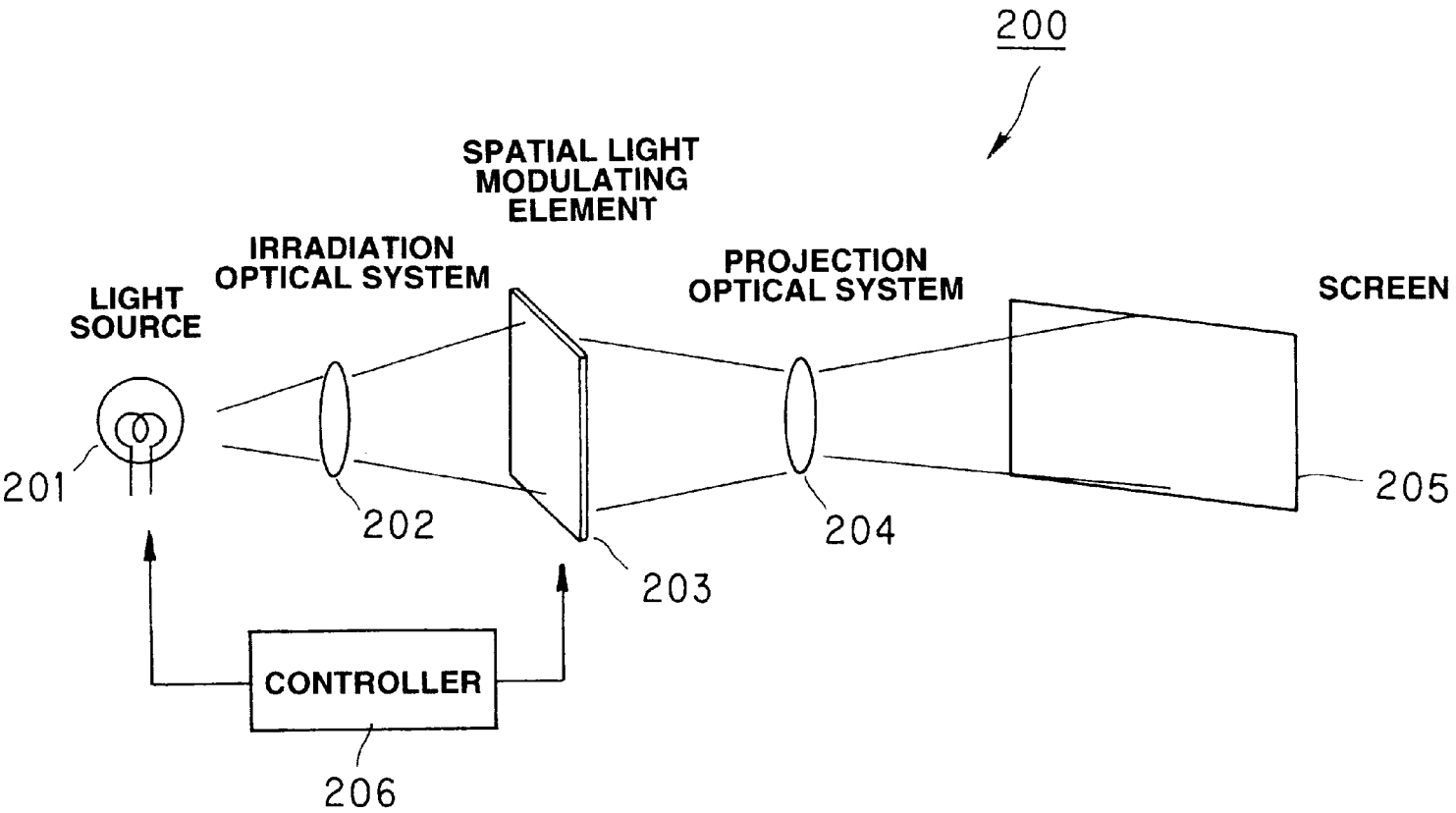
FIG. 55 is a schematic view showing the structure of a transmission type display system.

FIGS. 54 and 55 show exemplary structures of the display system.

FIG. 54 shows a reflection type display system in which a light reflected by a spatial light modulating element is projected to a screen, thus realizing large-screen display.

FIG. 55 shows a transmission type display system in which a light from a back light is modulated by a spatial light modulating element so that the light transmitted through the spatial light modulating element is projected to a screen.

Each of these display systems 200 includes a light source 201, an irradiation optical system 202, a spatial light modulating element 203, a projection optical system 204, and a screen 205. In the actual structure, a polarizer is provided in the irradiation optical system 202 and an analyzer is provided in the projection optical system 204, though not described here. Alternatively, a polarizer and an analyzer are provided in the spatial light modulating element 203, or either one of a polarizer and an analyzer is provided in the spatial light modulating element 203 while the other is provided in the irradiation optical system 202 or the projection optical system 204.

The light source 201 is a light source capable of high-speed flashing. By controlling flashing of the light source 201 by a controller 206, the display/non-display state of the display system 200 is controlled. For example, when the light source 201 is lit, the display system 200 is in the display state. On the contrary, when the light of the light source is extinct, the display system 200 is in the non-display state.

Switching of the display/non-display state of the display system 200, that is, flashing of the light source 201, is carried out at a high speed so as to prevent flickering of the image signal. For example, in the display system for receiving and displaying television broadcast signals, the display/non-display state is switched at 60 Hz. That is, the image signal is updated 60 times a second.

By making the lighting time of the light source 201 longer than the extinction time, image display with high luminance can be realized even when the light intensity of the light source 201 is set at a low level. Thus, the efficiency of light utilization can be improved.

In displaying a color image, a light source capable of emitting a red light, a green light and a blue light corresponding to three primary colors of light is used as the light source 201. Specifically, three independent light sources corresponding to three primary colors of light may be prepared, or a light from a single light source may be split into a red light, a green light and a blue light by using a dichroic mirror.

The irradiation optical system 202 is an optical system for irradiating the reflection type spatial light modulating element 203 with a light from the light source 201. That is, the light from the light source 201 is radiated to the spatial light modulating element 203 through the irradiation optical system 202.

The spatial light modulating element 203 is adapted for modulating a light by each pixel in accordance with pixel data, as described above. In the reflection type display system shown in FIG. 54, a reflection type spatial light modulating element is used as the spatial light modulating element 203. In the reflection type spatial light modulating element, the driving circuit for driving the above-described modulation layer can be arranged on the side opposite to the surface reflecting a light, and the effective numerical aperture of the pixel will not be narrowed by the arrangement of the driving circuit. That is, in the reflection type display system, the effective numerical aperture of each pixel can be enlarged by using such reflection type spatial light modulating element.

In the transmission type display system shown in FIG. 55, a transmission type spatial light modulating element is used as the spatial light modulating element 203. The transmission type spatial light modulating element modulates a light emitted from the light source 201 (back light) arranged on the back side of the spatial light modulating element, and transmits this modulated light. In the transmission type display system, reduction in thickness is realized by using such transmission type spatial light modulating element.

The projection optical system 204 is an optical system for projecting the light modulated by the spatial light modulating element 203 onto the screen 205. The light which is emitted from the light source 201 and modulated by the spatial light modulating element 203 projected onto the screen by the projection optical system 204. That is, in the display system 200, an image obtained by modulating the light from the light source by the spatial light modulating element 203 is displayed on the screen 205.

As described above, in this display system 200, a light from the light source 201 is radiated to the spatial light modulating element 203 by the irradiation optical system 202, and the light modulated by the spatial light modulating element 203 is projected onto the screen 205 by the projection optical system 204. As a result, an image is displayed on the screen 205.

In this display system, when displaying an image, the light source 201 is caused to flash at a high speed under the control of the controller 206, and the spatial light modulating element 203 is driven synchronously with flashing of the light source 201. That is, in the display system 200, every time the image to be displayed is changed, the light source 201 is set in the extinction state and each pixel of the spatial light modulating element 203 is rewritten during the period of the extinction state. Then, on completion of rewriting of all the pixels, the light source 201 is lit. Thus, images formed by lights modulated by each pixel are sequentially displayed on the screen 205. In the case where the time for rewriting pixels is sufficiently short or not problematical, the light source 201 need not be caused to flash, as a matter of course.

In the above example, the screen 205 is provided, and the light modulated and reflected by the spatial light modulating element 203 is projected to the screen 205. However, the display system may also have a structure such that the light modulated by the spatial light modulating element 203 is caused to form an image directly to the eyes through the projection optical system 204.

In the voltage generating circuit according to the present invention, charge or discharge with respect to the capacitor is carried out in accordance with the first input signal and the second input signal supplied from outside. Thus, a signal having at least two levels between the power-supply voltage and the common electric potential can be outputted.

Also, in the voltage generating circuit, in the case where the first and second level setting means are constituted by insulated gate field-effect transistors, the level of the output node can be set by controlling the conduction time of the insulated gate field-effect transistors. The second input signal may be a signal of a small amplitude sufficient to control the conduction time of the insulated gate field-effect transistors, and a signal of a large amplitude can be outputted by the signal of a small amplitude.

In addition, in the spatial light modulating element according to the present invention, the control means outputs the second signal corresponding to the pixel data, and the voltage generating circuit outputs a signal having at least two levels in accordance with the first input signal and the second input signal supplied by the control means. Thus, a light can be properly modulated by each pixel.

Also, in the spatial light modulating element, in the case where the first and second level setting means are constituted by insulated gate field-effect transistors, the level of the output node can be set by controlling the conduction time of the insulated gate field-effect transistors. The second input signal may be a signal of a small amplitude sufficient to control the conduction time of the insulated gate field-effect transistors, and a light can be properly modulated with the signal of a small amplitude.

Also, in the spatial light modulating element, in the case where the control means includes the first data holding means, the second data holding means, and the transfer gate for controlling the data transfer between the first data holding means and the second data holding means, all the pixels can be rewritten in a batched manner.

In addition, in the display system according to the present invention, the spatial light modulating element properly modulates a light emitted from the light source, by each pixel, on the basis of a signal having at least two levels outputted from the voltage generating circuit in accordance with the first input signal and the second input signal supplied by the control means in accordance with the pixel data. Thus, an image corresponding to the pixel data can be properly displayed.

Also, in the driving method for display system according to the present invention, at the first step, the electric potential of the output node connected to each pixel of the spatial light modulating element is set at the first level, and at the second step, the electric potential of the output node is held at the first level or set at the second level different from the first level in accordance with the second input signal corresponding to the pixel data. Thus, each pixel of the spatial light modulating element can be properly driven in accordance with the pixel data.

What is claimed is:

1. A spatial light modulating element having a plurality of pixels and adapted for modulating a light by each pixel in accordance with pixel data based on an image signal to be displayed, the spatial light modulating element comprising, for each pixel:

a voltage generating circuit having first level setting means for setting the electric potential of an output node at a first level in accordance with a first input signal from a first signal input, level holding means for holding the level of the output node, second level setting means for setting the electric potential of the output node at a second level different from the first level in accordance with a second input signal from a second signal input, and a common electric potential, said first level setting means includes a switch operable to select one of a first power supply voltage and a second power supply voltage which is different from said first power supply voltage in response to a control signal in which each of said first power supply voltage and said second power supply voltage is greater than zero; and control means for outputting the second input signal in accordance with the pixel data, wherein the second level setting means is constituted by a first switching element connected between the output node and the common electric potential, the first switching element having its ON/OFF state controlled in accordance with the second input signal.

2. The spatial light modulating element as claimed in claim 1, wherein the first level setting means includes a second switching element connected between either one of said first power supply voltage and said second power-supply voltage and the output node, the second switching element having its ON/OFF state controlled in accordance with the first input signal.

3. The spatial light modulating element as claimed in claim 1, wherein the light modulation characteristic of each of the pixels is controlled in accordance with the electric potential of the output node of the voltage generating circuit provided for each pixel.

4. The spatial light modulating element as claimed in claim 1, wherein each of the pixels includes:

a first electrode held at the common electric potential;

a second electrode connected to the output node of the voltage generating circuit; and a liquid crystal material provided between the first electrode and the second electrode.

5. The spatial light modulating element as claimed in claim 4, the optical transmittance or reflectivity of the liquid crystal material is controlled in accordance with the electric potential of the output node.

6. The spatial light modulating element as claimed in claim 4, wherein the state of a plane of polarization of a light transmitted through or reflected by the liquid crystal material is controlled in accordance with the electric potential of the output node.

7. The spatial light modulating element as claimed in claim 6, further comprising an analyzer for controlling the quantity of transmitted light in accordance with the plane of polarization of the light.

8. The spatial light modulating element as claimed in claim 4, wherein the liquid crystal material is a ferroelectric liquid crystal material.

9. The spatial light modulating element as claimed in claim 8, wherein the light modulation characteristic of each of the pixels is held by the memory characteristic of the ferroelectric liquid crystal material.

10. The spatial light modulating element as claimed in claim 8, wherein the light modulation characteristic of the ferroelectric liquid crystal material is changed by setting the electric potential of the output node at the first level and applying, to the ferroelectric liquid crystal material, an electric field necessary for inverting spontaneous polarization of the ferroelectric liquid crystal material, for not less than a period necessary for injecting electric charges of a quantity corresponding to not less than double that of spontaneous polarization.

11. The spatial light modulating element as claimed in claim 1, wherein the first level setting means is constituted by a first insulated gate field-effect transistor having the first input signal applied to the control gate thereof, the first insulated gate field effect transistor having its one diffusion layer connected to the level holding means, the first insulated gate field-effect transistor having its other diffusion layer connected to the output node, and wherein the second level setting means is constituted by a second insulated gate field-effect transistor having the second input signal applied to the control gate thereof, the second insulated gate field-effect transistor having its one diffusion layer connected to the common electric potential, the second insulated gate field-effect transistor having its other diffusion layer connected to the output node.

12. The spatial light modulating element as claimed in claim 11, wherein the electric potential of the output node is set at a predetermined electric potential between the power-supply voltage and the common electric potential, by controlling a conduction time of the second insulated gate field-effect transistor in accordance with the second input signal.

13. The spatial light modulating element as claimed in claim 1, wherein the level holding means is constituted by a capacitor having its one electrode connected to the output node and having its other electrode connected to the common electric potential.

14. The spatial light modulating element as claimed in claim 1, wherein the level holding means is a parasitic capacity existing between the output node and the common electric potential.

15. The spatial light modulating element as claimed in claim 1, wherein the control means includes at least one data holding means for holding the pixel data.

16. The spatial light modulating element as claimed in claim 15, wherein the control means includes:

first data holding means for holding the pixel data;

second data holding means for receiving the data held by the first data holding means and holding the data; and a transfer gate connected between the first data holding means and the second data holding means and adapted for transferring the data held by the first data holding means to the second data holding means in accordance with a third input signal.

17. The spatial light modulating element as claimed in claim 16, wherein the first data holding means and the second data holding means are constituted by DRAM type memory cells.

18. The spatial light modulating element as claimed in claim 16, wherein the second data holding means is a parasitic capacity existing between the first data holding means and the second level setting means.

19. The spatial light modulating element as claimed in claim 1, a third switching element connected between the second level setting means and the common electric potential, the third switching element having its ON/OFF state controlled in accordance with a fourth input signal, the second level setting means being set in the OFF state by setting, in the ON state, the third switching element having its ON/OFF state controlled in accordance with the fourth input signal.

20. A display system comprising:

a light source for radiating a light; and a spatial light modulating element having a plurality of pixels and adapted for modulating a light radiated from the light source by each pixel in accordance with pixel data based on an image signal to be displayed;

the spatial light modulating element including, for each pixel:

a voltage generating circuit having first level setting means for setting the electric potential of an output node at a first level in accordance with a first input signal from a first signal input, level holding means for holding the level of the output node, and second level setting means for setting the electric potential of the output node at a second level different from the first level in accordance with a second input signal from a second signal input, said first level setting means includes a switch operable to select one of a first power supply voltage and a second power supply voltage which is different from said first power supply voltage in response to a control signal in which each of said first power supply voltage and said second power supply voltage is greater than zero; and control means for outputting the second input signal in accordance with the pixel data, wherein the second level setting means is constituted by a first switching element connected between the output node and the common electric potential, the first switching element having its ON/OFF state controlled in accordance with the second input signal.

21. The display system as claimed in claim 20, wherein the electric potential of the output node is simultaneously set at the first level or the second level, in two or more pixels of the plurality of pixels.

22. The display system as claimed in claim 21, wherein the electric potential of the output node is simultaneously set at the first level or the second level, in the plurality of pixels.

23. The display system as claimed in claim 20, wherein each of the pixels includes:

a first electrode held at a common electric potential;

a second electrode connected to the output node of the voltage generating circuit; and a liquid crystal material provided between the first electrode and the second electrode.

24. The display system as claimed in claim 20, wherein the light radiated from the light source is modulated by each pixel by the spatial light modulating element so that the modulated light is reflected by the spatial light modulating element to display an image.

25. The display system as claimed in claim 20, wherein the light radiated from the light source is modulated by each pixel by the spatial light modulating element so that the modulated light is transmitted through the spatial light modulating element to display an image.

26. A driving method for display system for driving each pixel of a spatial light modulating element having a plurality of pixels and adapted for modulating a light by each pixel in accordance with pixel data based on an image signal to be displayed, the method comprising:

a first step of charging a capacitor provided between an output node connected to each pixel and a common electric potential in accordance with a first input signal from a first signal input, thus setting the electric potential of the output node at a first level; and a second step of one of holding the electric potential of the output node at the first level and setting the electric potential of the output node at a second level different from the first level, in accordance with a second input signal, from a second signal input, corresponding to the pixel data, wherein a switch, operable to select one of a first power supply voltage and a second power supply voltage which is different from said first power supply voltage in response to a control signal in which each of said first power supply voltage and said second power supply voltage is greater than zero, selects a voltage to set said first level, wherein a first switching element is connected between a common electric potential and the output node, and wherein the electric potential of the output node is held at the first level or the electric potential of the output node is held at the second level by switching the ON/OFF state of the first switching element.

27. The driving method for display system as claimed in claim 26, wherein the first level set at the first step is a level corresponding to the pixel data by each pixel.

28. The driving method for display system as claimed in claim 26, wherein the second level set at the second step is a level corresponding to the pixel data by each pixel.

29. The driving method for display system as claimed in claim 26, wherein a second switching element is connected between a power-supply voltage and the output node and wherein the capacitor is charged by setting the second switching element in the ON state, thus setting the electric potential of the output node at the first level.

30. The driving method for display system as claimed in claim 26, wherein the second switching element is constituted by an insulated gate field-effect transistor having its ON/OFF state controlled in accordance with the first input signal applied to the control gate thereof.

31. The driving method for display system as claimed in claim 26, wherein electric charges are discharged from the capacitor by setting the first switching element in the ON state, thus setting the electric potential of the output node at the second level.

32. The driving method for display system as claimed in claim 26, wherein the first switching element is constituted by an insulated gate field-effect transistor having its ON/OFF state controlled in accordance with the second input signal applied to the control gate thereof.

33. The driving method for display system as claimed in claim 32, wherein the electric potential of the output node is set at a predetermined electric potential between the power-supply voltage and the common electric potential, by controlling a conduction time of the insulated gate field-effect transistor in accordance with the second input signal.

34. The driving method for display system as claimed in claim 26, wherein the capacitor is a parasitic capacity existing between the output node and the common electric potential.

35. The driving method for display system as claimed in claim 26, wherein the first level is a level higher than a desired electric potential in anticipation of outflow of electric charges from the output node.

36. The driving method for display system as claimed in claim 26, the first level is a level lower than a desired electric potential in anticipation of inflow of electric charges to the output node.

37. The driving method for display system as claimed in claim 26, wherein each of the pixels includes:

a first electrode held at a common electric potential;

a second electrode connected to the output node of the voltage generating circuit; and a liquid crystal material provided between the first electrode and the second electrode.

38. The driving method for display system as claimed in claim 37, wherein the optical transmittance or reflectivity is controlled by changing the electric potential of the output node.

39. The driving method for display system as claimed in claim 37, the state of a plane of polarization of a light transmitted through or reflected by the liquid crystal material is controlled by changing the electric potential of the output node.

40. The driving method for display system as claimed in claim 37, wherein a ferroelectric liquid crystal material is used as the liquid crystal material.

41. The driving method for display system as claimed in claim 40, wherein the light modulation characteristic of each of the pixels is held by the memory characteristic of the ferroelectric liquid crystal material.

42. The driving method for display system as claimed in claim 40, wherein at the first step, the light modulation characteristic of the ferroelectric liquid crystal material is changed by setting the electric potential of the output node at the first level, and then applying, to the ferroelectric liquid crystal material, an electric field necessary for inverting spontaneous polarization of the ferroelectric liquid crystal material for not less than a period necessary for injecting electric charges of a quantity corresponding to not less than double that of the spontaneous polarization.

43. The spatial light modulating element as recited in claim 16, wherein the second data holding means is a parasitic capacity existing between the common electric potential and the second level setting means.

* * * * *